US010750849B2

(12) United States Patent
Woodard et al.

(10) Patent No.: US 10,750,849 B2
(45) Date of Patent: Aug. 25, 2020

(54) SKIN CLEANSING AND MASSAGING SYSTEM

(71) Applicant: WATER PIK, INC., Fort Collins, CO (US)

(72) Inventors: Brian Woodard, Fort Collins, CO (US); Michael J. Quinn, Windsor, CO (US)

(73) Assignee: WATER PIK, INC., Fort Collins, CO (US)

( * ) Notice: Subject to any disclaimer, the term of this patent is extended or adjusted under 35 U.S.C. 154(b) by 1158 days.

(21) Appl. No.: 15/090,525

(22) Filed: Apr. 4, 2016

(65) Prior Publication Data

US 2016/0287034 A1 Oct. 6, 2016

Related U.S. Application Data

(63) Continuation-in-part of application No. 14/678,781, filed on Apr. 3, 2015, now abandoned.

(51) Int. Cl.
*A46B 7/04* (2006.01)
*A46B 5/00* (2006.01)
(Continued)

(52) U.S. Cl.
CPC ..... *A46B 5/0012* (2013.01); *A46B 7/04* (2013.01); *A46B 11/063* (2013.01); *A46B 13/04* (2013.01);
(Continued)

(58) Field of Classification Search
CPC ..... A47K 7/04; A46B 5/00; A61C 17/22
See application file for complete search history.

(56) References Cited

U.S. PATENT DOCUMENTS 1,191,860 A 7/1916 Wesley
2,516,778 A 7/1950 Kreidenweiss
(Continued)

FOREIGN PATENT DOCUMENTS

BE 893388 10/1982
CN 2140203 8/1993
(Continued)

OTHER PUBLICATIONS

Aquacare rainfall combo, http://www.amazon.com/AquaCare-HotelSpa%C2%AE-Ultra-luxury-Rainfall-Hydrobrush/dp/B00JUTV2VS, retrieved on Dec. 30, 2014.
(Continued)

*Primary Examiner* — Michael D Jennings
(74) *Attorney, Agent, or Firm* — Dorsey & Whitney LLP

(57) ABSTRACT

A handheld, therapeutic cleansing system includes a skin or body brush with a rotating bristle head and an associated water spray. The body brush includes a housing, a brush assembly connected to the housing, and a drive assembly for rotating the brush assembly. The brush assembly includes a plurality of bristles and is rotated by the drive assembly. The drive assembly may include a motor having a drive shaft, a worm gear coupled to the drive shaft of the motor and rotatable therewith, and at least one gear engaged with the worm gear and rotatable therewith. During operation, the at least one gear couples to the brush assembly and rotates the brush assembly as the worm gear rotates. Water spray is provided through a connection with a water supply and spray nozzles adjacent to the bristles.

23 Claims, 43 Drawing Sheets

(51) Int. Cl.

| | |
|---|---|
| ***A46B 13/04*** | (2006.01) |
| ***A46B 11/06*** | (2006.01) |
| ***A47K 7/04*** | (2006.01) |
| ***B05B 1/18*** | (2006.01) |

(52) U.S. Cl.

CPC ..... *A47K 7/046* (2013.01); *B05B 1/18* (2013.01); *A46B 2200/102* (2013.01); *A46B 2200/1006* (2013.01)

(56) References Cited

U.S. PATENT DOCUMENTS 2,678,457 A 5/1954 Demo et al.
2,682,675 A 7/1954 Prucha
3,864,780 A 2/1975 Watkins
3,910,265 A 10/1975 Coleman
3,927,434 A 12/1975 Burgess
4,089,079 A 5/1978 Nicholson
4,151,623 A 5/1979 Steere
4,228,558 A 10/1980 Zhadanov
4,239,409 A 12/1980 Osrow
4,417,826 A 11/1983 Floros
4,461,052 A 7/1984 Mostul
4,703,536 A 11/1987 Livneh
D295,696 S 5/1988 Larsen
4,796,321 A 1/1989 Lee
4,841,590 A 6/1989 Terry et al.
D313,267 S 12/1990 Lenci et al.
4,998,836 A 3/1991 Scripnick
5,033,897 A 7/1991 Chen
5,065,463 A 11/1991 Le
5,142,723 A 9/1992 Lusting
5,382,221 A 1/1995 Hsu et al.
5,385,532 A 1/1995 Shyu
D369,026 S 4/1996 Furbert et al.
5,561,869 A 10/1996 Sarel
5,647,841 A 7/1997 Groenewold et al.
5,769,802 A 6/1998 Wang
5,891,063 A 4/1999 Vigil
6,021,539 A 2/2000 Zhadanov
6,041,462 A 3/2000 Marques
6,058,543 A 5/2000 Thompson
6,170,108 B1 1/2001 Knight
6,205,607 B1 3/2001 Tse
6,230,717 B1 5/2001 Marx et al.
D447,635 S 9/2001 Smith
6,363,565 B1 4/2002 Paffrath
6,450,425 B1 9/2002 Chen
6,569,170 B1 5/2003 Kellogg
6,595,440 B2 7/2003 Moriarty et al.
RE38,397 E 1/2004 Gueret
6,730,051 B2 5/2004 Lin
D493,621 S 8/2004 Wilson et al.
6,799,346 B2 10/2004 Jeng et al.
D500,358 S 12/2004 Haug
D523,809 S 6/2006 Roth et al.
7,157,816 B2 * 1/2007 Pilcher ..... H02K 33/16 310/36
D549,964 S 9/2007 Roth et al.
7,293,302 B2 11/2007 Mesa
7,306,569 B2 12/2007 LaJoie et al.
7,320,691 B2 1/2008 Pilcher et al.
7,337,487 B2 3/2008 Leonardi
7,386,906 B2 6/2008 Roth et al.
D579,516 S 10/2008 Hsu
7,451,513 B2 11/2008 Torres
D601,803 S 10/2009 Reishus et al.
7,597,495 B2 10/2009 Gueret
7,665,171 B2 2/2010 Alexander et al.
7,670,305 B2 3/2010 Zhadanov et al.
7,758,525 B2 7/2010 Thiebaut et al.
7,786,626 B2 8/2010 Reishus et al.
7,789,092 B2 9/2010 Akridge et al.
7,789,326 B2 9/2010 Luettgen et al.
7,814,585 B1 10/2010 Reich
7,823,593 B2 11/2010 Gueret
7,841,927 B2 11/2010 Krause et al.
7,857,241 B2 12/2010 Deng
D638,221 S 5/2011 Liao et al.
7,941,887 B2 5/2011 Tasai
8,088,085 B2 1/2012 Thiebaut et al.
8,157,753 B2 4/2012 Nichols
8,302,615 B2 11/2012 Thiebaut
8,308,390 B2 11/2012 Kao
D679,502 S 4/2013 Itano et al.
8,407,825 B2 4/2013 Kao
8,425,134 B2 4/2013 Gueret
D683,139 S 5/2013 Chikos et al.
8,439,588 B2 5/2013 Houman
8,469,909 B2 6/2013 Pilcher et al.
8,484,788 B2 7/2013 Brewer et al.
8,511,927 B2 8/2013 Houman
8,555,811 B2 10/2013 Dole
8,608,251 B2 12/2013 Nirwing et al.
D705,900 S 5/2014 Bailey
D719,640 S 12/2014 Yu
8,985,886 B1 3/2015 Derrick
9,032,576 B2 5/2015 Zelickson et al.
9,107,486 B2 8/2015 Brewer et al.
9,138,257 B2 9/2015 Revivo
9,433,281 B1 9/2016 Barras
2004/0117931 A1 6/2004 Washington
2004/0167481 A1 8/2004 Carlucci et al.
2005/0125890 A1 6/2005 Zhadanov et al.
2005/0138740 A1 6/2005 Alfano
2006/0076436 A1 4/2006 Zhadanov et al.
2007/0095362 A1 5/2007 Koopah
2007/0101522 A1 5/2007 Alfano
2008/0104787 A1 5/2008 Keenan et al.
2011/0085845 A1 4/2011 Cutler
2011/0114754 A1 5/2011 Li et al.
2011/0121105 A1 5/2011 Moriarty et al.
2011/0142529 A1 6/2011 Oh et al.
2011/0185521 A1 8/2011 Temple
2012/0037184 A1 2/2012 Czetty et al.
2012/0124758 A1 5/2012 Sabisch et al.
2012/0138087 A1 6/2012 Newlin
2012/0159724 A1 6/2012 Houman
2012/0209151 A1 8/2012 Zhou et al.
2012/0227197 A1 * 9/2012 Fleischer ..... F21V 21/0885 15/105
2013/0060176 A1 3/2013 Nichols
2013/0098382 A1 4/2013 Martin et al.
2013/0139841 A1 6/2013 Dumousseaux et al.
2014/0007362 A1 1/2014 Park et al.
2014/0058300 A1 2/2014 Ungemach et al.
2014/0099154 A1 4/2014 O'Neill
2014/0135665 A1 5/2014 Pilcher et al.
2014/0276281 A1 9/2014 Nefcy
2014/0305458 A1 10/2014 Brewer et al.
2014/0309662 A1 10/2014 Brewer et al.
2015/0040331 A1 2/2015 White
2015/0065927 A1 3/2015 Brewer et al.
2015/0165179 A1 6/2015 Grez
2015/0182078 A1 7/2015 Miller et al.
2015/0182290 A1 7/2015 Grez
2015/0305487 A1 10/2015 Pardo et al.
2015/0359324 A1 12/2015 Brewer
2016/0015150 A1 1/2016 Casasanta, III
2016/0037902 A1 2/2016 Grez
2016/0151133 A1 * 6/2016 Luettgen ..... F04B 53/14 433/80
2016/0287035 A1 10/2016 Woodard et al.

FOREIGN PATENT DOCUMENTS

CN 2169359 6/1994
CN 1410168 4/2003
CN 2611047 4/2004
CN 2723038 9/2005
CN 2843622 12/2006
CN 1972612 5/2007
CN 2910075 6/2007
CN 201026474 2/2008

(56) References Cited

FOREIGN PATENT DOCUMENTS

| | | |
|---|---|---|
| CN | 201346171 | 11/2009 |
| CN | 101797128 | 8/2010 |
| CN | 201949941 | 8/2011 |
| CN | 202045028 | 11/2011 |
| CN | 102349739 | 2/2012 |
| CN | 202842758 | 4/2013 |
| CN | 203170464 | 9/2013 |
| CN | 103655160 | 3/2014 |
| CN | 103717116 | 4/2014 |
| CN | 203860668 | 10/2014 |
| CN | 203861095 | 10/2014 |
| CN | 204091850 | 1/2015 |
| CN | 204192481 | 3/2015 |
| CN | 204671034 | 9/2015 |
| DE | 1566490 | 11/1970 |
| EP | 0280833 | 9/1988 |
| GB | 2237505 | 5/1991 |
| IL | 10471 | 4/1987 |
| IL | 23733 | 12/1996 |
| JP | D1477160 | 8/2013 |
| JP | D1477161 | 8/2013 |
| WO | WO01/19281 | 3/2001 |
| WO | WO2010/084870 | 7/2010 |
| WO | WO2013/021380 | 2/2013 |
| WO | WO2013/095462 | 6/2013 |
| WO | WO2013/122400 | 8/2013 |
| WO | WO2014/173126 | 10/2014 |
| WO | WO2016/161451 | 10/2016 |

OTHER PUBLICATIONS

Interlink TheraClense™, http://www.itlk.com/theraclense.html, retrieved on Dec. 30, 2014.

Koninklijke Philips N.V. PureRadiance Facial Cleansing System leaflet, 2014, 2 pages.

Koninklijke Philips N.V. PureRadiance user manual, 2014, 64 pages.

Aquatrim-shower massage, http://www.kaboodle.com/reviews/aquatrim--shower-massage, retrieved on Mar. 27, 2015.

Encapsulation Carpet Cleaning is Changing the Industry, http://cimex-carpet-cleaning.com/#Company, retrieved on Mar. 27, 2015.

* cited by examiner

SKIN CLEANSING AND MASSAGING SYSTEM

CROSS REFERENCE TO RELATED APPLICATIONS

The present application is a continuation-in-part of and claims priority to U.S. application Ser. No. 14/678,781 filed 3 Apr. 2015 entitled "Skin Cleansing and Massaging System," the disclosure of which is hereby incorporated by reference in its entirety.

TECHNICAL FIELD

The technology disclosed herein relates generally to cleansing brushes and more specifically, to skin cleansing brushes.

BACKGROUND

Cleaning and exfoliating skin is a typical part of a hygiene routine for many people. Recently, skin brushes, including a single rotating brush head, have been introduced and have been marketed as a way to clean, stimulate, and/or exfoliate skin better than a person's hands can do alone. However, these skin brushes are typically not designed for use in a wet environment, such as a shower. For example, many current skin brushes are electrically driven and cannot be submerged or covered in water without malfunctioning. Other categories of skin brushes may be water-driven, but typically do not have sufficient power to rotate the brush head in a desired manner. For example, users may apply some pressure to the brush head as they apply the brush to their skin and the water-driven mechanism may not be sufficiently strong to overcome the force. Thus, the brush head may cease to rotate or stall out. Therefore, there is a need for a water-safe brush having a brush head motion that can overcome pressure against the skin, while also providing a cleansing and exfoliating function.

The information included in this Background section of the specification, including any references cited herein and any description or discussion thereof, is included for technical reference purposes only and is not to be regarded subject matter by which the scope of the invention is to be bound.

SUMMARY

A bathing or skin cleansing system is disclosed which includes a powered skin brush and optionally a showerhead and bracket for connecting the skin brush to the showerhead. The skin brush includes a bristle carrier for supporting one or more bristle groups and a drive mechanism that rotates the bristle carrier. The drive assembly that rotates the bristle carrier may be water driven or electrically powered by a motor. A gear reduction assembly may be used to rotate the bristle carrier at a desired speed that provides a pleasant sensation on a user's skin and also acts to remove debris and provide a stimulating effect.

In one implementation, a hand-held, rotating, therapeutic brush has a housing, a brush assembly, and a drive assembly. The brush assembly may have a plurality of bristles and may be releasably coupled to the housing. The drive assembly rotates the brush assembly and may include a motor having a drive shaft. A worm gear may be coupled to the drive shaft and rotate therewith. An additional gear may be engaged with the worm gear. The additional gear may be operably coupled to the brush assembly and configured to rotate the brush assembly as the worm gear rotates. A plurality of nozzles may be defined by or connected to the housing. A fluid flow path may fluidly connect the plurality of nozzles to a fluid source.

In another implementation, a handheld rotating brush for contact with a user's skin includes a handle, a brush head, and a brush assembly. The brush head may extend from the handle and a connection magnet may be positioned within the brush head. The brush assembly may be releasably coupled to the brush head. The brush assembly may further include a bristle base and a plurality of bristles extending from an outer surface of the bristle base. The brush assembly may also include a brush magnet supported by the bristle base. The connection magnet and the brush magnet attractively connect to releasably couple the brush assembly to the brush head. In one embodiment, the brush head may include an inductive charging coil to charge a battery pack in the brush head. A charging assembly may be provided with the handheld rotating brush and selectively coupled to the handheld rotating brush, wherein when activated the charging assembly induces a current in the charge coil to charge the battery pack.

In a further implementation a hand-held, therapeutic, cleansing system is configured for fluid communication with a water source. The system includes a diverter valve, a showerhead, a body brush, and a bracket. The diverter valve is configured for connection to the water source. The showerhead is connected to a first outlet of the diverter valve. The body brush is connected to a second outlet of the diverter valve. The body brush includes a motor assembly, a rotatable bristle assembly driven by the motor assembly, and a nozzle array in fluid communication with the second outlet of the diverter valve. The bracket is operably coupled to the fluid source and defines a cradle recess configured to support the brush for storage.

In another implementation, a skin brush is provided including a housing, a brush assembly, a drive assembly, and a battery. The housing may have a handle portion and a head portion. The brush assembly may be operably coupled to the head portion of the housing. The drive assembly may be positioned in the head portion and operably coupled to the brush assembly, wherein the drive assembly drives the brush assembly. The battery may be received within the head portion and electrically connected to the drive assembly. The battery is positioned at a first angle relative to a longitudinal axis of the handle portion.

In yet another implementation, a handheld brush for cleansing a user's skin includes a housing, an electrically powered drive assembly, a brush assembly, and a plurality of spray nozzles. The handle portion may have a fluid inlet and a fluid passage connected to the fluid inlet. The head portion may extend from the handle portion and include a front surface defining a brush recess surrounded by an outer wall. The electrically powered drive assembly may be received within the housing. The brush assembly may be positioned within the brush recess and may be operably connected to the drive assembly. The drive assembly may rotate the brush assembly relative to the housing. The plurality of spray nozzles may be in fluid communication with the fluid passage and may be defined in part by the housing and spaced around the outer wall of the brush recess.

In an alternate implementation, a fluid connection assembly for a handheld brush includes a hose connector body, a latch positioned with the hose connector body, and a latch biasing element positioned within the hose connector body. The latch biasing element biases the latch towards a first end of the hose connector body. A knob is operably coupled around an outer surface of the hose connector body. One or more balls are operably coupled to the hose connector body and are movable between a first position where the one or more balls engage the knob and a second position where the one or more balls disengage from the knob.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments of the invention and illustrated in the accompanying drawings.

DETAILED DESCRIPTION

Figure 1:
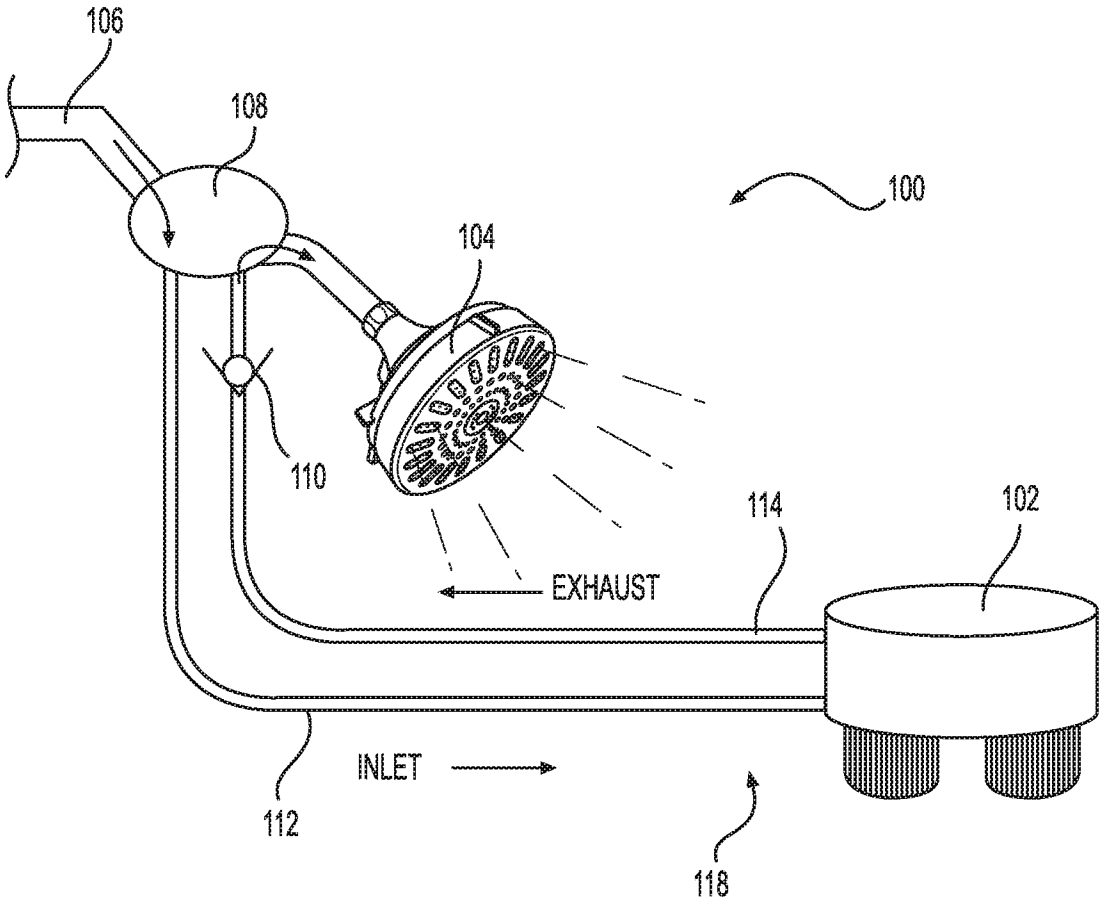
FIG. 1 is a side isometric view of a cleansing system including a showerhead and a skin brush.

This disclosure is related to a bathing or skin cleansing system including a skin brush and optionally a showerhead and bracket for connecting the skin brush to the showerhead. The skin brush includes a drive mechanism that may be water and/or electrically powered, and a bristle carrier for supporting one or more bristle groups. In one embodiment, the skin brush includes a bristle carrier or brush assembly that is electrically driven by a motor. A gear reduction assembly is so that the bristles are rotated at a desired speed that feels good on a user's skin and also acts to remove debris and provide a stimulating effect. In this embodiment, the bristle carrier may include a single set of bristles having substantially uniform characteristics to provide a uniform feeling on the skin.

In one embodiment, the drive assembly may include a worm gear that engages a cluster gear to transfer motion from the motor to the bristle carrier. In this embodiment, the cluster gear may include two different types of gear teeth; one for a worm wheel that meshes with the worm gear and another for a shaft gear that meshes with an output gear connected to an output shaft. In this example, the worm wheel may have a helical gear shape whereas the shaft gear may have a straight cut gear. By combining different gear types into a single part, the skin brush can be manufactured economically as fewer parts are required.

In other embodiments, the bristle carrier and the bristle groups are driven by a planetary gear arrangement, such that as the bristle carrier is rotated by the drive mechanism, the bristle carrier rotates in a first direction at a first speed and the bristle groups are the planet gears for the gear mechanism and each rotate in a second direction at a second speed. This configuration allows the bristles to exert a sufficiently strong force on a user's skin, while also alternatingly stimulating different sections of the user's skin in a particular location. This motion exerts a sufficiently stimulating effect so that users are less likely to exert a strong force against the brush, such as to push the brush against the skin. Thus, the skin brush may be less likely to stall out during use.

The bristle groups and/or the bristle carrier may be removable to allow replacement. For example, some users may wish to share the brush with different people, but may not want to have others use the bristle groups due to hygienic reasons. In these embodiments, the bristles may be attached to a substrate that is secured to the bristle carrier through a magnetic connection. This allows the bristles to be quickly and easily removed from the brush, as well as assists a user in aligning the bristles with the carrier correctly.

In some embodiments, the brush may include nozzles that provide water or other fluid (e.g., cleaning solutions, medicines, etc.) output to the user, such as outputting a massaging stream of water. In one example, the brush may include integrated nozzles that are formed within a handle or on the face of the brush. In this embodiment, the brush may include a releasable water connection to enhance the portability of the brush. In another example, the brush may include a releasable nozzle assembly that selectively connects and disconnects to the brush. In this embodiment, the nozzle assembly may be permanently attached to a fluid source or may include a releasable attachment to the fluid source.

In embodiments where the brush includes a fluid output the brush may include a connector assembly for providing a quick connection to a fluid source, such as a hose or tube. In these embodiments, the connector assembly may include a self-securing latch that automatically latches into place when a user inserts the hose. Additionally, the connector assembly may automatically reconfigure itself into an insertion position to allow a user to easily insert the hose into the connector, without having to first pull or otherwise configure the connector assembly to an insertion position.

Additionally, in embodiments where the skin brush includes an electrically powered drive assembly, the cleansing system may include a charging device for recharging batteries within the skin brush. To allow the skin brush to maintain a waterproof enclosure or otherwise ensure that water does not leak into the skin brush and damage the electrical components, the charging device may be an inductive charger that uses magnetic fields to transfer electricity between an external power source and the brush. The charging device can be configured to mate with a portion of the skin brush to ensure adequate alignment during charging to enhance efficiency and reduce charging time.

Figure 2A:
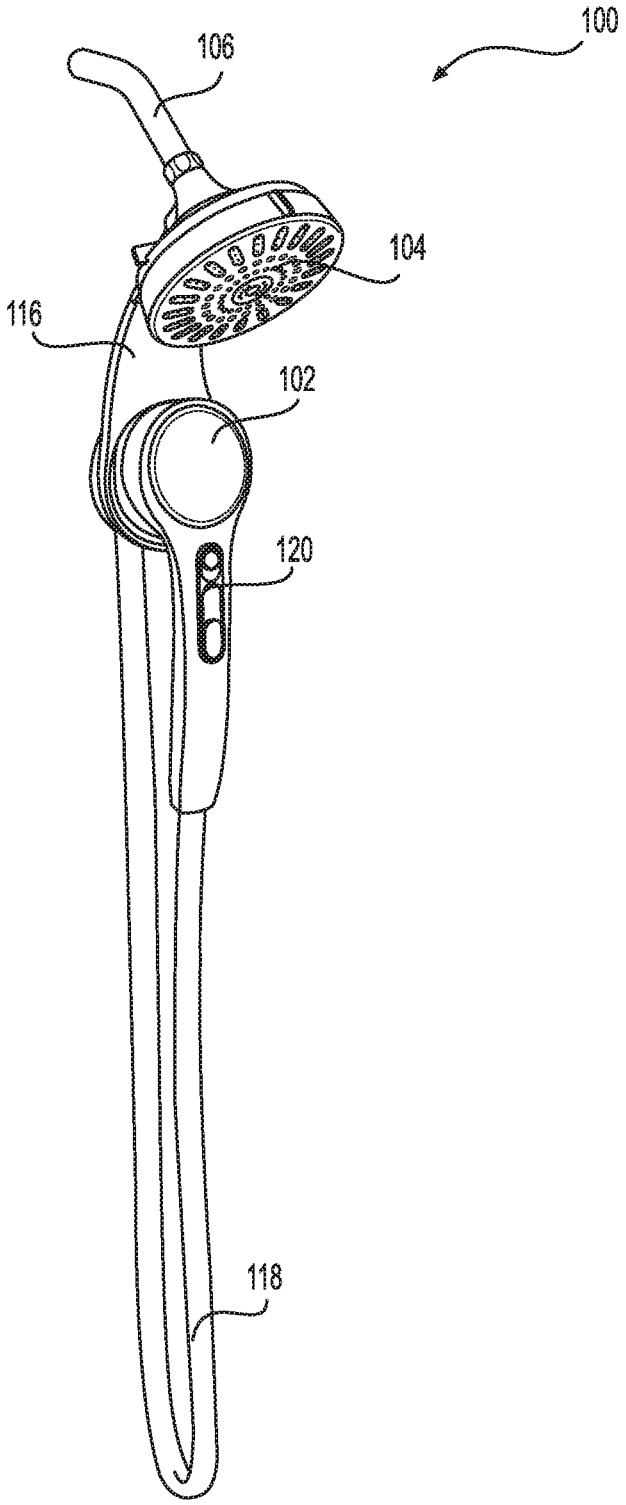
FIG. 2A is a front isometric view of another example of the cleansing system of FIG. 1.
Figure 2B:
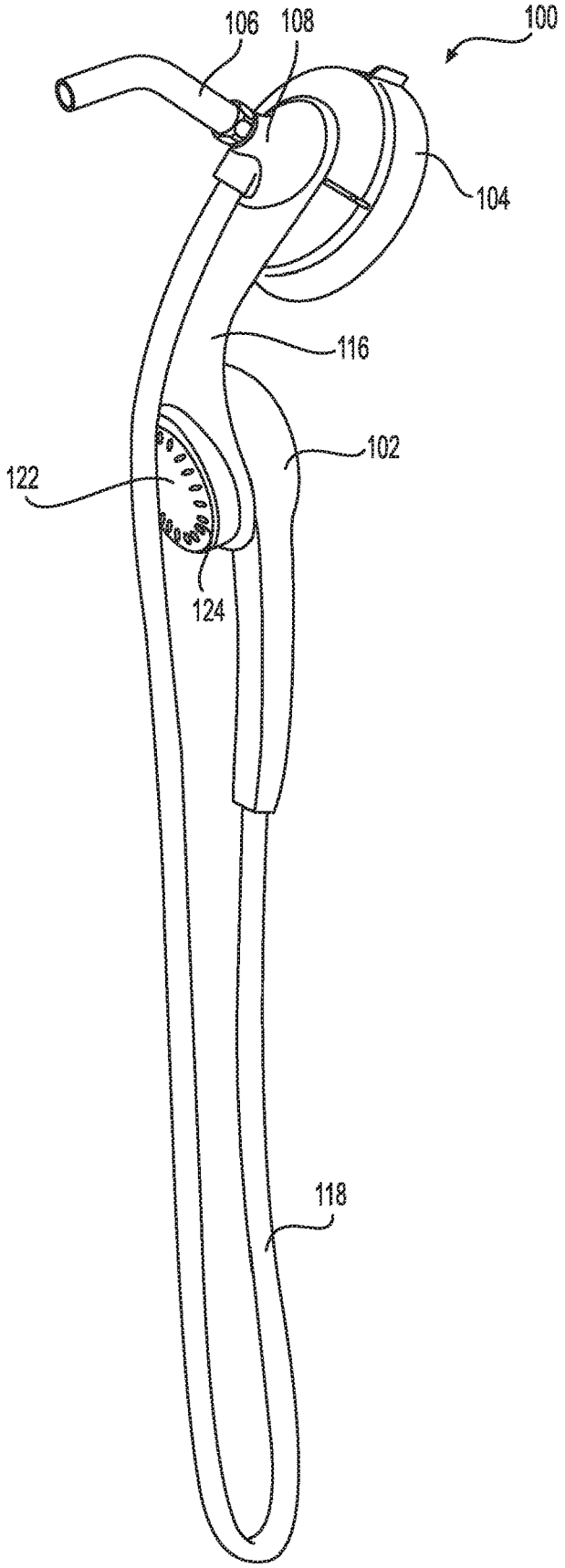
FIG. 2B is a rear isometric view of the cleansing system of FIG. 2A.

Turning to the figures, a first example of a cleansing system of the present disclosure will now be discussed in more detail. FIG. 1 illustrates a simplified schematic diagram of the cleansing system 100. FIGS. 2A and 2B illustrate various views of the cleansing system of FIG. 1 including a bracket and integrated hose for connecting the brush to a showerhead. With reference to FIG. 1, the cleansing system 100 may include a brush 102, a showerhead 104, and optionally a hose 118 fluidly connecting the brush 102 to the showerhead 104.

In the embodiment shown in FIGS. 1-2B, the showerhead 104 is a fixed mount showerhead. However, in other embodiments, the showerhead 104 may be a handheld showerhead. The showerhead 104 connects to a fluid source by a J-pipe 106 or other mechanism. In embodiments where the brush 102 is fluidly connected to the showerhead 104 and/or another fluid source, the cleansing system 100 may include a diverter valve 108 for selectively directing fluid from the J-pipe 106 to the brush 102 and/or the showerhead 104. The diverter valve 108 may be located between the showerhead 104 and the J-pipe 106 and/or between the hose 118 and the brush 102 or on the brush 102 itself.

In some embodiments, the cleansing system 100 of FIGS. 1-2B may include a bracket 116 for connecting the brush 102 to the showerhead 104. The bracket 116 provides a convenient place to store the brush 102 and helps to prevent the brush 102 from collecting debris and the like. The bracket 116 may be concavely curved or otherwise shaped to direct the brush 102 out of the spray path of the showerhead 104, as well as enhance the aesthetics of the cleansing system 100. The bracket 116 may include a brush recess 112 or aperture or other cradle structure for receiving a front face of the brush 102 and securing the brush 102 to the bracket 116. In embodiments including the brush recess 112, a back wall of the brush recess 112 may include a plurality of drying apertures 124 defined through a back surface thereof. The drying apertures 124 may be defined around an outer perimeter of the back surface and provide an air pathway through the bracket 116 to the brush 102 to allow the bristles on the brush 102 to dry more quickly.

Figure 3A:
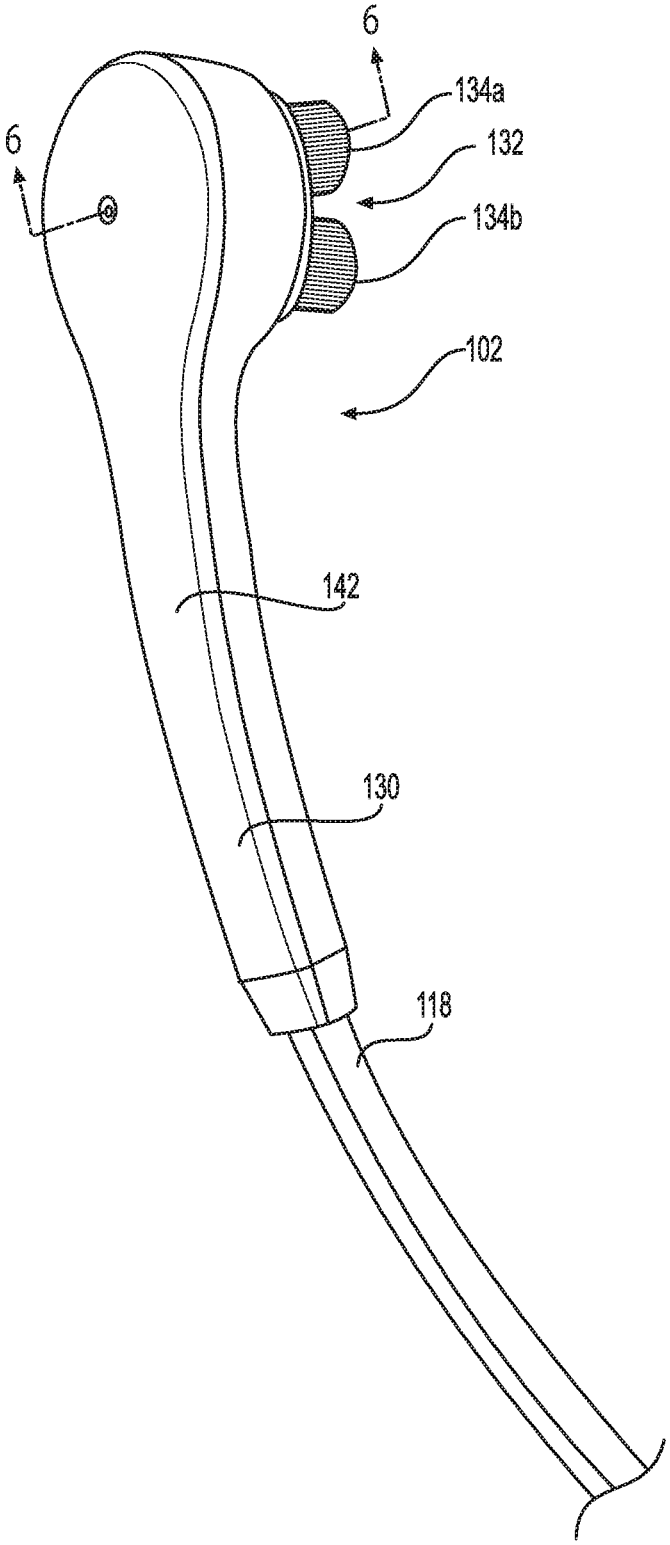
FIG. 3A is a rear isometric view the skin brush from the system of FIG. 1.
Figure 3B:
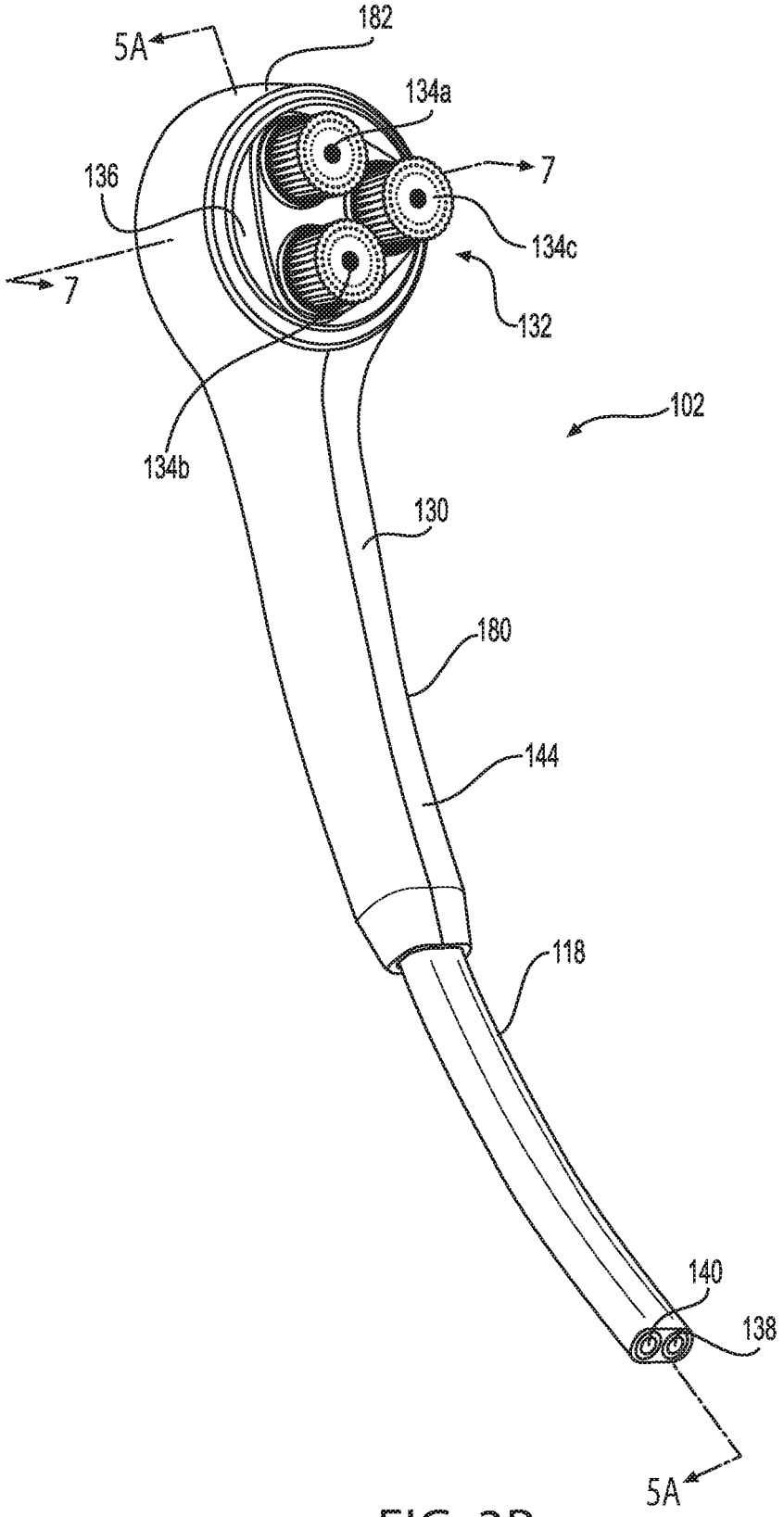
FIG. 3B is a front isometric view of the skin brush of FIG. 3A.
Figure 4:
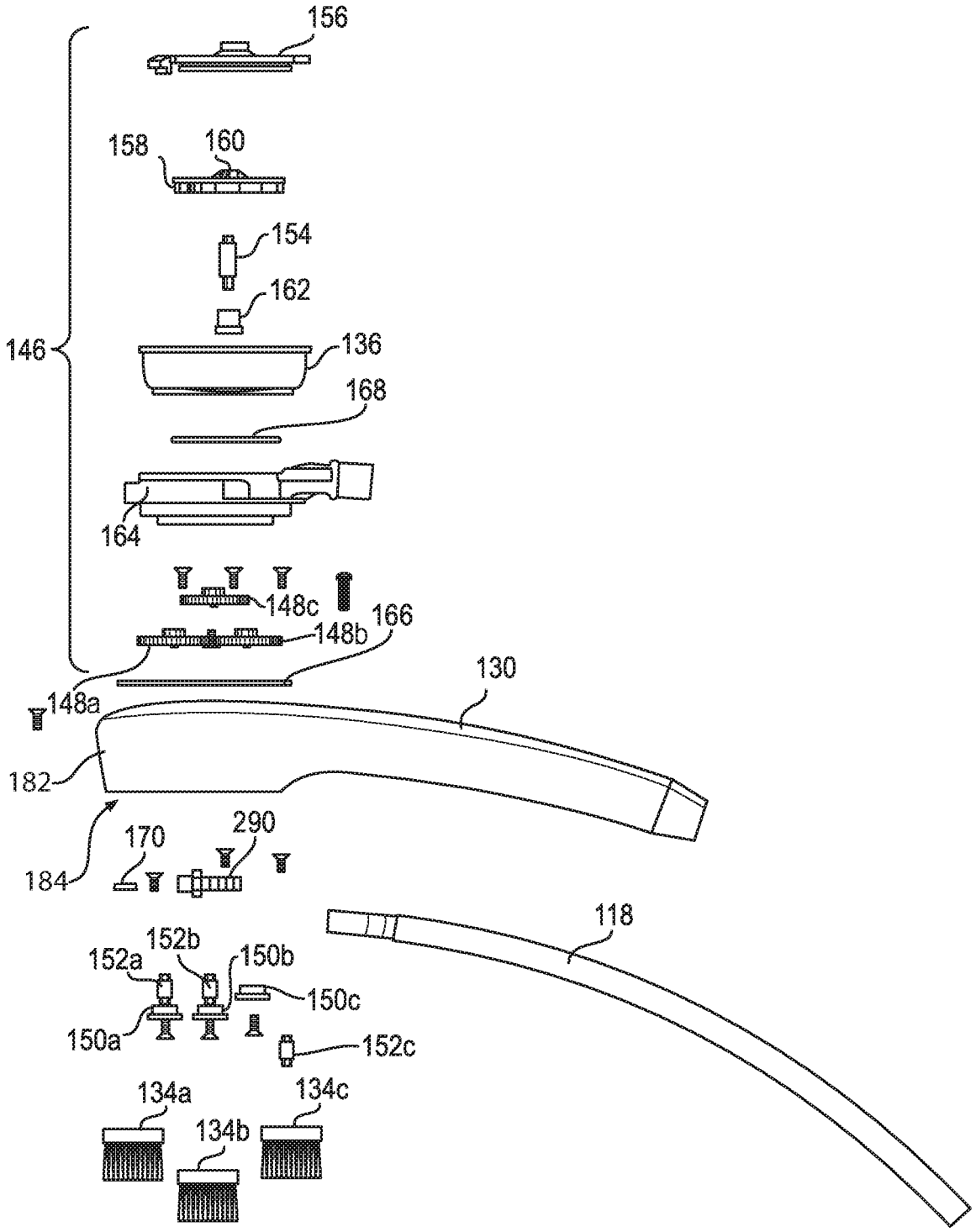
FIG. 4 is an exploded view of the skin brush of FIG. 3A.
Figure 5A:
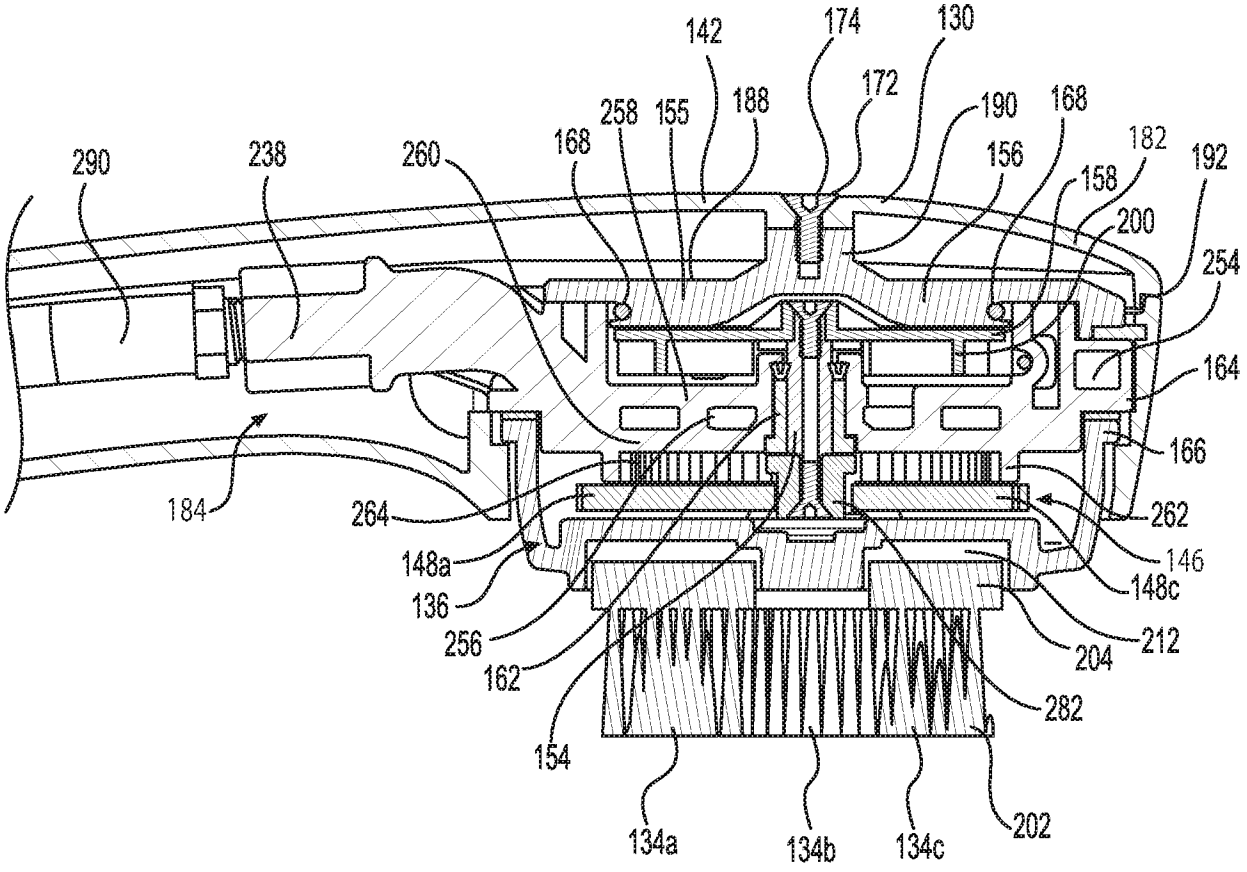
FIG. 5A is a cross-section view of the skin brush of FIG. 3A taken along line in FIG. 3B.
Figure 5B:
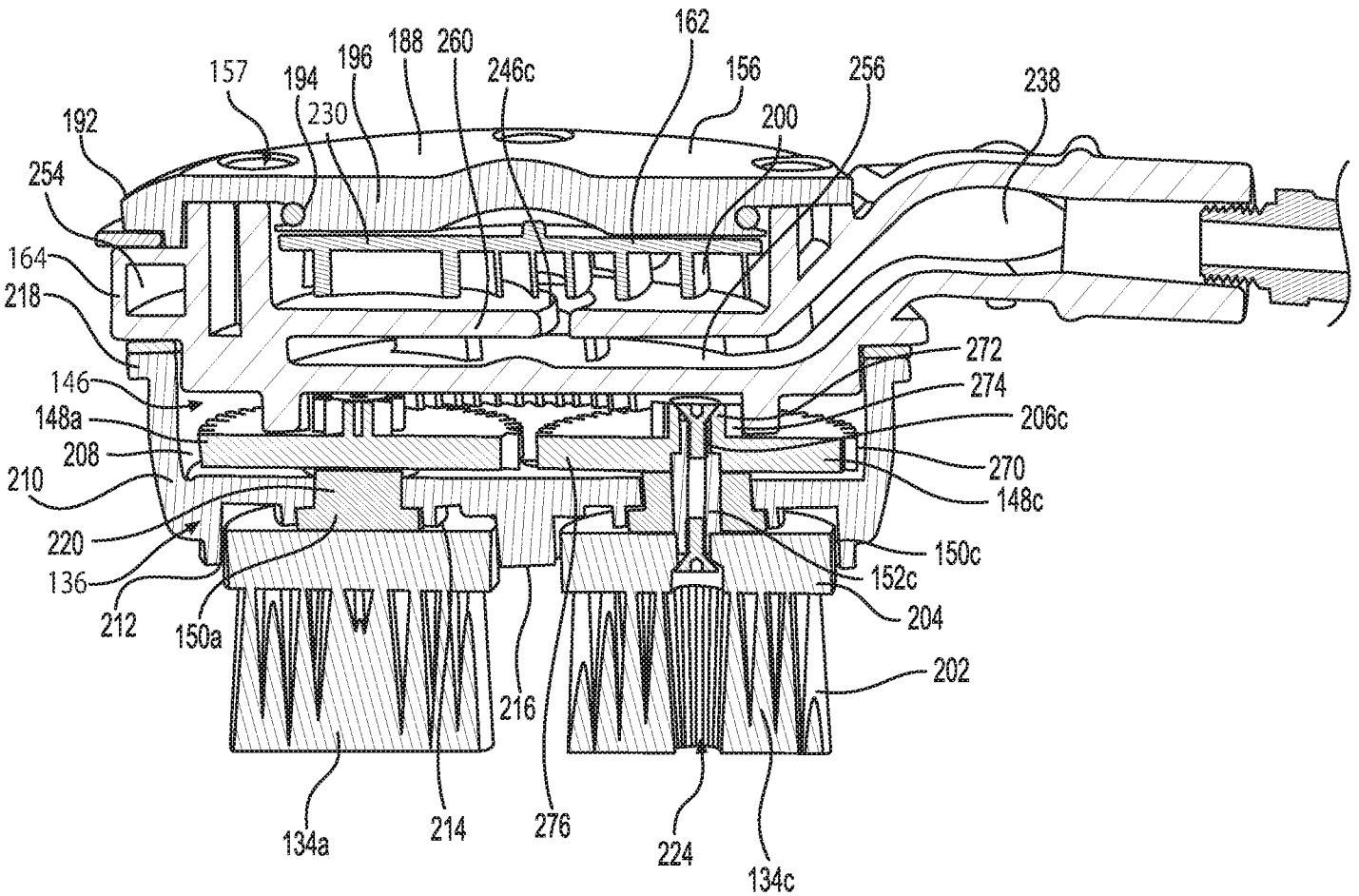
FIG. 5B is a cross-section view of the skin brush of FIG. 3A, similar to FIG. 5A but with select components hidden for clarity.

The brush 102 of the cleansing system 100 will now be discussed in more detail. FIGS. 3A and 3B illustrate various isometric views of the brush 102. FIG. 4 is an exploded view of the brush 102. FIGS. 5A and 5B illustrate various cross-section views of the brush 102. With reference to FIGS. 3A-5B, the brush 102 includes a handle 130 having a top surface 142 and a bottom surface 144 and a brush assembly 132. The brush assembly 132 includes a brush carrier 136 including three brushes 134*a*, 134*b*, 134*c* spaced apart from another. The brush assembly 132 is driven by an engine 146 housed within the handle 130. The hose 118 fluidly connects the brush 102 to the showerhead 104 and includes an inlet 138 and an outlet 140. Each of the components will be discussed, in turn, below.

The handle 130 houses the various components of the brush 102 and provides a mechanism to allow a user to manipulate the brush 102. For example, the handle 130 includes a handle cavity 184 that receives the engine 146, brush carrier 136, and one or more fluid conduits. The handle 130 includes an elongated shaft 180 and a head 182. The shaft 180 is typically sized to allow a user to comfortably grip the outer surface to manipulate the brush 102. Additionally, the shaft 180 may be sized and shaped to allow a user's fingers to extend around, as well as to be aesthetically pleasing. The head 182 may be formed separately from the shaft 180 and connected thereto or may be integrally formed with the shaft 180 and extend therefrom. The head 182 may have a round shape and be configured to receive the various components of the brush carrier 136 and engine 146. The shape of the handle 130, including the head 182, shaft 180, and handle cavity 184 may be varied as desired based on the configurations of the brush 102, type of drive mechanisms, and so on.

The brush assembly 132 includes the brush carrier 136 and the plurality of brushes 134*a*, 134*b*, 134*c*. The brush carrier 136 supports the brushes 134*a*, 134*b*, 134*c* on the brush 102 and in some embodiments allows movement of the brushes 134*a*, 134*b*, 134*c* relative thereto. In these embodiments, the brush carrier 136 includes an outer surface 216 that forms an outer surface of the brush 102. The outer surface 216 transitions to an outer wall 210 that extends outward and upward from around a perimeter of the outer surface 216. The outer wall 210 may include a lip 218 formed on a terminal end thereof. The outer wall 210 and the outer surface 216 define a recess 208 for receiving one or more components of the engine 146. Additionally, one or more brush compartments 212 may be defined on the outer surface 216. In the embodiment shown in FIGS. 3A-5B, three brush compartments 212 are defined on the outer surface 216, each receiving a portion of one of the brushes 134*a*, 134*b*, 134*c*. With reference to FIG. 5B, each of the brush compartments 212 may include a bushing wall 214 surrounding a bushing aperture 220 defined through the outer surface 216.

Each of the brushes 134*a*, 134*b*, 134*c* may be substantially similar to one another and each may include a brush base 204 and a plurality of bristles 202 extending from, or otherwise connected thereto. The brush base 204 supports the bristles 202 and allows the bristles 202 to be rotated in a collective group. The bristles 202 may be glued or otherwise connected to the brush base 204. The bristles 202 may be arranged in any desired manner, but in some embodiments are arranged in concentric rows and so as to define a fastening aperture 224 through a central region of each brush 134*a*, 134*b*, 134*c*. The fastening aperture 224 may be defined so as to assist in the assembly of the brushes 134*a*, 134*b*, 134*c* so that a fastener may be more easily inserted through the brush base 204 and bristles 202. However, in other embodiments, the bristles 202 may be otherwise configured and the fastening aperture 224 may be omitted or defined in another manner.

Water Driven Embodiments

With reference to FIGS. 4, 5A, 5B, and 6, in embodiments where the brush is water driven, the engine 146 defines a drive assembly or drive mechanism for the brush 102 and includes the components for creating the motion of the brush 102 and, in particular, the brushes 134*a*, 134*b*, 134*c* and brush carrier 136. The engine 146 includes an engine cap 156, an engine housing 164, a sun gear 282, a plurality of planet gears 148*a*, 148*b*, 148*c*, a turbine 158, a plurality of shaft elements (e.g., planet shafts 152*a*, 152*b*, 152*c* and turbine shaft 154), a plurality of carrier bushings 150*a*, 150*b*, 150*c*, and turbine bushing 162, and a plurality of fasteners.

The engine cap 156 forms an end cap for the engine 146 assembly and includes a top surface 188 and a base 196 extending downward from the top surface 188. An annular groove 194 is defined around an outer edge circumference of the base 196 and is configured to receive a sealing element, such as O-ring 168. A fastening protrusion 190 extends upward from the top surface 188 and includes a fastening recess 191 defined through a portion thereof, configured to receive a fastener 174. Additionally, the engine cap 156 may include a plurality of fastening apertures 157 defined around an outer perimeter of the top surface 188 that are configured to receive fasteners 159 to secure the engine cap 156 to the engine housing 164. The engine cap 156 may include a beveled ledge 192 extending from a front end.

Figure 6:
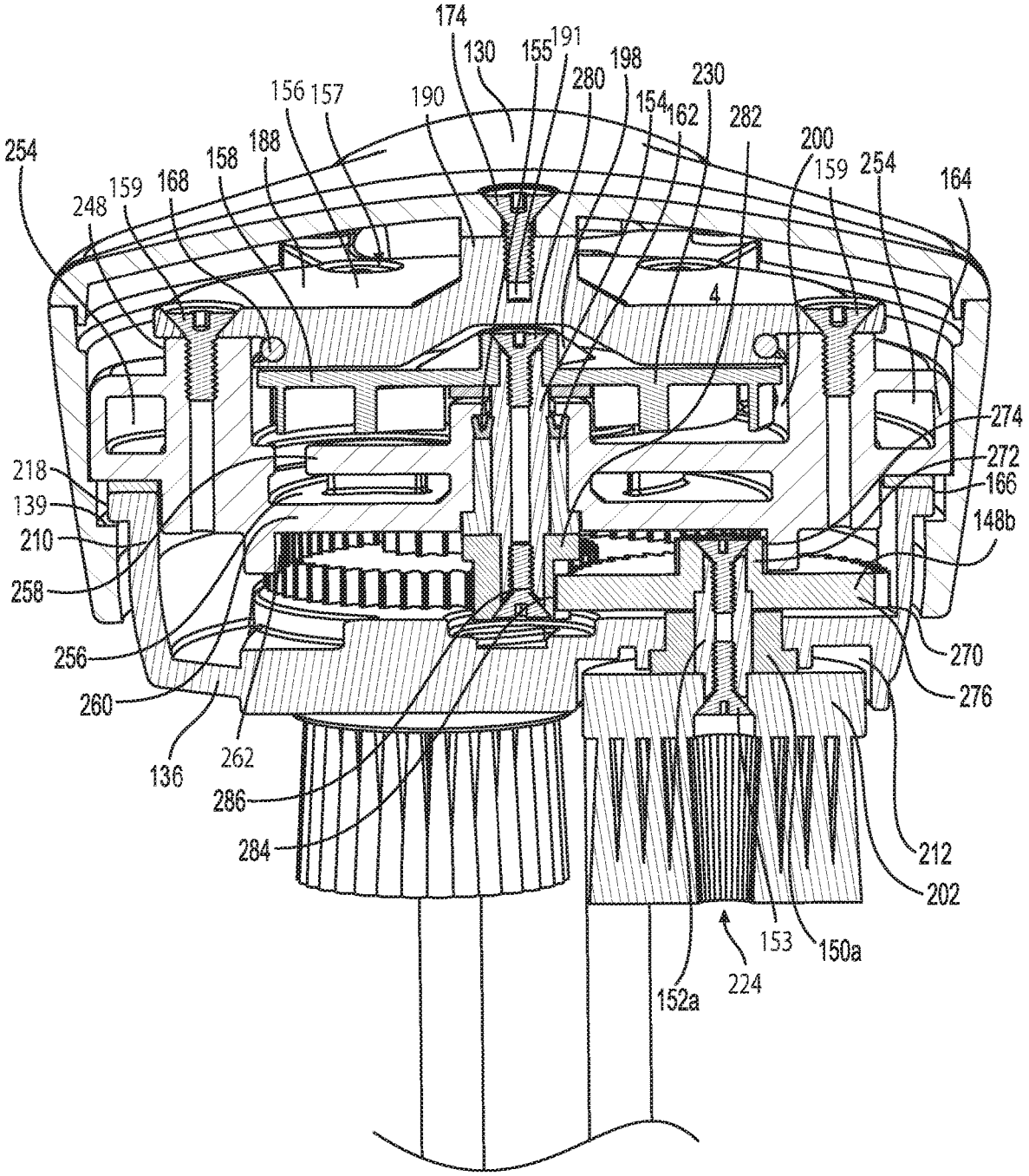
FIG. 6 is a cross-section view of the skin brush of FIG. 3A taken along line 6-6 in FIG. 3A.
Figure 7:
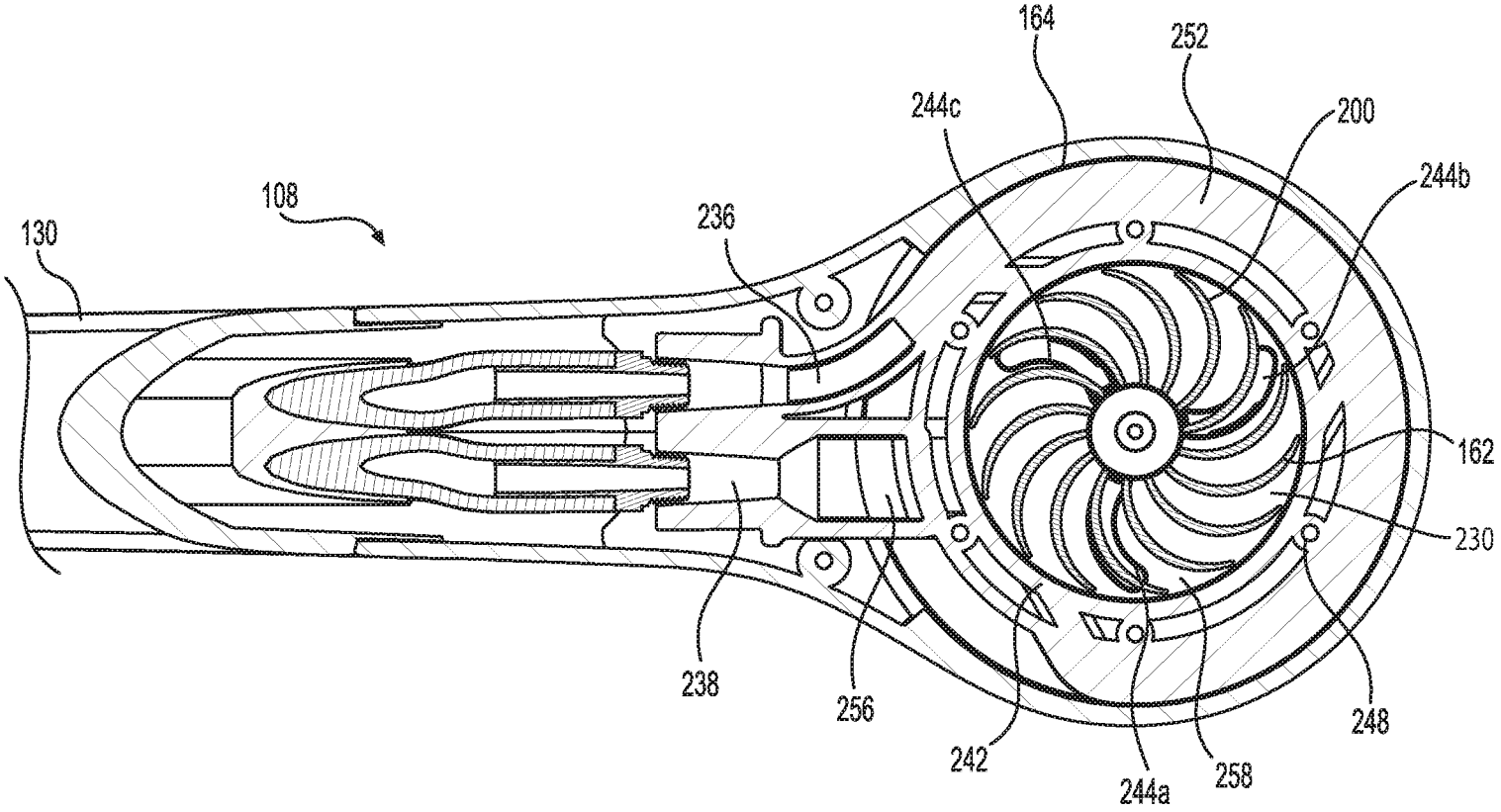
FIG. 7 is cross-section view of the skin brush of FIG. 3A taken along line 7-7 in FIG. 3B.

The engine 146 also includes a turbine 158 for driving the brushes 134*a*, 134*b*, 134*c* and brush carrier 136. The turbine 158 includes a disc shaped body 230 having a fastening protrusion 198 extending upward from a first surface of the body 230 and a plurality of fins 200 extending downward from a second surface. FIG. 7 is a cross-section of brush 102 taken along line 7-7 in FIG. 3B. With reference to FIGS. 5A-7, the fins 200 extend radially from a center of the body 230 and are curved as they extend from the center of the body 230 toward the outer perimeter of the body 230. The fins 200 may be differently configured but are generally designed so as to define a surface onto which water exerts a force to spin the turbine 158 as will be discussed in more detail below; e.g., tangentially oriented relative to an inlet nozzle.

Figure 8A:
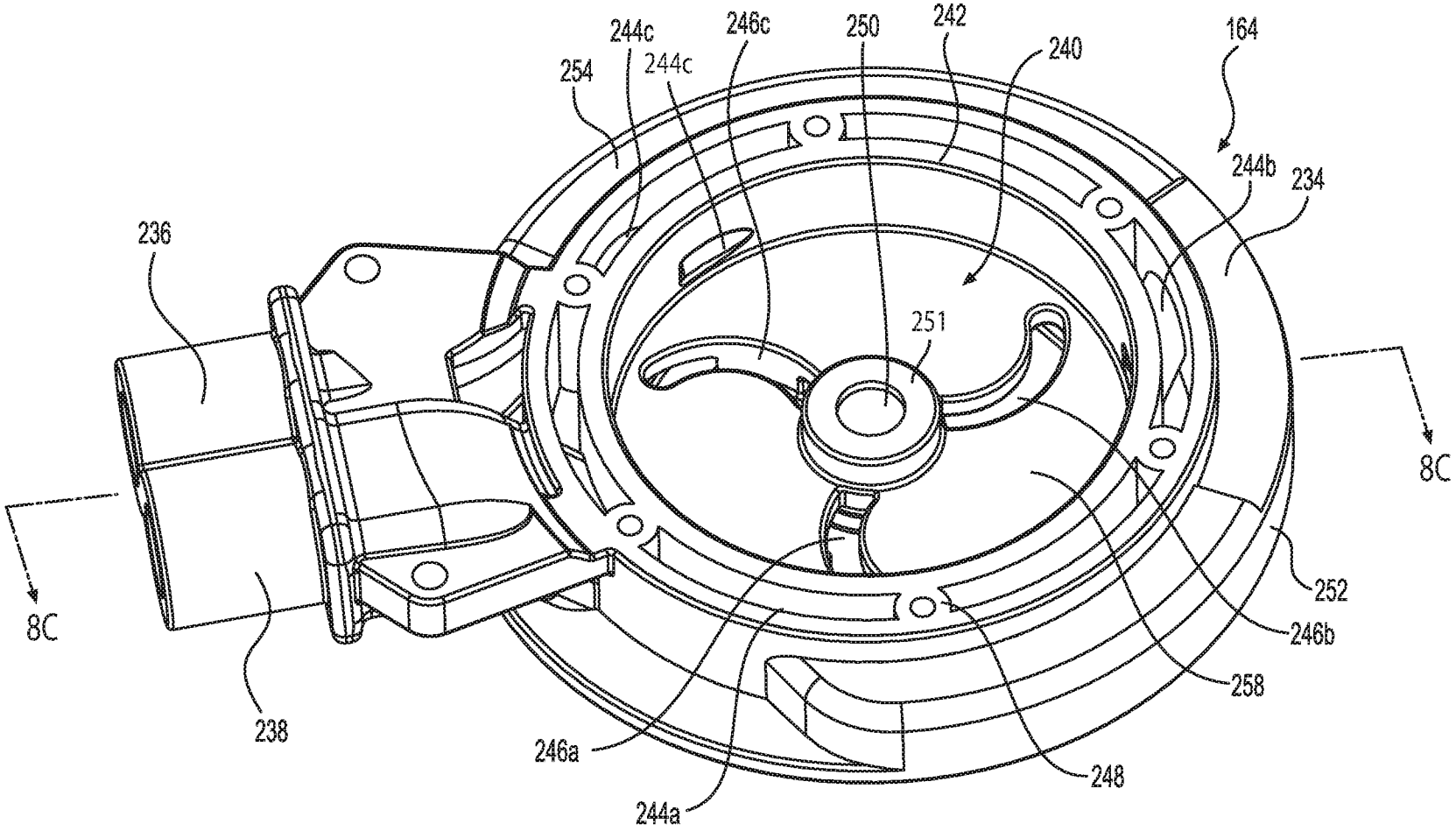
FIG. 8A is a top isometric view of an engine housing for the skin brush of FIG. 3A.
Figure 8B:
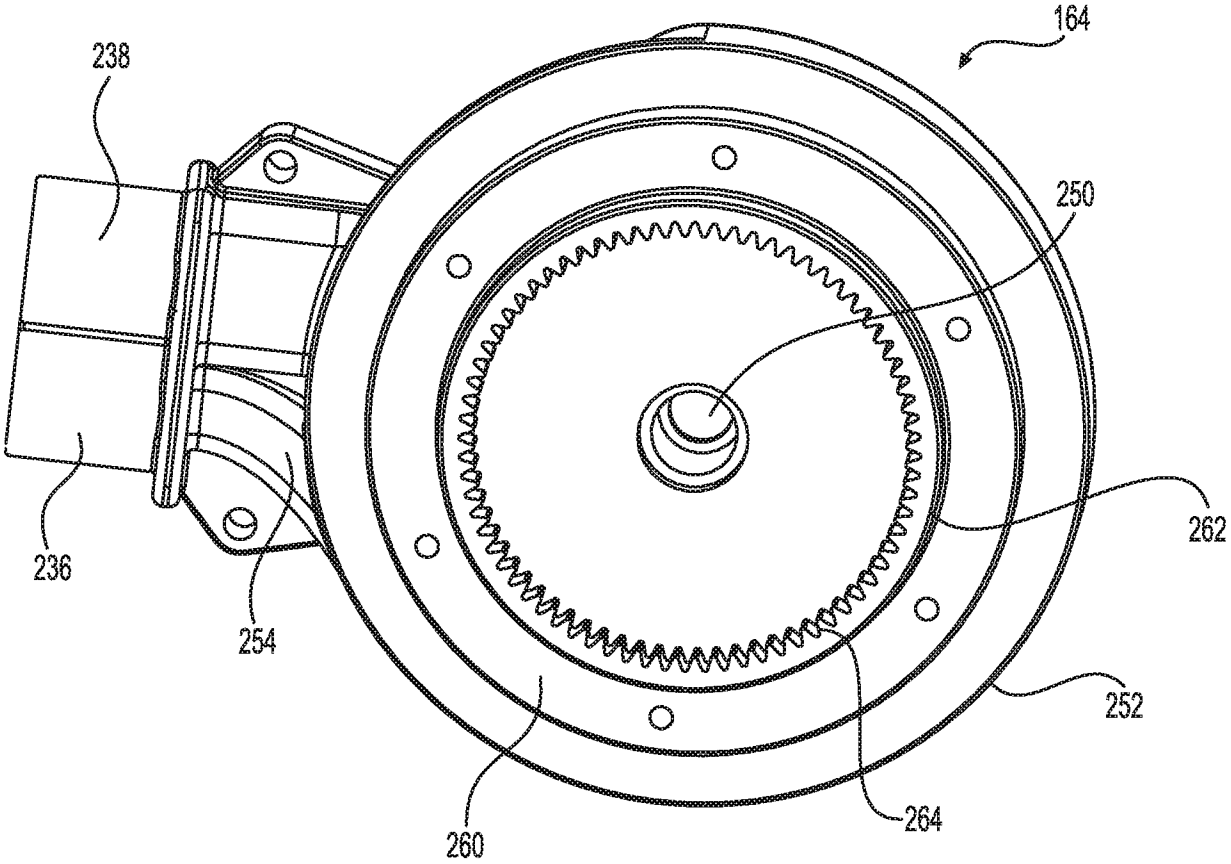
FIG. 8B is a bottom isometric view of the engine housing of FIG. 8A.
Figure 8C:
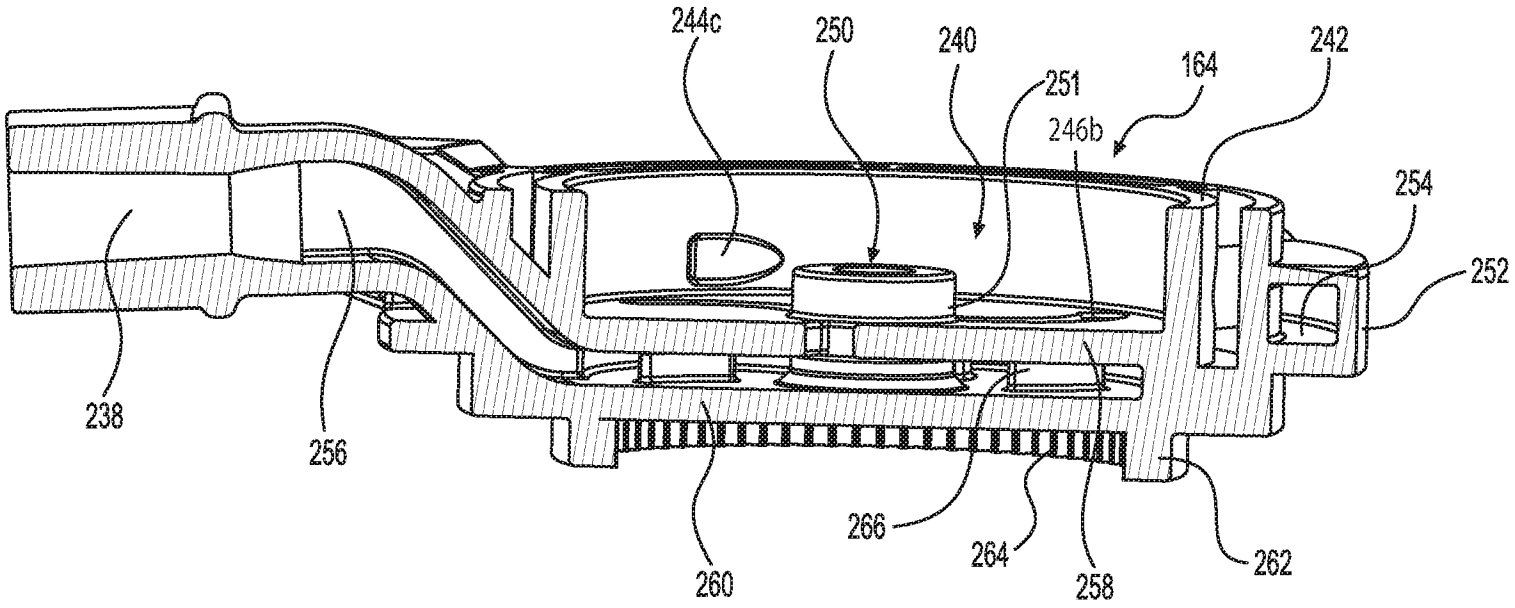
FIG. 8C is a cross-section view of the engine housing of FIG. 8A taken along line 8C-8C in FIG. 8A.

The engine housing 164, houses a number of engine components, as well as defines a gearing component for the engine 146. FIGS. 8A-8C illustrates various views of the engine housing 164. With reference to FIGS. 8A-8C, the engine housing 164 includes a housing body 234, including a bottom surface 260 and an outer wall 252. With reference to FIGS. 8A-8C, the engine housing 164 includes an inlet 236 and an exhaust 238 for directing fluid into and out of the engine 146, respectively. A chamber inlet passage 254 is defined by a portion of the outer wall 252 and extends substantially around the entire outer perimeter of the engine housing 164, such that the inlet 236 and the exhaust 238 may be positioned adjacent to one another.

With reference to FIGS. 8B and 8C, an outer gear 262 extends downward from the bottom surface 260 and includes a plurality of gear teeth 264. The outer gear 262 may be circular and arranged concentrically with the outer wall 252. Additionally, the gear teeth 264 may be defined on an interior surface of the outer gear 262 such that the gear teeth 264 face inwards toward a center of the engine housing 164.

With reference to FIGS. 8A and 8C, the engine housing 164 also includes a chamber outer wall 242 defined within the perimeter of the outer wall 252. The chamber outer wall 242 is spaced apart from the outer wall 252 so as to define a gap therebetween. In these embodiments, one or more fastening posts 248 may be defined therebetween to help support the chamber outer wall 242 relative to the outer wall 252 of the housing body 234. The chamber outer wall 242 is connected to a chamber floor 258 that is positioned above the bottom surface 260 to define an exhaust passage 256 between the two levels or planes. With reference to FIG. 8C, in some embodiments, the engine housing 164 may include one or more support beams 266 extending between the chamber floor 258 and the bottom surface 260 to support the chamber floor 258 above the bottom surface 260 by a gap.

The chamber outer wall 242 and chamber floor 258, define a turbine chamber 240. A plurality of chamber inlets 244*a*, 244*b*, 244*c* extend between the outer wall 252 and a chamber inlet passage 254 defined therein and the turbine chamber 240. For example, the chamber outer wall 242 may include a plurality of inlet apertures that are fluidly connected to the chamber inlet passage 254 via the chamber inlets 244*a*, 244*b*, 244*c*. In some embodiments, the chamber inlets 244*a*, 244*b*, 244*c* may be shaped to direct one or more streams of water in a desired direction with the turbine chamber 240, such as to impinge on the turbine 158 in a desired manner. The chamber floor 258 includes a plurality of chamber outlets 246*a*, 246*b*, 246*c* defined therethrough. The chamber outlets 246*a*, 246*b*, 246*c* are fluidly connected to the exhaust passage 256 and direct fluid out of the turbine chamber 240 into the exhaust passage 256. The chamber floor 258 may also include a shaft 251 having a shaft aperture 250 defined therethrough at a center of the chamber floor 258.

The planet gears 148*a*, 148*b*, 148*c* are configured to transmit rotation of the turbine 158 to the brushes 134*a*, 134*b*, 134*c*. With reference to FIGS. 5B and 6, each of the planet gears 148*a*, 148*b*, 148*c* may be substantially the same and each may include a disc shaped lower gear 276 having a plurality of gear teeth 270 extending from an outer periphery thereof. Additionally, each of the planet gears 148*a*, 148*b*, 148*c* may include an upper gear 272 extending upward from a top surface of the planet gears 148*a*, 148*b*, 148*c* and include a plurality of gear teeth 274 extending around an outer surface. The upper gear 272 may have a smaller diameter than the lower gear 276. In these embodiments, each of the planet gears 148*a*, 148*b*, 148*c* form a two-plane gear that includes gear teeth 270, 274 on two different planes. In the embodiment shown in FIGS. 5B and 6, the planet gears 148*a*, 148*b*, 148*c* are formed integrally or monolithically such that the upper gear 272 and the lower gear 276 are a single component. However, in other embodiments, the upper gear 272 and the lower gear 276 may be formed by two separate gears connected together (e.g., via adhesive, fasteners, etc.), such that the upper gear 272 and the lower gear 276 rotate together with one another. As can be appreciated, the gearing assembly of the fluid driven embodiments may be used with an electrically driven brush, with the water driven turbine replaced by or driven by a motor.

Assembly of the brush 102 will now be discussed. With reference to FIGS. 5A and 6, the engine 146 may be assembled and a turbine bushing 162 is received into the shaft aperture 250 of the engine housing 164 and the turbine shaft 154 is received through the turbine bushing 162 and receives a seal-cup 155 or other sealing element therearound. The turbine 158 is then positioned within the turbine chamber 240 and arranged such that a center aperture of the turbine 158 is positioned over the turbine shaft 154. A fastener 280 may then be inserted into the aperture of the turbine 158 and the turbine shaft 154 to secure the two components together. The O-ring 168 is received into the annular groove 194 of the base 196 of the engine cap 156 and the engine cap 156 may then be positioned over the engine housing 164. The engine cap 156 is secured thereto by a plurality of fasteners 159 received into the fastening apertures 157 defined through the top surface 188 of the engine cap 156 and into the fastening posts 248 of the engine housing 164. The engine cap 156 extends over the turbine chamber 240 to seal the top end of the turbine chamber 240.

Figure 9:
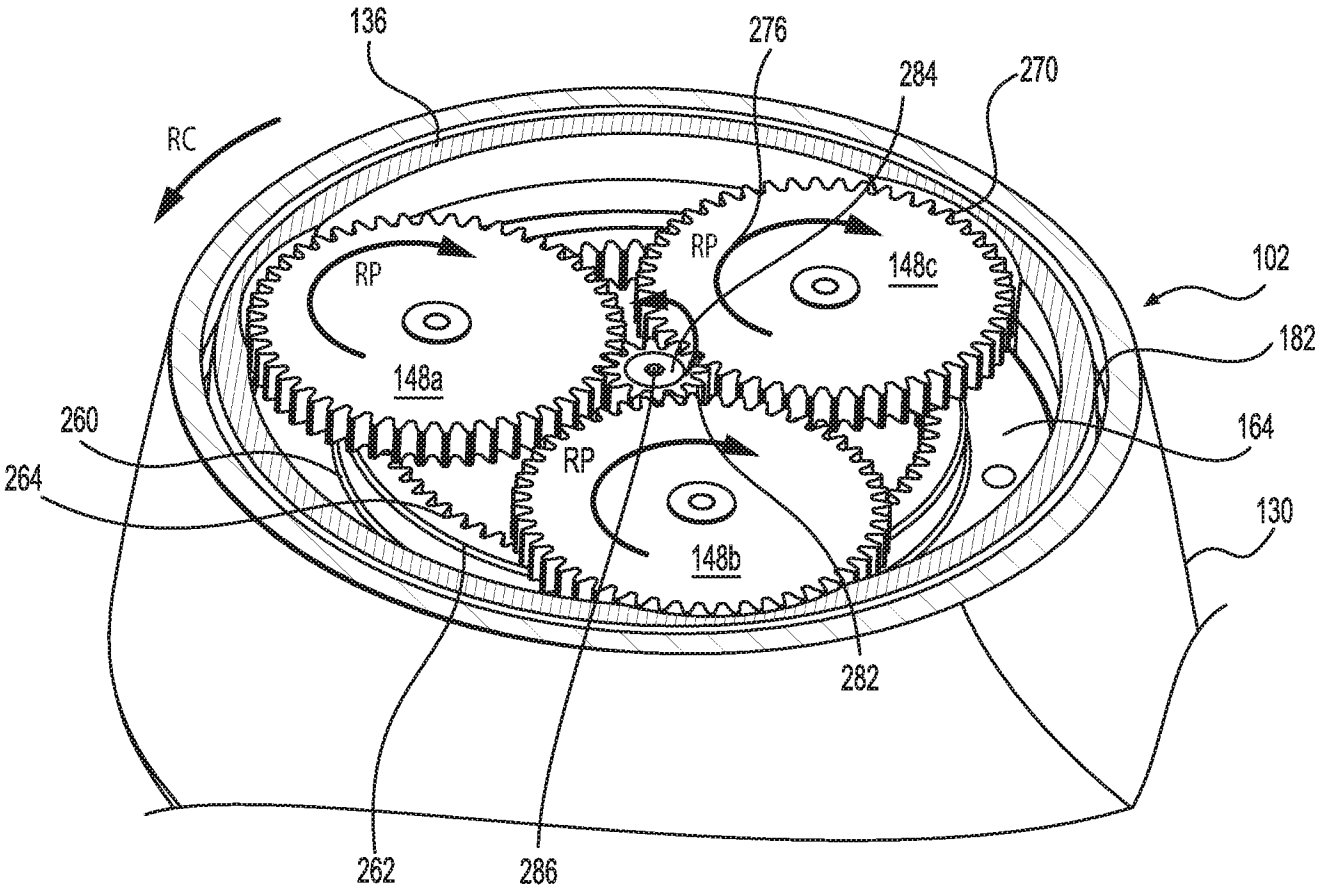
FIG. 9 is a front isometric view of the skin brush of FIG. 3A with certain elements hidden for clarity.

With continued reference to FIGS. 5B, 6, and 9, the sun gear 282 having a plurality of teeth 284 around an outer surface thereof is connected to the turbine shaft 154 by a fastener 286. In one embodiment, the sun gear 282 is aligned within and interfaces with the bottom surface of the turbine bushing 162. The sun gear 282 is connected to the turbine 158 by the turbine shaft 154 such that as the turbine 158 rotates, the sun gear 282 will rotate about the same axis.

With reference to FIGS. 5A-6, to assemble the brush assembly 132, the brushes 134*a*, 134*b*, 134*c* are connected to the brush carrier 136. For example, a planet shaft 152*a*, 152*b*, 152*c* may be inserted into the fastening aperture 224 in each of the brushes 134*a*, 134*b*, 134*c* and a carrier bushing 150*a*, 150*b*, 150*c* is received around each of the planet shafts 152*a*, 152*b*, 152*c*. The planet gears 148*a*, 148*b*, 148*c* are received around the planet shafts 152*a*, 152*b*, 152*c* and fasteners 153 are used to secure the planet shafts 152*a*, 152*b*, 152*c* to the planet gears 148*a*, 148*b*, 148*c* and the brushes 134*a*, 134*b*, 134*c*.

With reference to FIGS. 5A-6 and 9, once the planet gears 148*a*, 148*b*, 148*c* are secured to the brushes 134*a*, 134*b*, 134*c* and the brush carrier 136, the planet gears 148*a*, 148*b*, 148*c* are then arranged within the outer gear 262 of the engine housing 164. Specifically, the upper gears 272 of each of the planet gears 148*a*, 148*b*, 148*c* are arranged so that the gear teeth 274 of the upper gears 272 mesh with the gear teeth 264 of the outer gear 262. Due to the orientation of the planet gears 148*a*, 148*b*, 148*c*, the upper gears 272 of each planet gear 148*a*, 148*b*, 148*c* mesh with only the outer gear 262 and do not engage the sun gear 282. However, with reference to FIG. 9, the gear teeth 270 on the outer edge of the lower gear 276 for each planet gear 148*a*, 148*b*, 148*c* mesh with the teeth 284 of the sun gear 282, which, as will be discussed below, allows the sun gear 282 to drive each of the planet gears 148*a*, 148*b*, 148*c* substantially simultaneously. With reference to FIGS. 5A-6 and 9, a carrier thrust washer 166 may be positioned between the engine housing 164 and the brush carrier 136 to help reduce friction between the two components so that the brush carrier 136 can more easily rotate relative to the engine housing 164.

The engine 146 and brush carrier 136 may then be connected to the handle 130. In particular, the engine 146 is positioned within the handle cavity 184 within the head 182 of the handle 130. The brush carrier 136 may define a lip 218 or edge that sits on a corresponding ledge 139 or lip within the handle 130 to secure the components of the engine 146 and brush carrier 136 within the handle 130. The fastener 174 may then be inserted through a fastening aperture in the top surface 142 of the handle 130 and into the fastening recess 191 defined in the protrusion 190 of the engine cap 156, securing the engine 146 to the handle 130 and in desired location.

The engine 146 may then fluidly connect to the hose 118 (or other fluid source), either before or after insertion to the handle 130. For example, a dual lumen connector 290 may be connected to the inlet 236 and exhaust 238 of the engine housing 164, fluidly connecting the inlet 138 and outlet 140 of the hose 118 to the engine 146. In some embodiments the hose 118 may be permanently secured to the brush. In other examples, (see, e.g., FIGS. 29A and 29B) a releasable connector is used to connect the hose to the brush 800.

Figure 10:
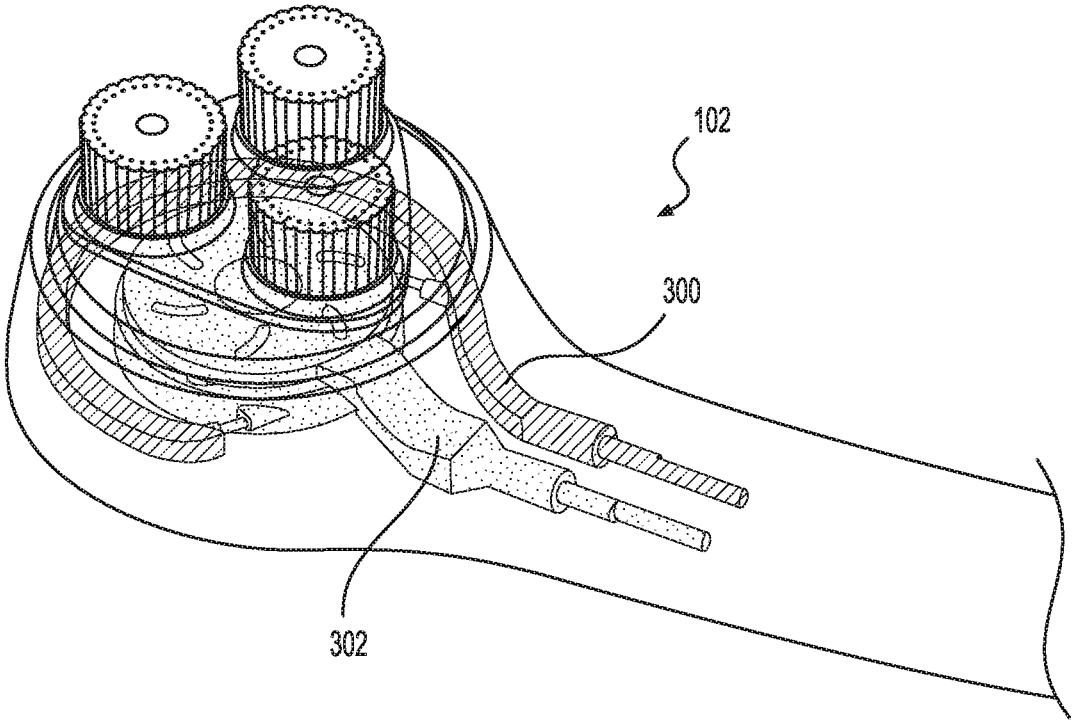
FIG. 10 is an isometric view of the skin brush of FIG. 3A illustrating the inlet and exhaust fluid pathways.
Figure 11:
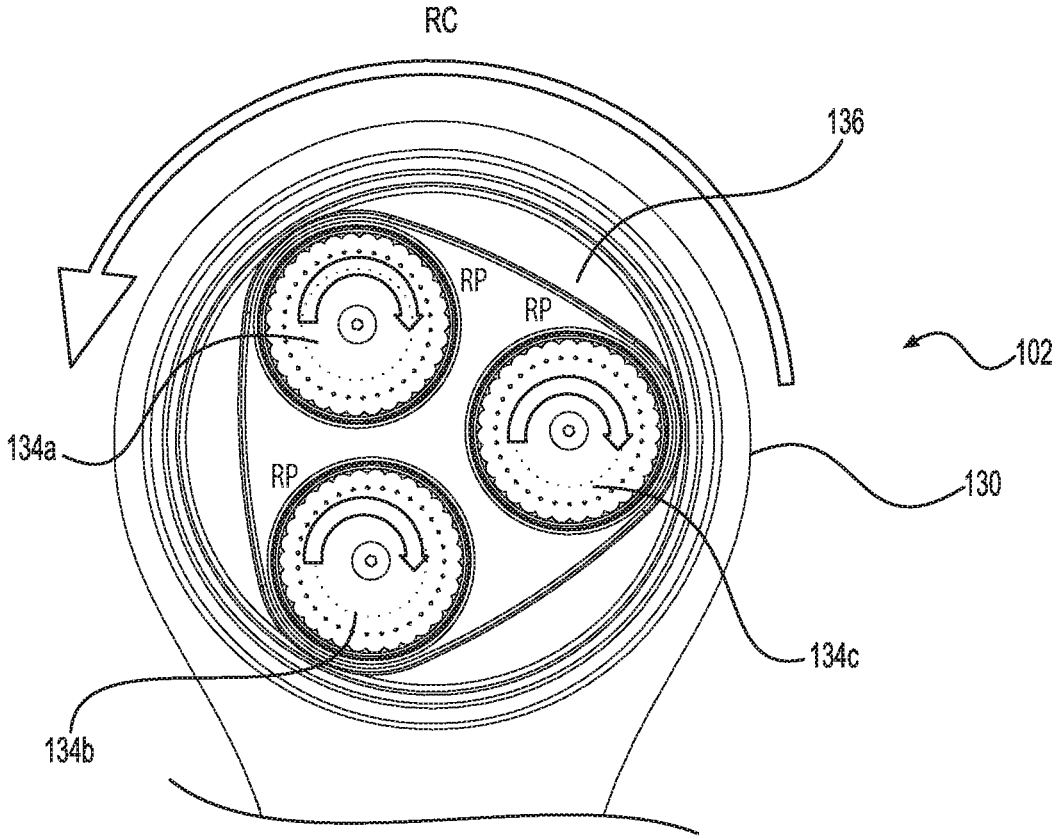
FIG. 11 is a front elevation view of the skin brush of FIG. 3A illustrating the rotation directions of a brush carrier and brushes.

In operation, the brush 102 is driven such that the brush carrier 136 rotates in a first direction at a first speed and the brushes 134*a*, 134*b*, 134*c* rotate in a second direction in a second speed. In one embodiment, the brush 102 may be water driven and, when a user via the diverter valve 108 selects the brush outlet, fluid flows from the J-pipe 106 (or other fluid source) into the inlet 138 of the hose 118 and enters the inlet 236 of the engine 146. FIG. 10 is a partially translucent view of the brush 102 illustrating the fluid flow paths therethrough. With reference to FIGS. 5A, 6, 8A, and 9, the fluid enters into the inlet 236 and into the chamber inlet passage 254. The fluid then travels through the chamber inlet passage 254 around a perimeter of the turbine chamber 240 and, as the fluid travels around the turbine chamber 240, fluid enters the turbine chamber 240 via the chamber inlets 244*a*, 244*b*, 244*c*.

With reference to FIGS. 5A-6, as the fluid enters into the turbine chamber 240, the fluid impinges on the fins 200 of the turbine 158. This causes the turbine 158 to rotate about the turbine shaft 154 and rotate within the turbine chamber 240. Fluid is expelled from the turbine chamber 240 via the chamber outlets 246*a*, 246*b*, 246*c* located within the chamber floor 258. With reference to FIGS. 5A-6, 8B, and 10, from the chamber outlets 246*a*, 246*b*, 246*c*, the fluid enters into the exhaust passage 256*b* located beneath the chamber floor 258 and exits the exhaust 238 of the engine housing 164. The fluid returns to the showerhead 104 to be completely expelled from the cleansing system 100.

While the fluid is flowing and the turbine 158 is rotating, the rotation of the turbine 158 causes the sun gear 282 to rotate therewith. With reference to FIGS. 5A-6, 9, and 11, as the sun gear 282 rotates, the planet gears 148*a*, 148*b*, 148*c* are rotated in a planet rotation direction Rp due to the meshed engaging the gear teeth 270 of the lower gear 276 with the teeth 284 of the sun gear 282. In one embodiment, the planet rotation direction Rp is the same direction as the rotation of the sun gear 282. As the lower gear 276 of the planet gears 148*a*, 148*b*, 148*c* rotate, the gear teeth 274 of the upper gear 272 mesh with the gear teeth 264 on the outer gear 262 of the engine housing 164. As the engine housing 164 is secured in position, the rotation force exerted by the planet gears 148*a*, 148*b*, 148*c* causes the brush carrier 136 to rotate in a second direction, a carrier rotation direction Rc.

Additionally due the gearing ratios, the brush carrier 136 may experience a large speed reduction as compared to the brushes 134*a*, 134*b*, 134*c*. For example, in one embodiment, the brush carrier 136 may rotate in the carrier rotation direction Rc at a 25:1 speed reduction and the brushes 134*a*, 134*b*, 134*c* may rotate in the planet rotation direction Rp at a speed reduction of 4:1. In these embodiments, the planetary gear arrangement of the brush 102 provides the brush 102 with two types of output motion profiles, namely, a motion profile of the brush carrier 136 with rotation in a first direction at a first speed and a motion profile of the brushes 134*a*, 134*b*, 134*c* with rotations in a second direction at a second speed. In other words, the sun gear 282 forms a first stage of the gearing system and the upper gears 272 of the planet gears 148*a*, 148*b*, 148*c* form the second stage as they engage with the stationary outer gear 262. These features allow the brush 102 to feel more powerful to a user and exert a cleaning and exfoliating feeling to a user, without requiring substantial levels of power.

It should be noted that in some embodiments, the drive assembly can be replaced by an electric motor. In these instances the turbine may be electrically driven or a drive shaft may be used to directly drive the sun gear.

Electrically Powered Embodiments

Figure 12A:
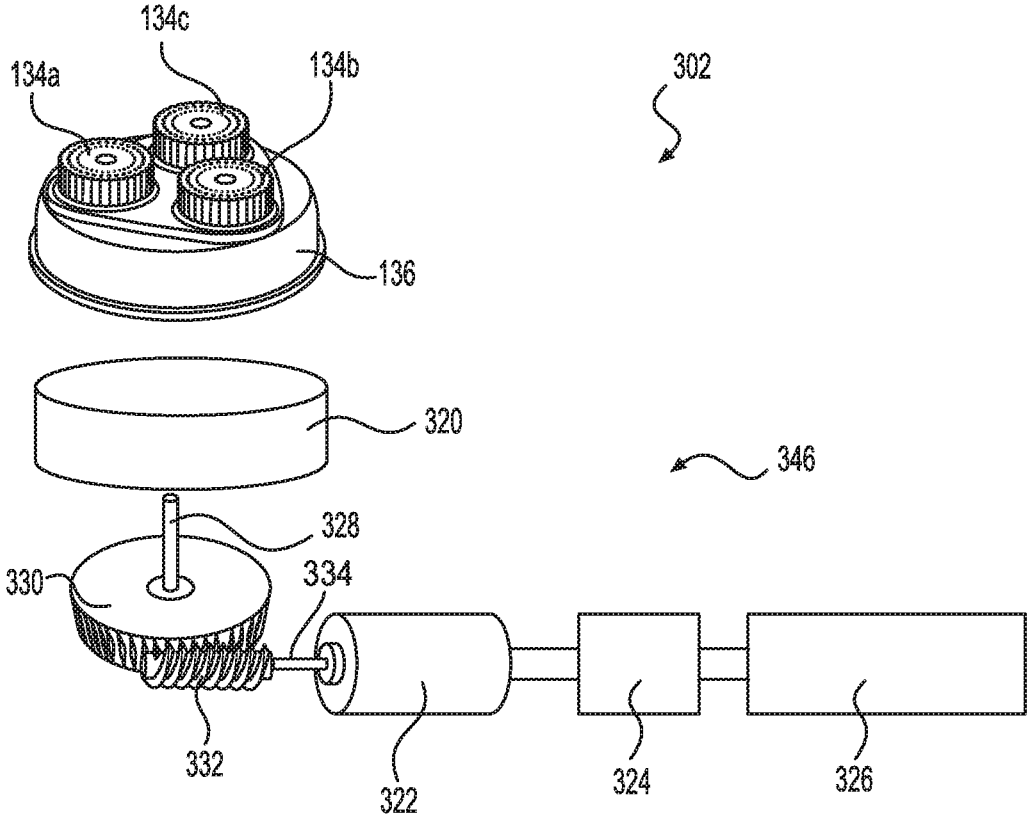
FIG. 12A is a schematic diagram illustrating an example of a skin brush including an electric drive mechanism.
Figure 12B:
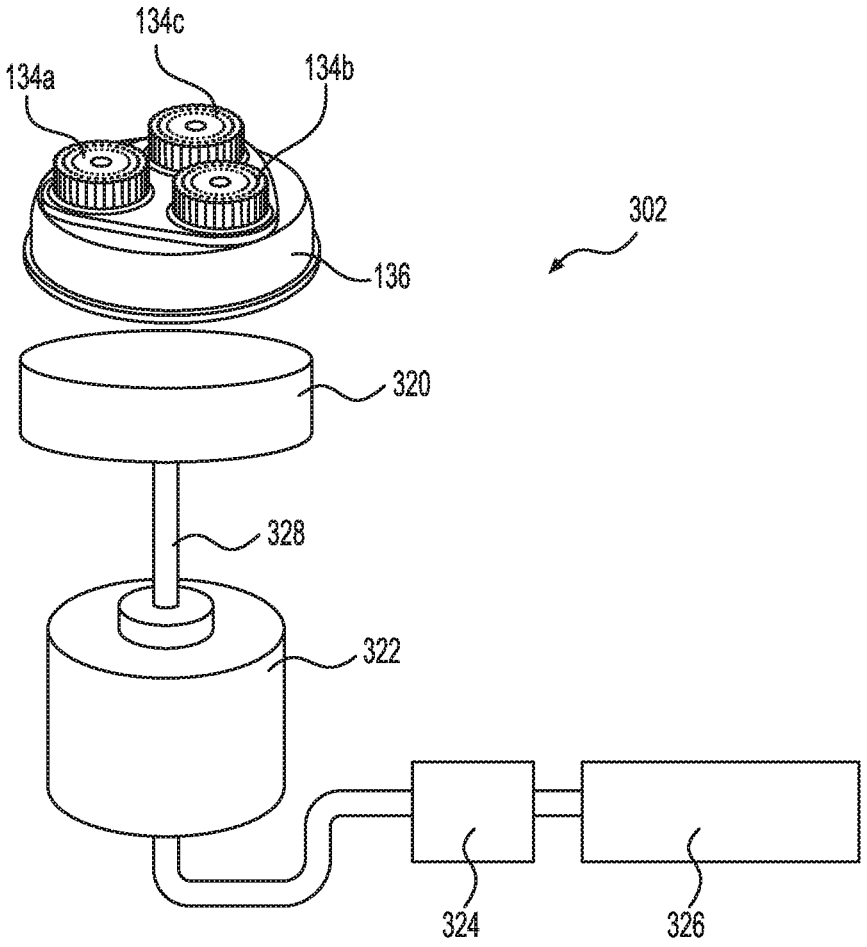
FIG. 12B is a schematic diagram illustrating another example of a skin brush including an electric drive mechanism.

In the embodiment shown in FIGS. 1-11, the brush 102 is driven by fluid, however, in other embodiments the brush may be driven by other methods. FIGS. 12A and 12B illustrate examples of an electrically driven brush. With reference to FIG. 12A, in one embodiment, a brush 302 may be substantially similar to the brush 102 shown in FIGS. 1-11, but rather than the engine being driven by fluid, an electric drive mechanism, e.g., a motor 322 may be used. The features of the cleansing system of FIGS. 1-11 can be interchanged with any of the elements in the following embodiments. In the example shown in FIGS. 12A and 12B, the brush 302 may include a gear assembly 320 and an engine 346. The gear assembly 320 may be substantially the same as the planetary gear arrangement described above and the brushes 134*a*, 134*b*, 134*c* may be connected via dual geared or clustered planet gears 148*a*, 148*b*, 148*c* to a sun gear 282 such that as the sun gear 282 rotates, the brushes 134*a*, 134*b*, 134*c* rotate in a first direction and the brush carrier 136 rotates in a second direction.

The engine 246 in this embodiment, however, may include a power source 326, a control circuit 324, a motor 322, a driving gear 332, a driven gear 330, and a sun gear shaft 328. The power source 326, which may be a battery pack, power cord, or the like, is in electronic communication with the motor 322 via the control circuit 324. The control circuit 324 selectively provides power to the motor 322 from the power source 326 to activate the brush 302. The motor 322 includes a drive shaft 334 that is rotated when the motor 322 is activated. The driving gear 332 is connected to the drive shaft 334 and rotates with the drive shaft 334. The driven gear 330 in meshed engagement with the driving gear 332 is rotated correspondingly, which causes the sun gear shaft 328 to rotate. As the sun gear shaft 328 rotates, the sun gear 282 rotates in a similar manner as described above with respect to FIGS. 1-11, causing the rotation and movement patterns as described above.

In the embodiment shown in FIG. 12A, the engine 346 is configured to fit within the handle 130, but with the driving gear 332 orientated substantially perpendicular to the driven gear 330. For example, the driving gear 332 may be a worm gear oriented at a right angle to the driven gear 330. However, in other embodiments, the electric brush may be in a direct drive configuration with respect to the gear assembly 320. For example, with respect to FIG. 12B, the sun gear shaft 328 may form the drive shaft of the motor 322 or may otherwise be directly connected thereto. The motor 322 and sun gear shaft 328 in this embodiment may be positioned in the head 182 portion of the handle 130 and the control circuit 324 and power source 326 may be located in the shaft 180 or other area of the handle 130. In this configuration, the communication wires between the control circuit 324 and motor 322 may curve as the handle 130 transitions from the shaft 180 to the head 182. However, it should be noted that many other types of drive mechanisms are envisioned and the examples shown in FIGS. 12A and 12B are illustrative only.

FIGS. 18A-26 illustrate a different electrically driven embodiment that includes a similar motor and drive assembly as FIGS. 12A and 12B. However, in the embodiment of FIGS. 18A-26, the planetary gear arrangement is replaced with a single dual-level gear that drives an output gear to rotate one bristle carrier, rather than multiple carriers. This embodiment is discussed in more detail below.

Brush Embodiments with Fluid Output

In the embodiments illustrated in FIGS. 1-12B, the brush is depicted without a fluid output. However, in some embodiments, the brush may include a fluid output to allow a user to apply water, cleansers (e.g., facial washes), or medicine to his or her skin while using the skin brush. FIGS. 13A-16 illustrate various views of fluid-outputting skin brushes. The brushes may be substantially similar to the brushes shown and described with respect to FIGS. 1-12B, but may include a fluid output mechanism. Accordingly, to the extent certain features are not described, it should be understood that the brushes shown in FIGS. 13A-16 include the same or similar features as the brushes of FIGS. 1-12B.

Figure 13A:
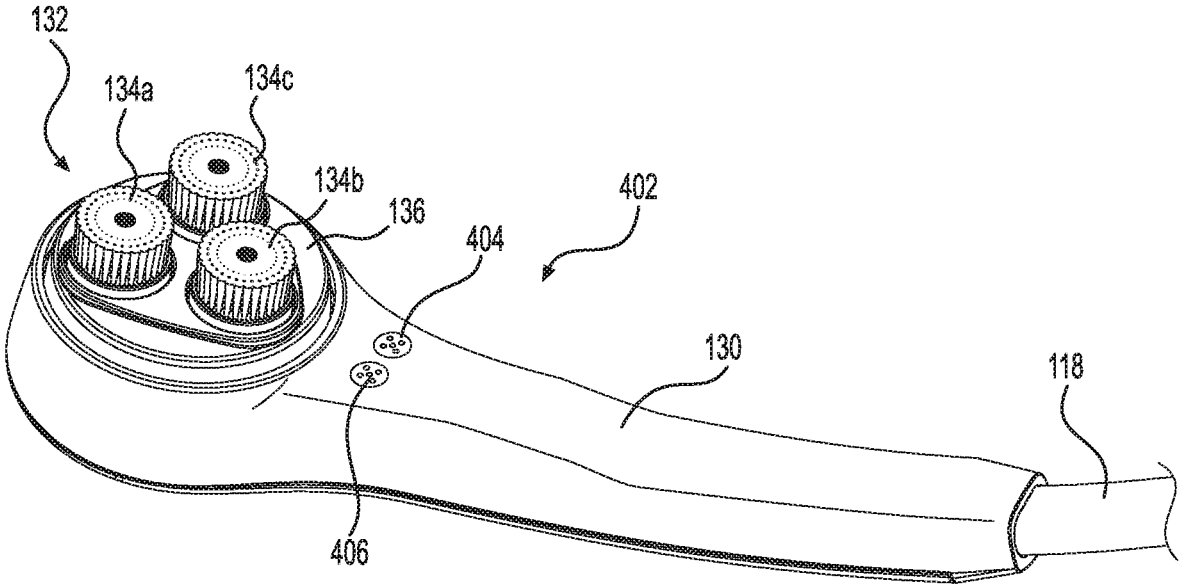
FIG. 13A is a bottom isometric view of a skin brush including one or more outlet nozzles.
Figure 13B:
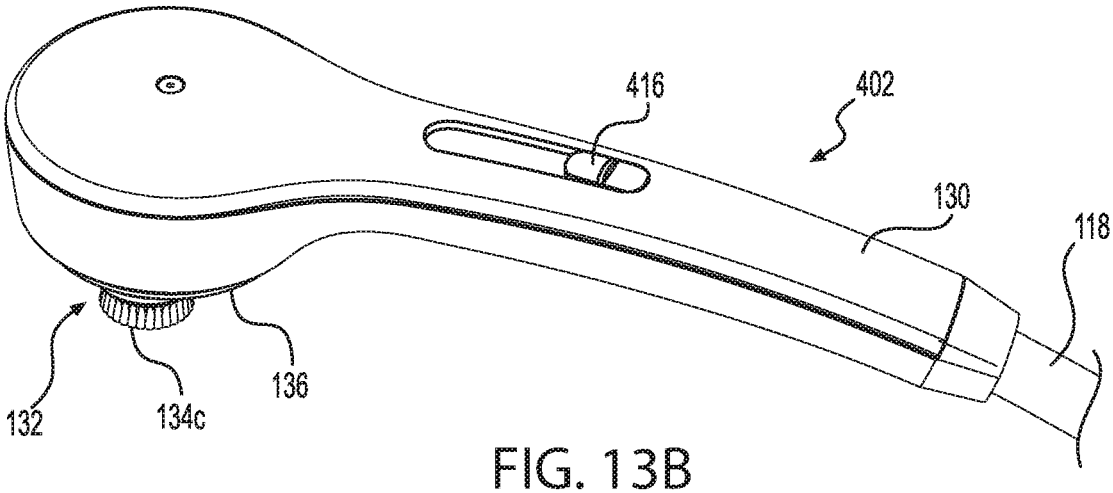
FIG. 13B is a top isometric view of the skin brush of FIG. 13A.
Figure 14:
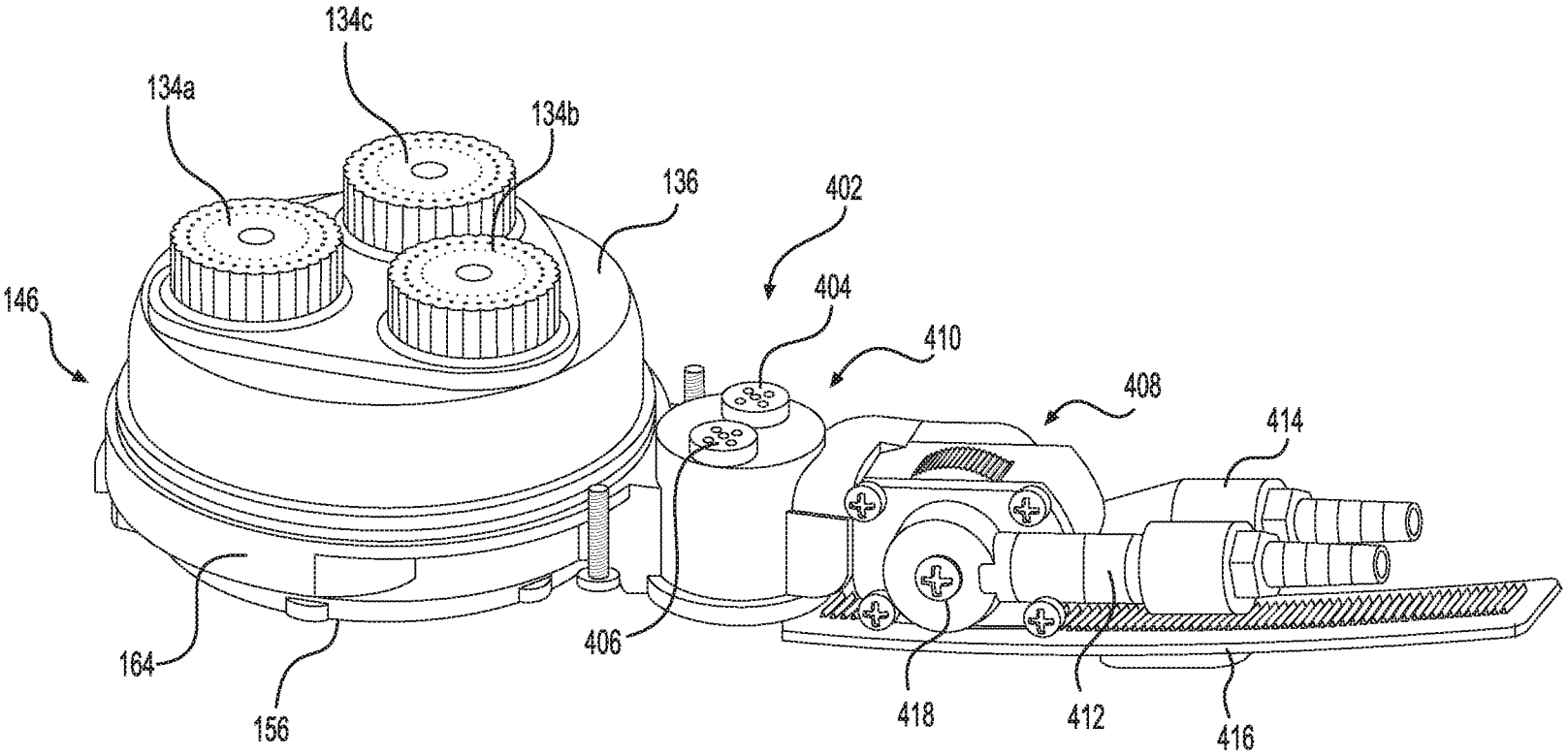
FIG. 14 is a side isometric view of the skin brush of FIG. 13A with certain elements hidden for clarity.

FIGS. 13A-14 illustrate an example of a fluid powered brush 402 including a nozzle assembly 410. With reference to FIGS. 13A-14, the brush 402 is substantially the same as the brush 102 of FIGS. 1-11, but includes a nozzle assembly 410 having a first group of nozzles 404 and a second group of nozzles 406 that are in fluid communication with the hose 118. The nozzles 404, 406 output fluid from the hose 118 in a desired spray pattern and the nozzle assembly 410 may include a turbine or massage feature such that nozzles 404, 406 output a massage spray or the like. The nozzles 404, 406 may be configured as desired, but in one example, they are oriented side by side to one another. The nozzle assembly 410 may be integrated with the handle 130 or may be removable therefrom.

The brush 402 in this embodiment may also include a control assembly 408 for selectively providing fluid and varying the fluid flow and pressure to the brush carrier 136 and/or nozzle assembly 410. The control assembly 408 may include a user actuator button, such as a slide 416, a valve 418, an inlet 412, and an exhaust 414. Fluid from the hose 118 may enter into the engine 146 and the nozzle assembly 410 via the control assembly 408. For example, the inlet of the hose 118 may be fluidly connected to the inlet 412 of the control assembly 408 that may be in fluid communication with both the engine 146 and the nozzle assembly 410. Similarly, the outlet of the hose 118 is fluidly connected to the exhaust 414 of the control assembly 408 which may be in fluid communication with the engine 146. The valve 418 of the control assembly 408 determines whether fluid form the hose 118 reaches the nozzle assembly 410 and/or engine 146 so that a user can selectively modify the speed of the brush 102, as well as the amount of fluid and pressure exiting the nozzles 404, 406. The valve 418 may be a rotary valve with a linear slide control or substantially any other type of control or mode selecting valve.

In operation, as a user slides the slide 416 from an off position to a first on position, the hose 118 is fluidly connected to the nozzles 404, 406 but not to the engine 146, such that fluid exits the nozzles 404, 406 but the brush is not activated, i.e., bristle carriers do not spin. As the user moves the slide 416 to a second on position, the amount of fluid reaching the nozzles 404, 406 may be reduced, but the brush 102 may become activated as fluid is directed into the engine 146. As the user moves the slide 416 to a third or "on" position, the fluid directed to the engine 146 increases, while the fluid directed to the nozzle assembly 410 decreases, such that the brush 102 speeds up and the fluid output by the nozzles 404, 406 is reduced. Then finally in a fourth on position, the valve 418 of the control assembly 408 may direct all of the fluid from the hose 118 to the engine 146 and the nozzles may be turned off. Moving the slide 416 in the opposite directions changes the modes in the opposite manner, i.e., moving the slide from the fourth on position to the third on position will activate the nozzles, but a lower fluid pressure while the brush remains spinning. However, the number of modes and order of selecting the modes may be varied as desired and the above description is meant as illustrative only.

Figure 15:
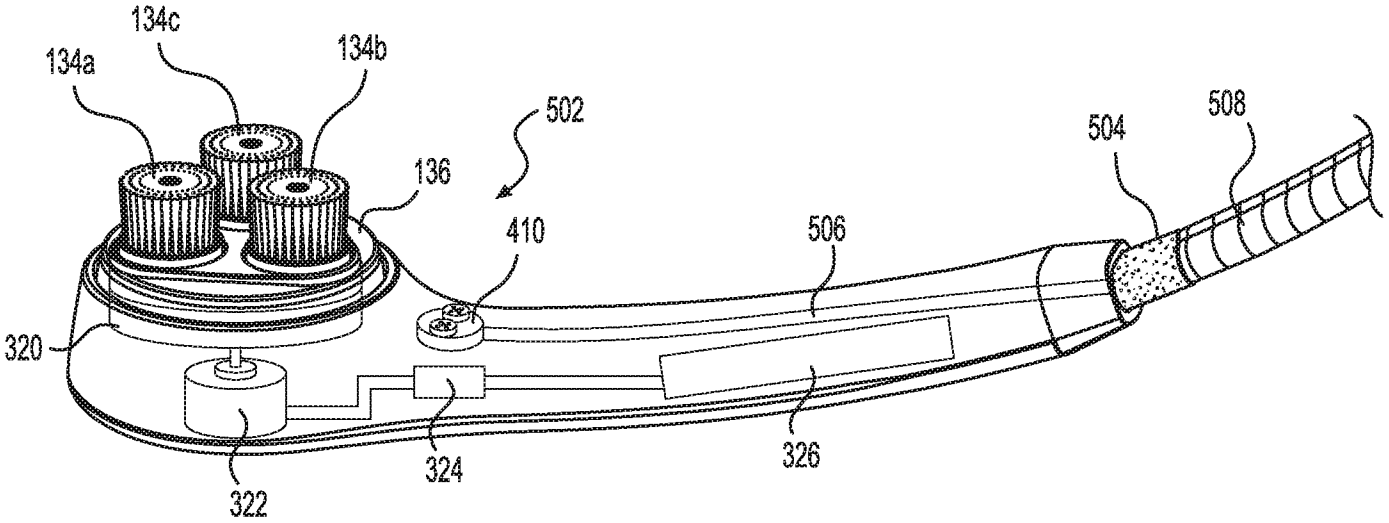
FIG. 15 is a schematic diagram illustrating an example of a skin brush including a removable fluid connection.

In embodiments where the brush may be electrically controlled, rather than fluidly controlled, the brush may include a selectively removable fluid supply to provide fluid to the nozzle assembly. FIG. 15 illustrates an example of the brush including a removable fluid supply. With reference to FIG. 15, in this example, the brush 502 may be electrically driven and may include an internal nozzle flow path 506 that is selectively connectable to a water supply, such as a hose 508, via a quick disconnect connector 504. In this example, the connector 504 fluidly connects the nozzle flow path 506 to the hose 508 and may include an optional shutoff valve to prevent fluid captured within the flow path 5067 from leaking out when not connected to the hose 508. In this embodiment, a user connects the brush 502 to the hose 508 to fluidly connect the nozzle assembly 410 to a fluid source to output a spray pattern or fluid flow via the nozzles 404, 406.

As briefly mentioned above, the nozzle assembly 410 may be detachable from the brush. For example, with reference to FIG. 16, the nozzle assembly 610 in this example may be removable from the brush 602. The nozzle assembly 610 may attach to the handle 130 or other location on the brush 602 so as to be removable therefrom, such as via a magnetic connector, snap-fit connector, twist connector, or the like. This allows a user to use the brush 602 with or without the nozzle assembly 610. For example, a user can use the brush 602 in the shower and use the nozzle assembly 610 or alternatively may remove the nozzle assembly while traveling with the brush and use the brush 602 without the nozzle assembly 610.

Figure 16:
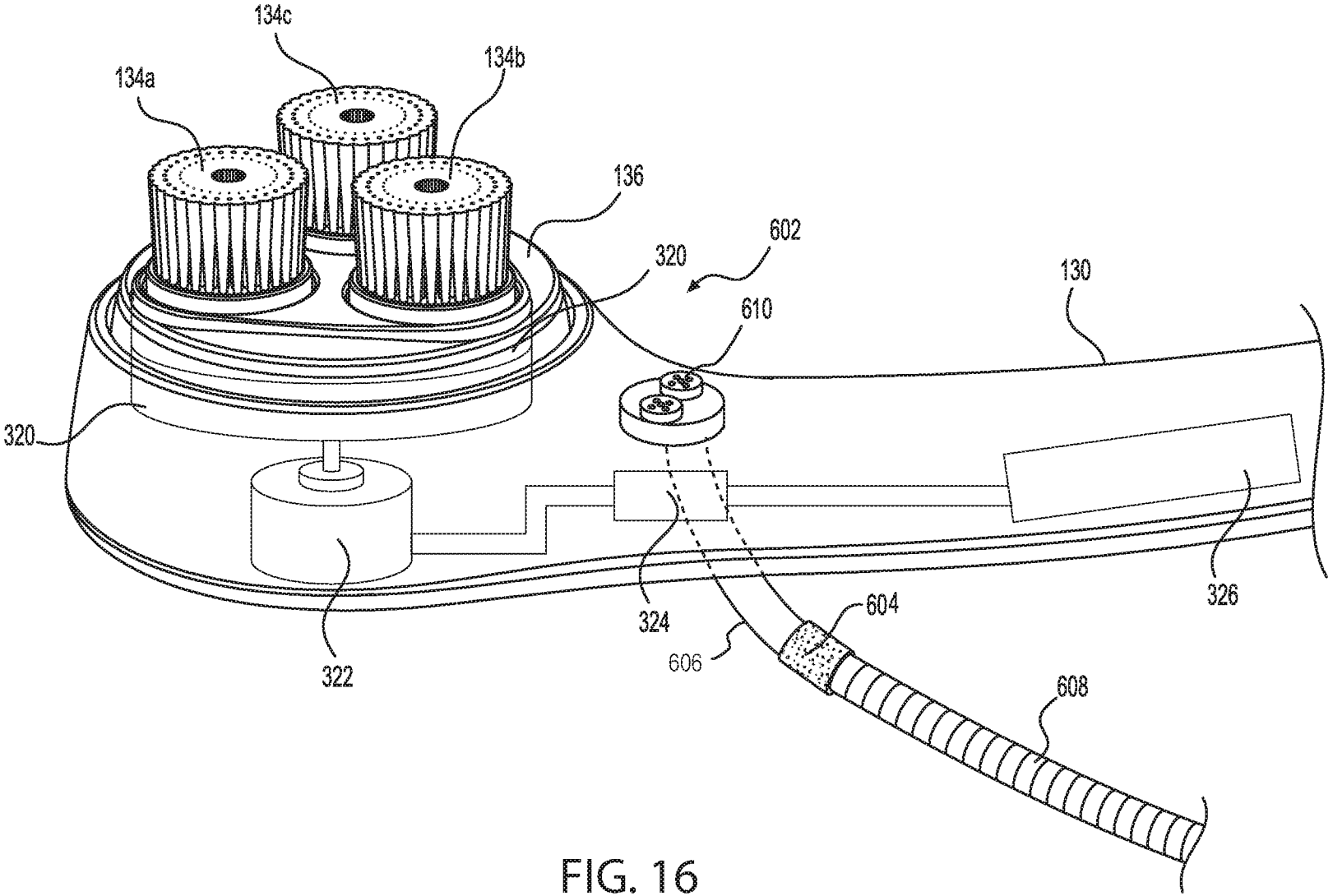
FIG. 16 is a schematic diagram illustrating an example of a skin brush including a removable nozzle assembly.

With continued reference to FIG. 16, in some embodiments, the brush 602 may include an external fluid pathway for the nozzle assembly 610. For example, an external hose 606 may be used to fluidly connect the nozzle assembly 610 with a fluid source, such as the hose 608. In these examples, a connector, such as a quick disconnected 604, may be used to selectively connect the external hose 606 and the fluid source hose 608 together.

Replaceable Brushes

Figure 17:
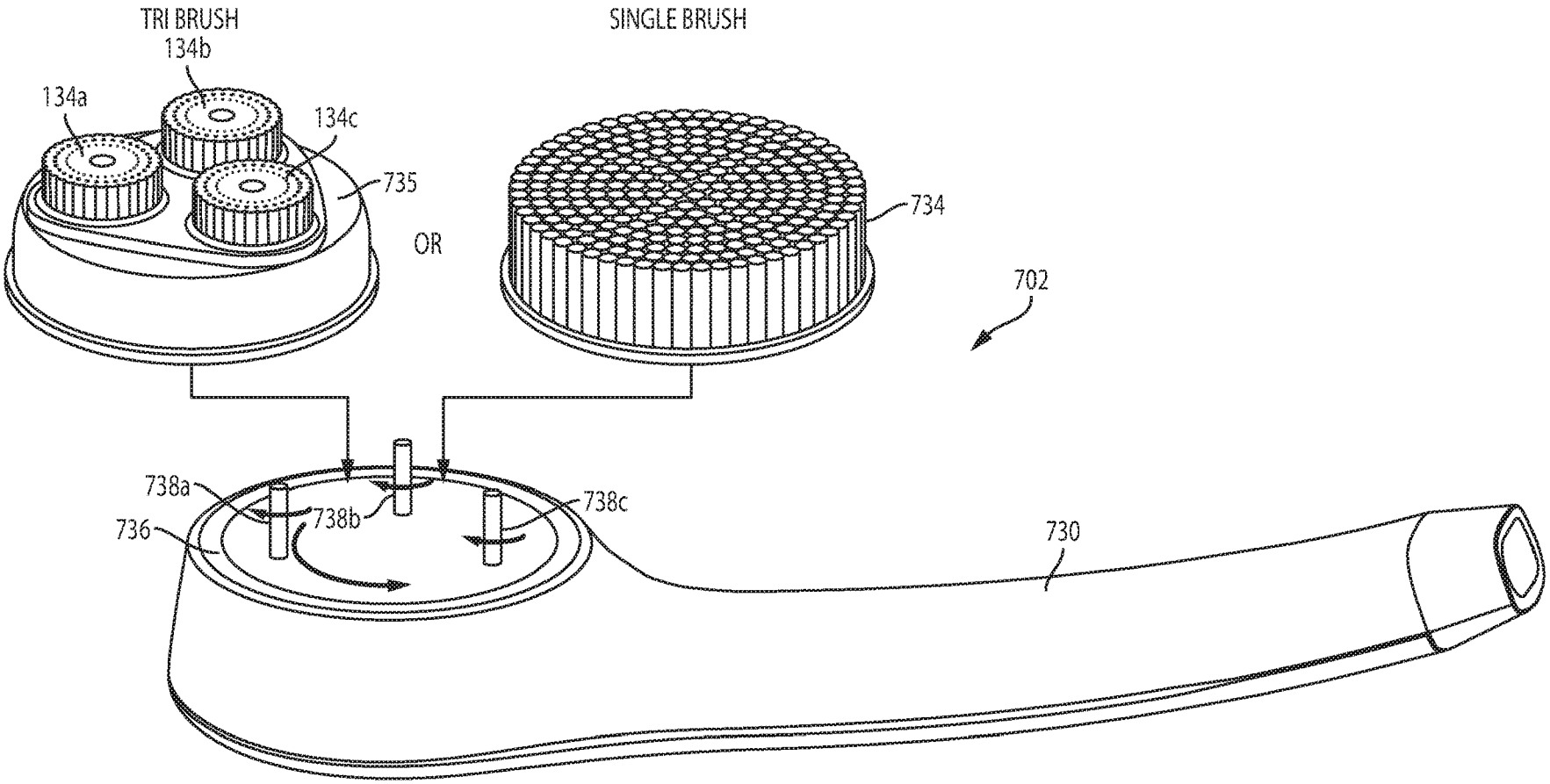
FIG. 17 is a schematic diagram illustrating examples of removable brushes for the skin brush.

As mentioned above, the brushes 134*a*, 134*a*, 134*c* and/or carrier 136 may be replaceable to allow different users to use the brush 102, as well as to allow users to change out the brushes for different cleansing effects, textures, and to replace brushes as they wear down. FIG. 17 is a schematic view of a skin brush illustrating examples of removable brushes. With reference to FIG. 17, in one embodiment, one or more individual brushes 734 may be connected to a carrier 736 on the handle 130. In this embodiment, a single brush 734 may cover the entire face of the brush and be driven by one or more drive dogs 738*a*, 738*b*, 738*c* of the brush 702. Alternatively, three or more brushes 734 may be connected to each of the drive dogs 738*a*, 738*b*, 738*c* and be driven individually by the carrier 736.

With continued reference to FIG. 17, as yet another example, in some embodiments, the brush carrier may include two subcarriers 735, 736, where the first is a removable subcarrier 735 can be detached from the brush 702 and the second is a fixed subcarrier 736 which remains attached to the brush 702. In this example, the brushes 134*a*, 134*b*, 134*c* are secured to the removable subcarrier 735 and to replace the brushes 134*a*, 134*b*, 134*c* the removable subcarrier 735 is detached from the fixed subcarrier 736. For example, the fixed subcarrier 736 may include one or more gearing connections, such as drive dogs 738*a*, 738*b*, 738*c* or planet gear shafts that connect to the brushes 134*a*, 134*b*, 134*c* once the removable subcarrier 735 is connected to the brush 702 and handle 730. The drive dogs 738*a*, 738*b*, 738*c* then act to drive the brushes 134*a*, 134*b*, 134*c* in a rotating motion.

Exemplary Electrical Embodiment

Figure 18A:
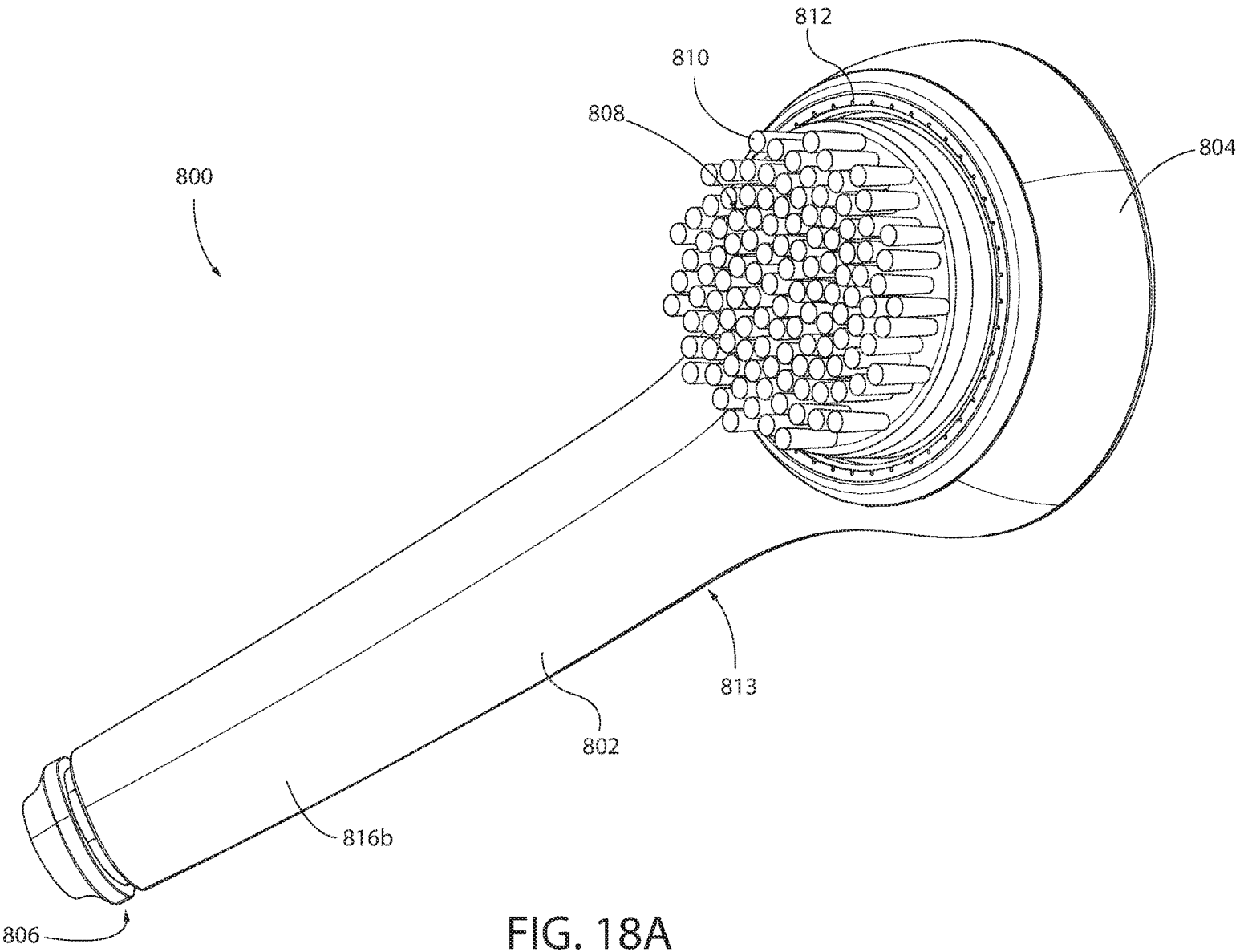
FIG. 18A is a front isometric view of another example of a skin brush.
Figure 18B:
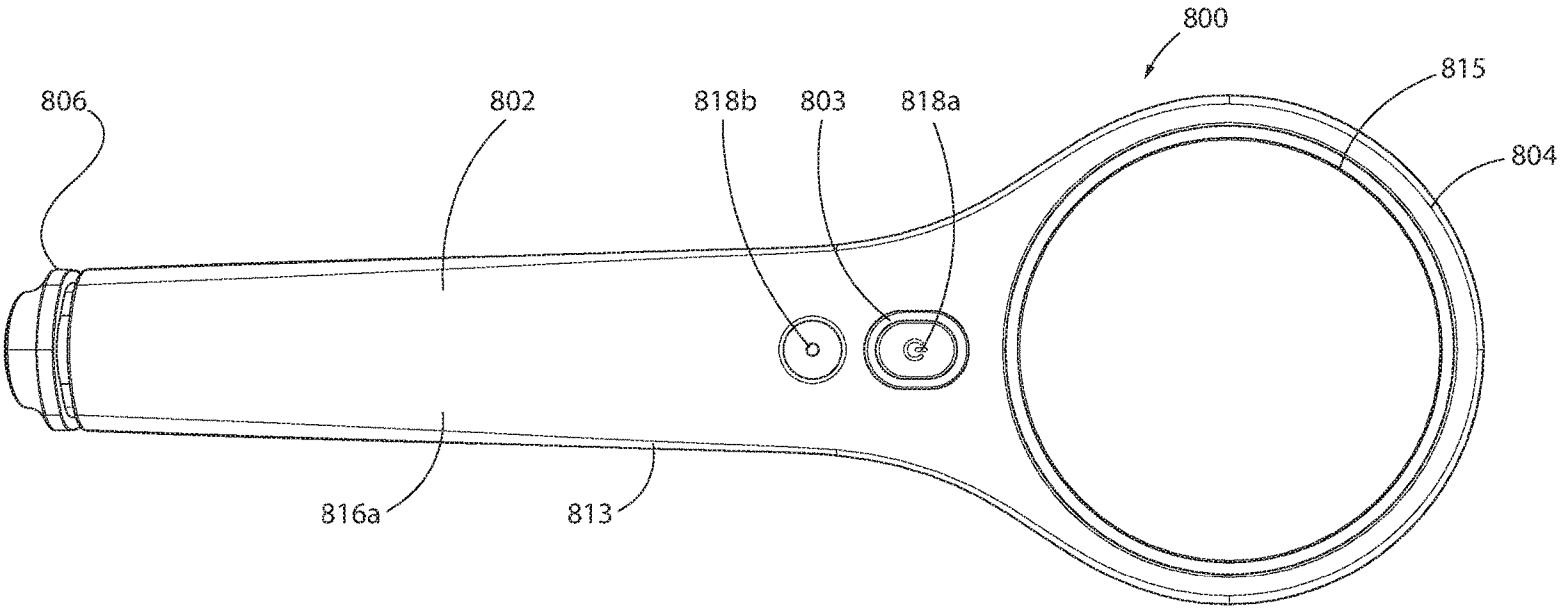
FIG. 18B is a rear isometric view of the skin brush of FIG. 18A.
Figure 18C:
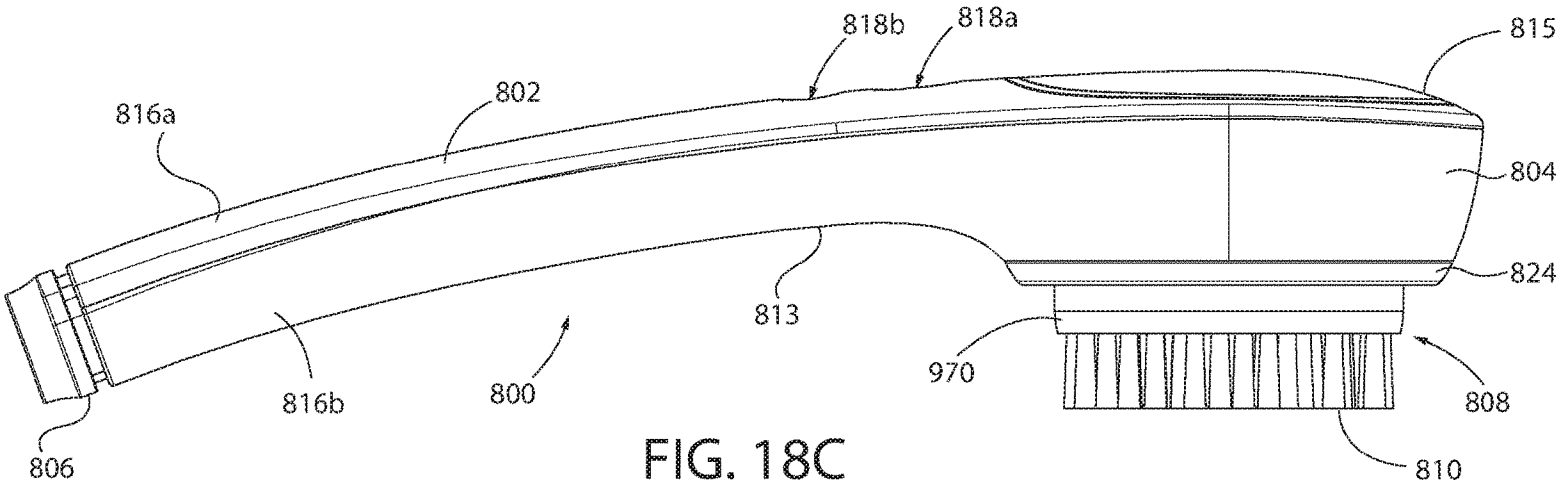
FIG. 18C is a side elevation view of the skin brush of FIG. 18A.

An exemplary embodiment that incorporates features from the above examples will now be discussed in more detail. FIGS. 18A-18C illustrate various views of a brush 800 that may be substituted within the cleansing system 100 for any of the prior embodiments of brushes 102, 302, 402, 502, 602, 702. The brush 800 includes an electrically powered bristle carrier and a plurality of spray nozzles. With reference to FIGS. 18A-18C, in this embodiment, the brush 800 includes a brush housing 813 defining a brush handle 802 and a brush head 804. In some embodiments, the brush handle 802 is generally elongated and has a diameter and shape that can be easily gripped by a user and is also aesthetically pleasing. In some embodiments, the brush handle 802 tapers from the brush head 804 downwards towards the bottom end of the brush housing 813.

A brush assembly 808 having a plurality of bristles 810 connects to the brush housing 813 and rotates relative thereto. A plurality of spray nozzles 812 are positioned around the brush assembly 808 and allow a user to rinse areas of his or her body with water from a fluid source, such as the showerhead 104, diverter valve, or J-pipe. The brush 800 also includes a connector assembly 806 to connect the brush 800 to a fluid source, such as a hose or J-pipe. The connector assembly 806 may be a quick connect/release connector to allow a user to easily use the brush 800 with or without the fluid source, allowing a user to use the brush in the shower or outside of the shower environment. The brush 800 may be a hand-held rotating therapeutic brush that can be used on a user's body, face, and the like.

Figure 19:
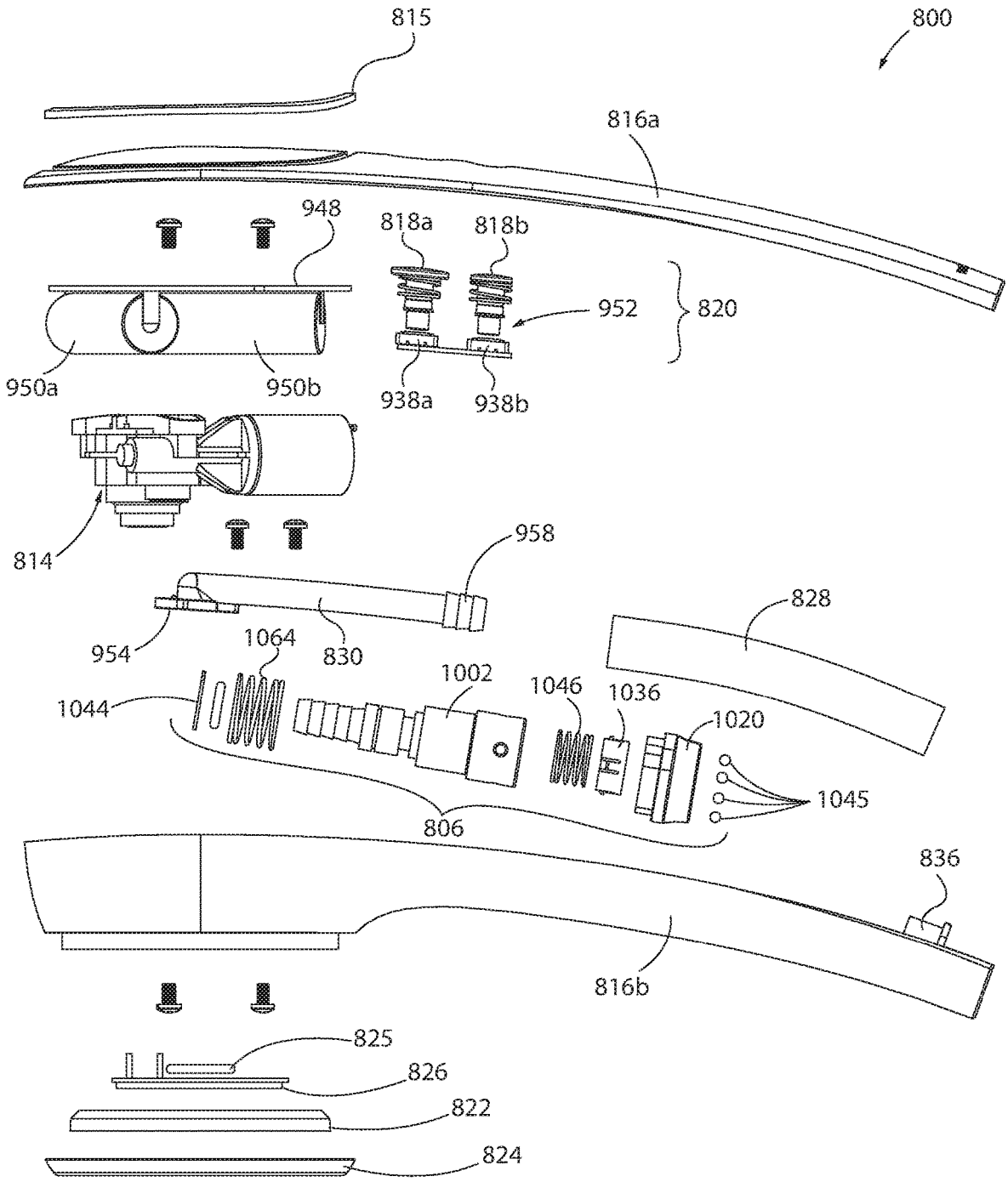
FIG. 19 is an exploded view of the skin brush of FIG. 18A.
Figure 20A:
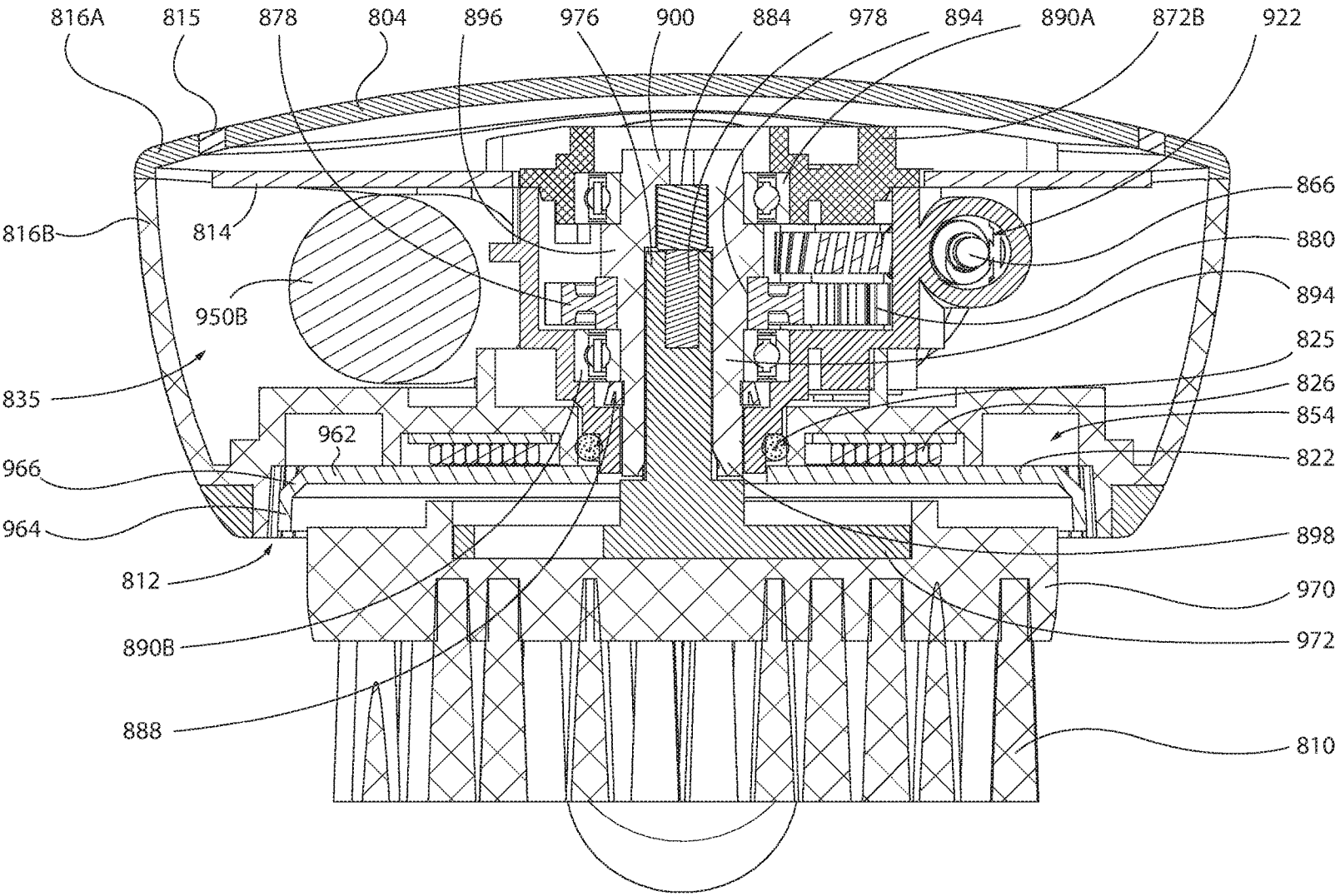
FIG. 20A is a cross-sectional view of the skin brush of FIG. 18A taken along line 20A-20 in FIG. 18B.
Figure 20B:
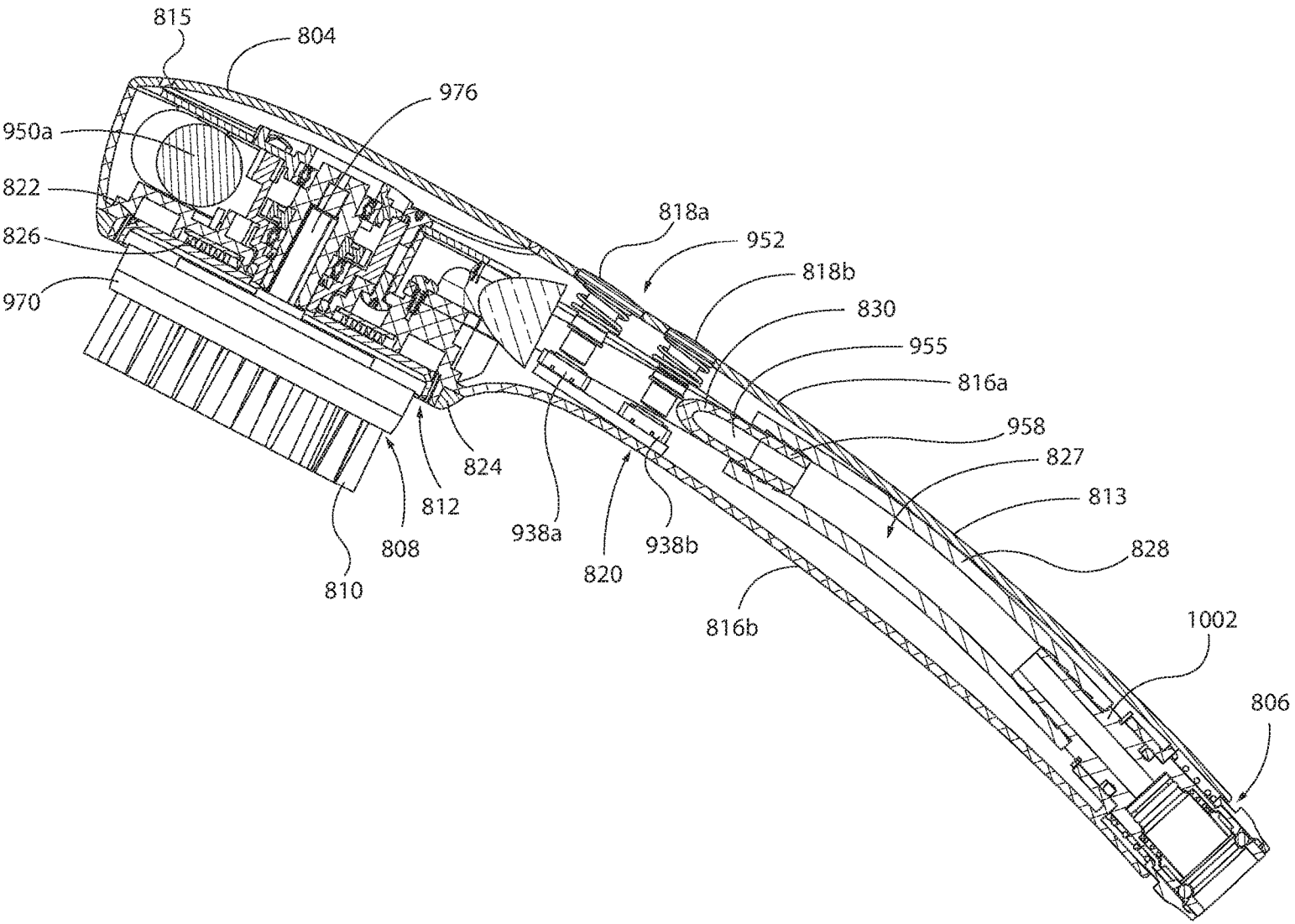
FIG. 20B is a cross-sectional view of the skin brush of FIG. 18A taken along line 20B-20B in FIG. 18B.
Figure 20C:
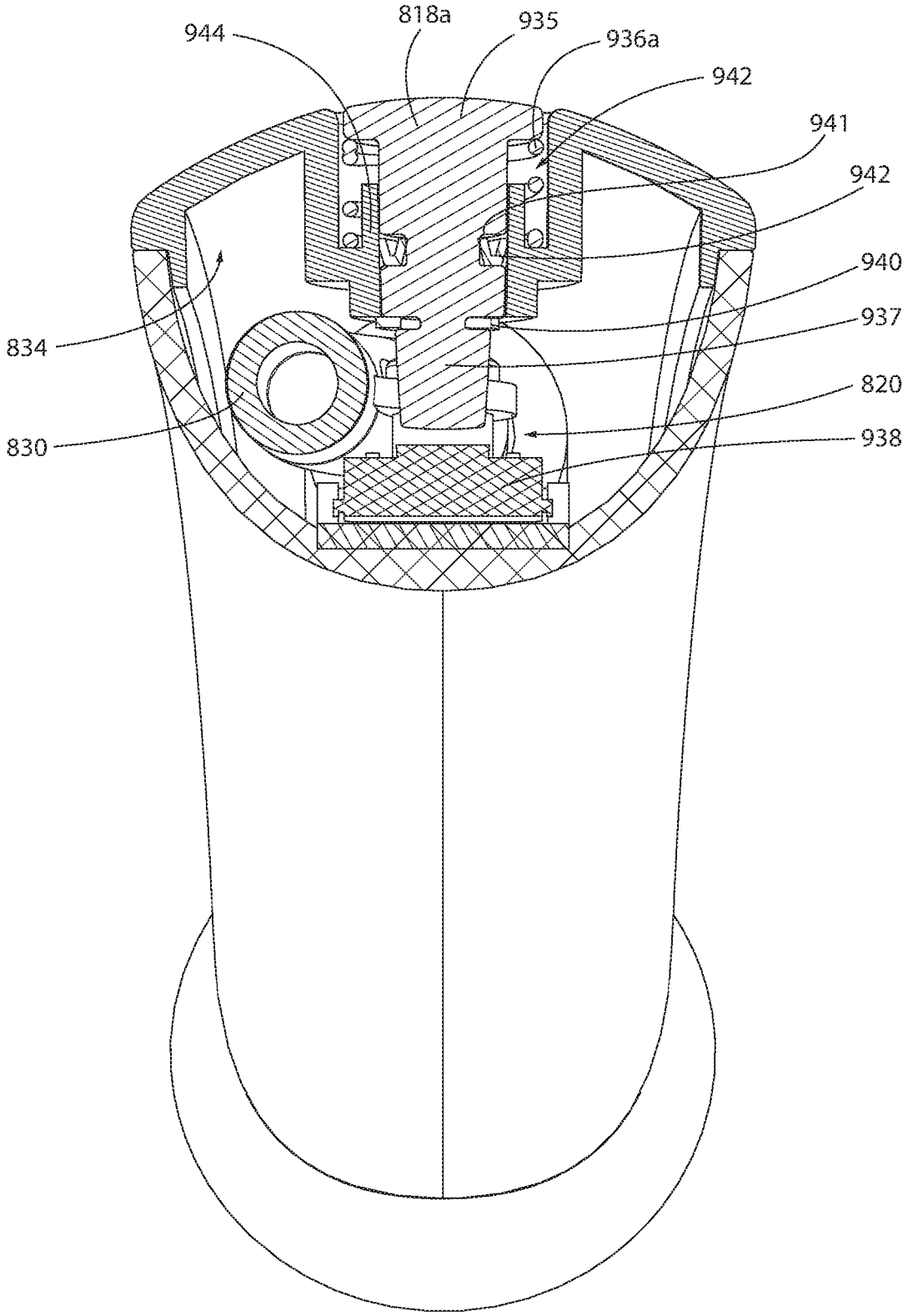
FIG. 20C is a cross-sectional view of the skin brush of FIG. 18A taken along line 20C-20C in FIG. 18B.

FIG. 19 is an exploded view of the brush. FIGS. 20A-20C illustrate various cross sectional views of the brush 800. With reference to FIGS. 19-20C, the brush 800 includes a number of components for activating and driving the brush movement and water output. The brush 800 may include a drive assembly 814 that drives the brush assembly 808, one or more input buttons 818*a*, 818*b* that activate the brush, a control assembly 820 for activating and varying the brush motion and optionally the fluid output, a charging coil 826 for charging the batteries 950*a*, 950*b*, and the connector assembly 806 for connecting the brush 800 to the fluid source. Optionally, a lighting element 803, such as a light pipe or light emitting diode, may be included on the brush 800, such as around one of the buttons or on the handle to provide indications to a user regarding battery charge state, mode, or the like. Additionally, the brush 800 may include one or more internal hoses 828, 830 for fluidly connecting the spray nozzles 812 to the fluid source that connects to the connector assembly 806. The various components of the brush 800 are connected to or positioned within the brush housing 813. The brush housing 813 and each of the brush components will be discussed, in turn, below.

The brush housing 813 defines a handle cavity 834 and a head cavity 835 that receive different components of the brush 800. In some embodiments, the brush housing 813 may be defined by two different components, such as a first shell 816*a* and a second shell 816*b*. In this embodiment, the two shells 816*a*, 186*b* are connected together (e.g., through ultrasonic welding, adhesive, press fit, fasteners, or the like) to define a compartment. In some embodiments, the two shells 816*a*, 186*b* may be equal halves having substantially the same depth and dimensions. In other embodiments, such as the ones shown in FIGS. 19A, 20A, and 20C, the shells 816*a*, 816*b* are asymmetrical with the first shell 816*a* defining a top for the second shell 816*b*, which defines the depth and shape of the handle cavity 834 and head cavity 835.

Figure 21A:
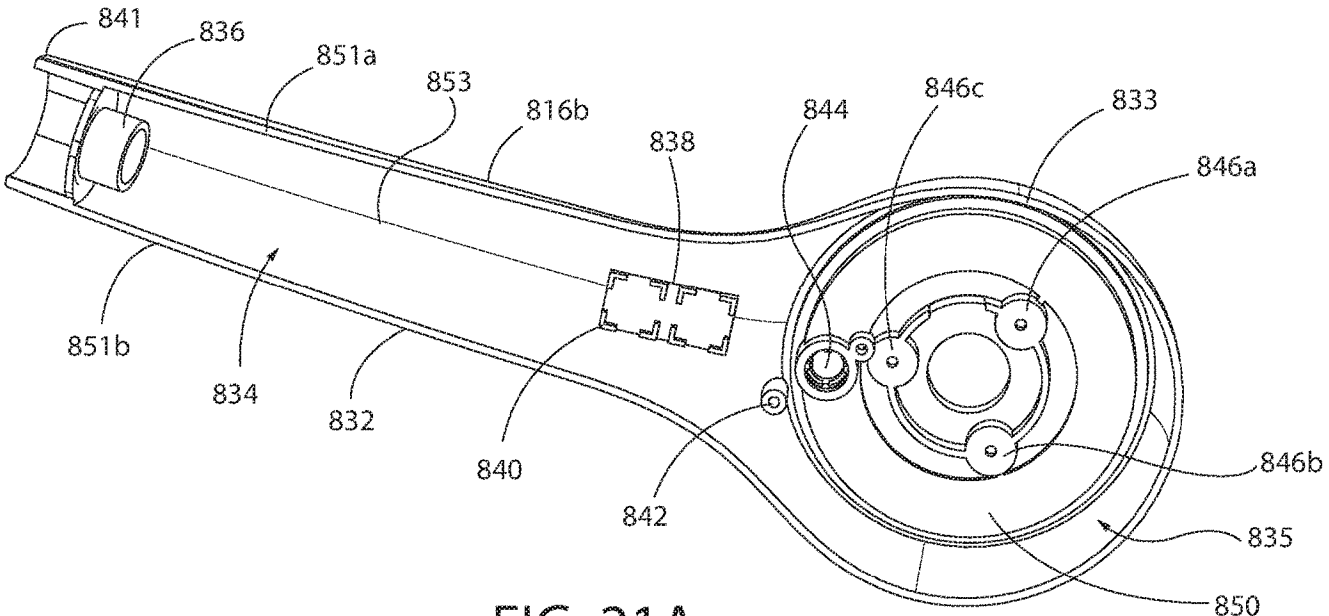
FIG. 21A is a rear plan view of a first shell of a housing of the skin brush of FIG. 18A.
Figure 21B:
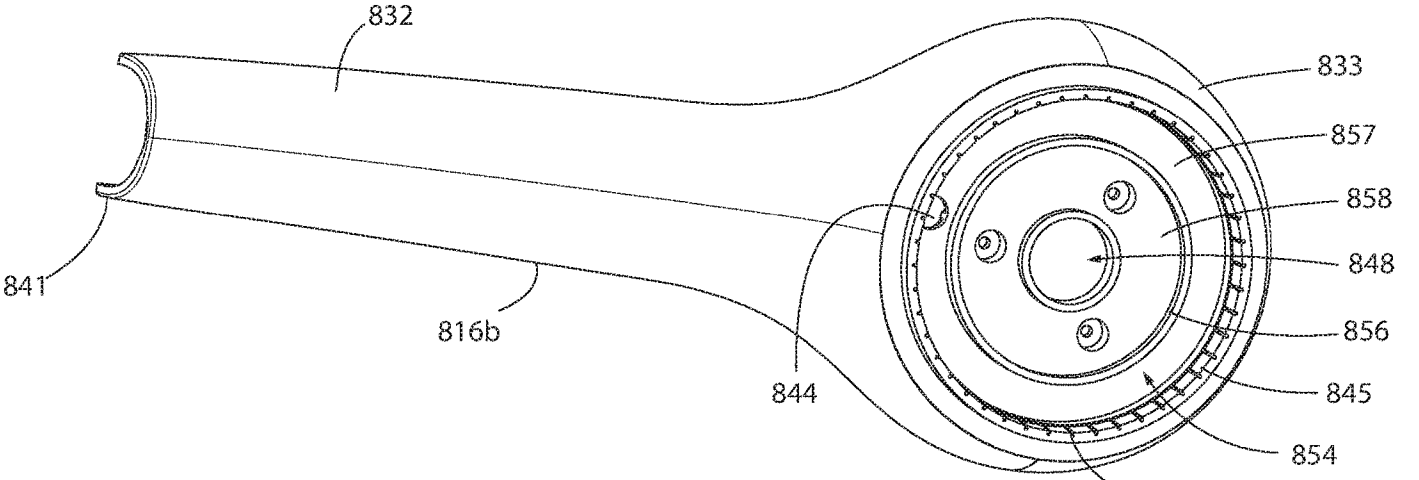
FIG. 21B is a front plan view of the first shell of FIG. 21A.

FIGS. 21A and 21B illustrate top and bottom plan views of the second shell 816*b*. With reference to FIGS. 21A and 21B, the second shell 816*b* may be formed as an integral molded component having an elongated portion 832 that transitions to define a head portion 833. In some embodiments, the elongated portion 832 flares outwards as it approaches the head portion 833 to define a gentle inflection point at the intersection of the two portions.

A valve securing structure 836 may be defined towards a bottom end 841 of the elongated portion 832 of the second shell 816*b*. In some embodiments, the valve securing structure 836 may be defined as a ring extending from an interior bottom surface 853 of the elongated portion 832 upwards and may span across the top edges 851*a*, 851*b* of the second shell 816*b*. The valve securing structure 836 may include ribs or other keying or structural features that engage with corresponding features of the connector assembly 806 as will be discussed in more detail below. In these embodiments, the valve securing structure 836 may be formed as a ring shaped structure that connects to the connector assembly 806 as discussed in more detail below.

With reference to FIG. 21A, the interior bottom surface 853 of the second shell 816*b* may also define or include additional structures, such as hose connection structure 842 and a button platform 838. The hose connection structure 842 may be configured to receive a fastener and direct the elbow hose 830 in a desired direction to accommodate the transition from the elongated portion 832 to the head portion 833.

The button platform 838 supports certain components of the control assembly 820 and may raise switches of the control assembly 820 to a sufficient height to interface with the input buttons 818*a*, 818*b*. The button platform 838 may also include one or more bracket walls 840 that help to maintain the orientation of the control assembly 820 relative to the input buttons 818*a*, 818*b*. In one embodiment, the bracket walls 840 maybe formed as corner L-shaped features, but can be defined in other manners as desired.

With reference to FIG. 21A, the head portion 833 also includes similar connecting structures, such as securing brackets 846*a*, 846*b*, 846*c*, that include apertures defined therethrough for receiving fasteners to secure internal components to the second shell 816*b*. Additionally, an interior bottom surface 853 of the head portion 833 may include a fluid outlet aperture 844 defined therethrough that provides a flow pathway for fluid to the spray nozzles 812. A drive aperture 848 may be defined through a center of the head portion 833 and is configured to receive portions of the drive assembly 814 therethrough to drive the brush assembly 808.

With reference to FIG. 21B, the outer surface of the head portion 833 includes a nozzle ring 845 defining a plurality of nozzle channels 852. The nozzle ring 845 may be formed integrally with the head portion 833 or may be a separate component, such as a removable ring, that is inserted into the recessed area on the exterior surface 857 of the head portion 833. In some embodiments, the nozzle channels 852 may be defined as linear grooves or cutouts that extend substantially perpendicular from the exterior surface 857 of the head portion 833. The exterior surface 857 may be recessed downwards from a top edge 859 of the head portion 833 and be defined as generally circular surface. In these embodiments, the nozzle channels 852 are spaced around the outer circumference of the recessed area of the exterior surface 857 and extend upwards towards the top edge 859. In other embodiments, the nozzles may be apertures defined through the housing.

The exterior surface 857 may include a separating wall 856 that may be substantially concentric with the drive aperture 848. The separating wall 856 defines a fluid channel 854 in fluid communication with the outlet aperture 844 and a coil channel 858 that is fluidly disconnected from the outlet aperture 844. In other words, the separating wall 856 defines a wet fluid channel 854 and a dry coil channel 858 on the exterior surface 857. Depending on the desired fluid flow pattern and drive mechanisms, the separating wall 856 may be differently configured, e.g., not concentric with the drive aperture.

Figure 22A:
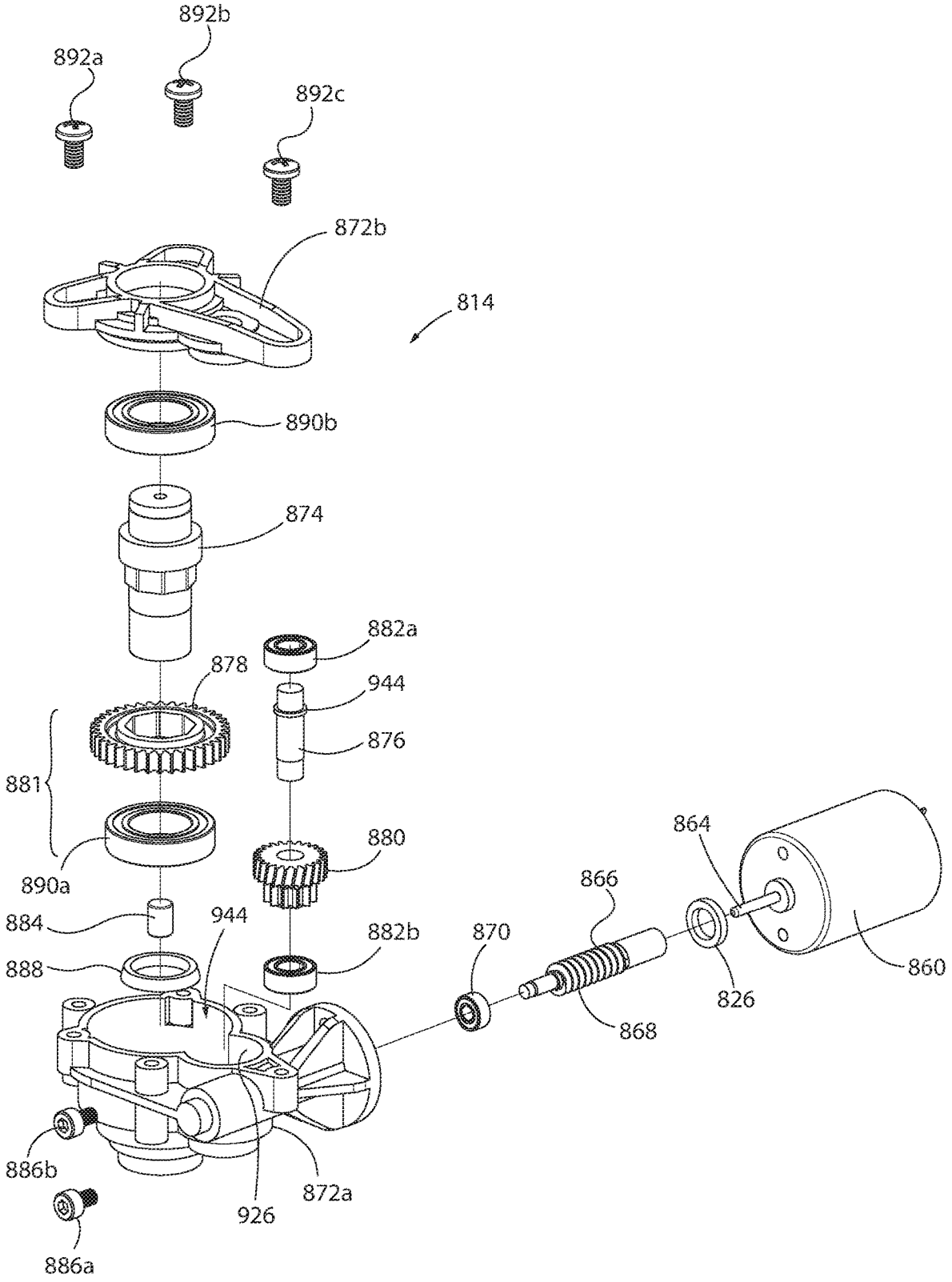
FIG. 22A is an exploded view of drive assembly for the skin brush of FIG. 18A.
Figure 22B:
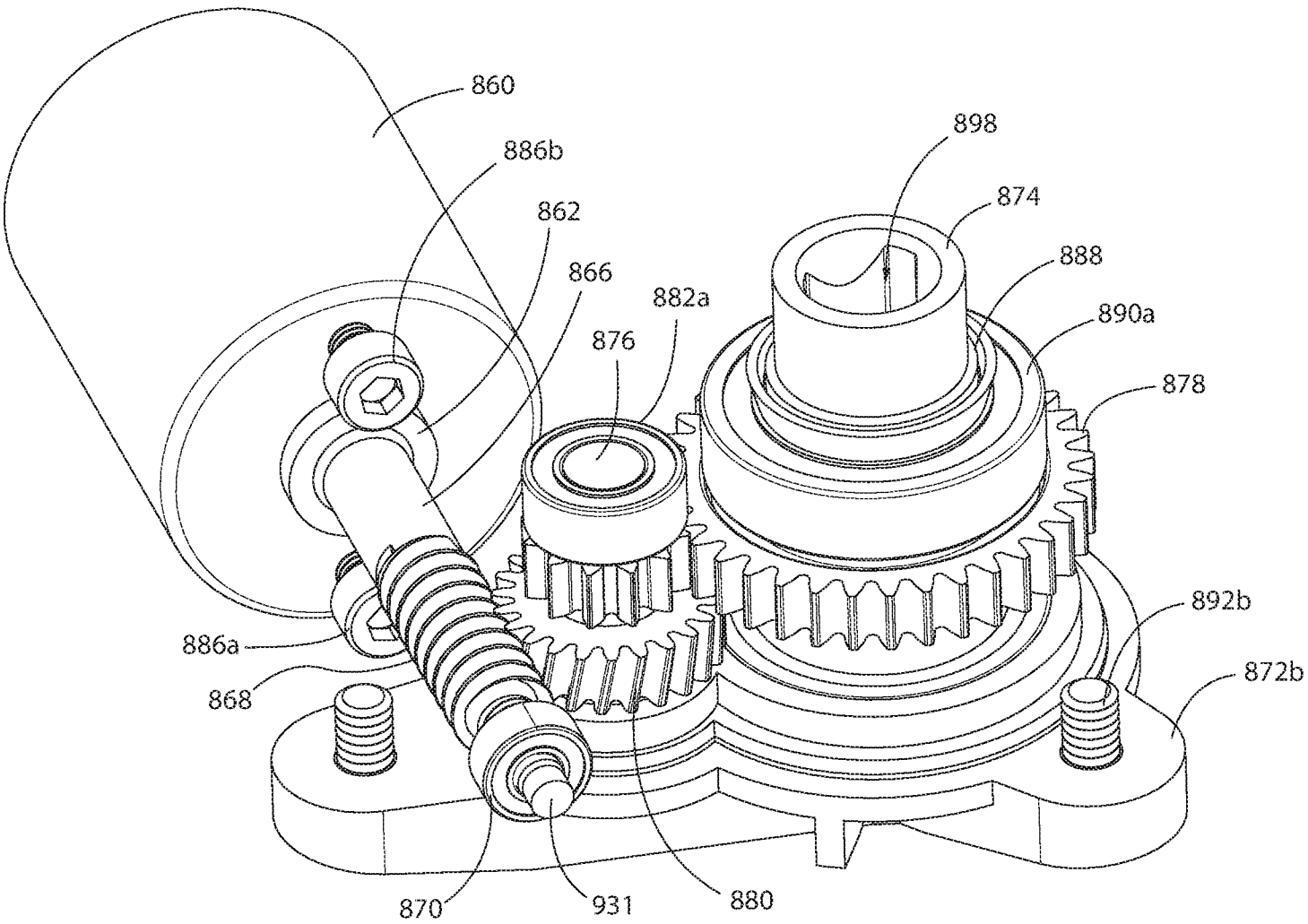
FIG. 22B is a bottom isometric view of the drive assembly with a first gear mount hidden to illustrate the internal components of the drive assembly.
Figure 22C:
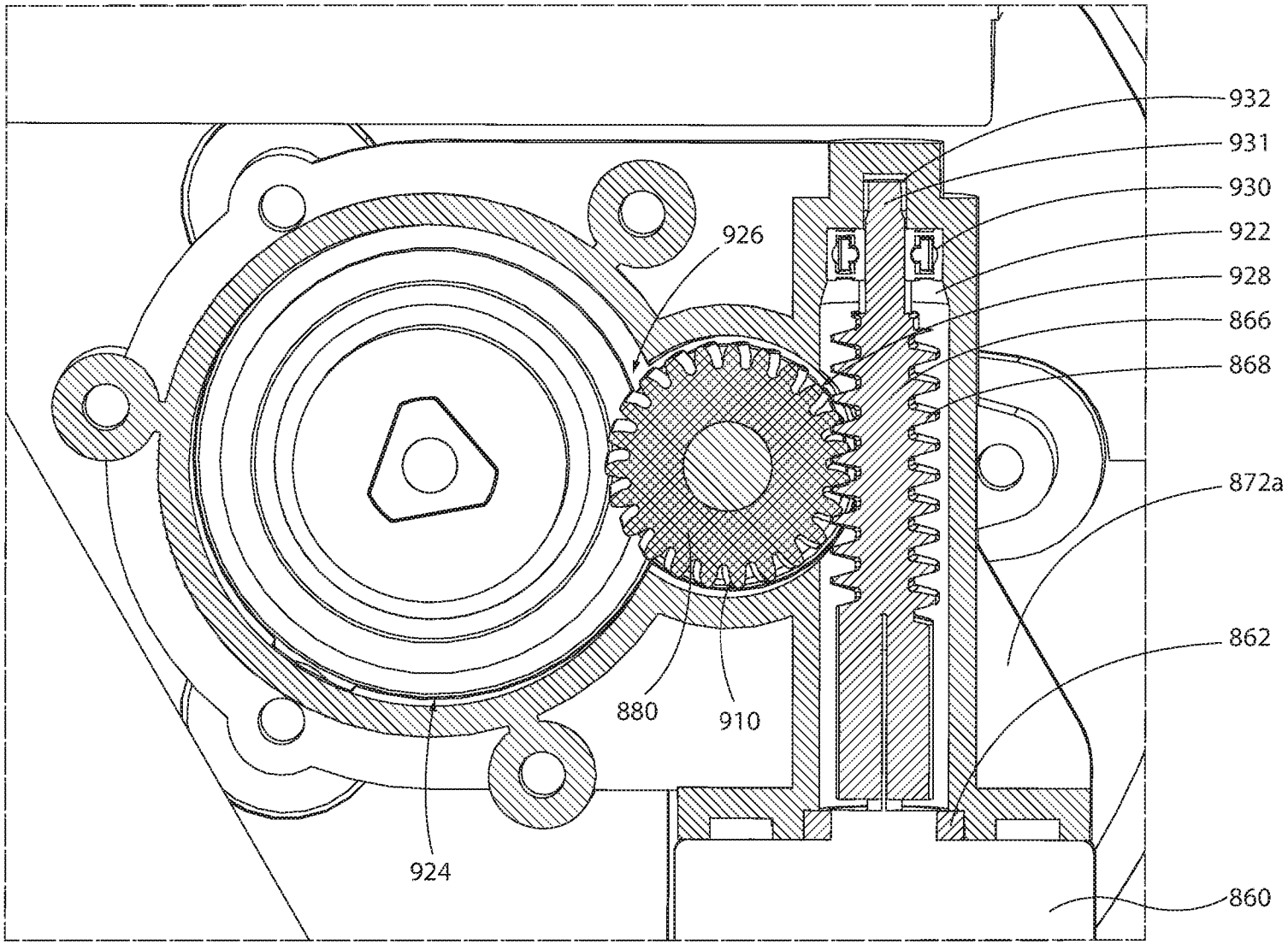
FIG. 22C is a fragmentary cross-sectional view of the skin brush of FIG. 18A illustrating the drive assembly of FIG. 22A.

The drive assembly 814 will now be discussed in more detail. FIG. 22A illustrates an exploded view of the drive assembly 814. FIG. 22B illustrates an isometric view of the drive assembly 814 with a first gear mount 872*a* hidden. FIG. 22C is an enlarged cross-section view of the brush 800 illustrating the drive assembly 814. The drive assembly 814 drives the brush assembly 808 in a desired movement pattern, such as a in a circular motion path. The drive assembly 814 includes a motor 860, a gear assembly 881 including one or more gears, one or more gear shafts, for example, a main shaft 874 and an intermediate shaft 876, gear mounts 872*a*, 872*b*, as well as sealing members, one or more bearings, and fasteners.

The motor 860 may be substantially any device that converts electrical power to mechanical movement. In one embodiment, the motor 860 includes a drive shaft 864 that rotates in response to electrical power. The drive shaft 864 may rotate continuously in one direction to provide a desired continuous motion for the brush assembly 808 or may be varied to rotate in other manners. As one example the motor 860 may be an 8 volt direct current motor that rotates at 14,000 RPMs (no load), but other motors can be used as well and the above is just one example. In other embodiments, the motor 860 may be configured to produce an oscillating or "back and forth" motion, may rotate in two directions, and/or may be driven by different signals produce a non-continuous or intermittent motion. The type of motor and the output of the motor may be varied depending on a desired motion output by the brush assembly 808.

Figure 23:
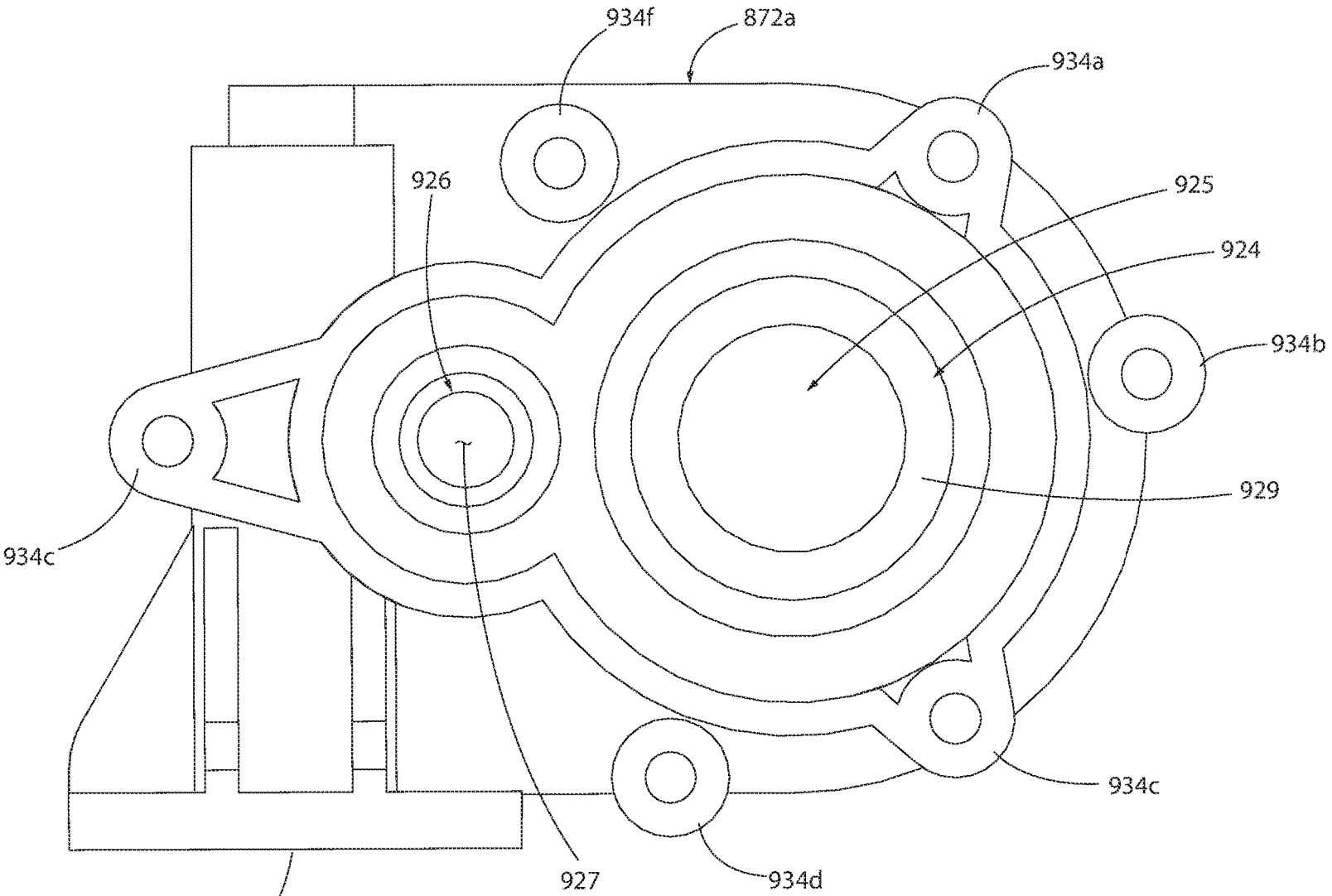
FIG. 23 is a top plan view of the first gear mount of the drive assembly of FIG. 22A.

The gear mounts 872*a*, 872*b* define a housing (e.g., gear box) for the gearing assembly of the drive assembly 814 and also may be configured to secure the gearing assembly to the brush housing 813. FIG. 23 is a bottom plan view of the first or top gear mount 872*a*. With reference to FIGS. 22C and 23, the first gear mount 872*a* defines a main compartment 924 and an intermediate compartment 926. Both compartments 924, 926 are configured to receive gear components of the drive assembly 814. Additionally, in some embodiments, certain components of the drive assembly 814 extend through the top gear mount 872*a* to secure to the brush housing 813 or access components within the housing. In these embodiments, the two compartments 924, 926 may include compartment apertures 925, 927 that extend through the top surface of the gear mount 872*a*. In one embodiment, the main compartment 924 has a larger diameter than intermediate compartment 926 and is configured to receive a larger gear assembly 881 than the intermediate compartment 926, but in other embodiments different configurations are envisioned. With reference to FIG. 22C, the two compartments 924, 926 may intersect one another to allow the gears housed in each compartment to mesh together. That is, the two compartments may be joined together to define an access between the two. As shown in FIG. 22C, the two compartments 924, 926 intersect along one side.

With reference to FIGS. 22C and 23, a worm cavity 922 may be defined as a generally tubular extension that extends tangential to intermediate and opposite the two compartments 924, 926. The worm cavity 922 is configured to house the worm gear 866 as discussed in more detail below. Accordingly, as shown in FIG. 22C, the worm cavity 922 may include a main portion that transitions to form a bearing pocket 930 and tapers at one end to define a pin pocket 932 configured to receive a bearing pin end 931 of the worm gear 866. In these embodiments, the worm cavity 922 is configured to have sufficient clearance to allow the worm gear 866 to rotate without interference. The bearing and pin pockets 930, 932 are also configured to secure the worm gear 866 in position and prevent lateral movement of the worm gear 866 within the worm cavity 922. The worm cavity 922 may be open on one adjacent the motor 860 end to allow the gear to be inserted therein, but the end of the pin pocket 932 may be closed on the to maintain the gear in a desired position within the gear mount 872*a*.

The worm cavity 922 intersects with the intermediate compartment 926 to allow the worm gear 866 to engage the gears housed in the intermediate compartment 926. With reference to FIG. 22C, in one embodiment, an engagement window 928 is defined as a slot or aperture defined through the sidewall defining the worm cavity 922 and in one embodiment is defined as an oval shaped slot.

With reference again to FIG. 23, the top gear mount 872*a* may also include a plurality of securing brackets 934*a*, 934*b*, 934*c*, 934*d*, 934*e* that may be spaced outer the perimeter of the gear mount 872*a*. The securing brackets 934*a*-934*e* may include apertures to receive fasteners for securing the top gear mount 872*a* to the brush housing 813 as discussed in more detail below.

With reference again to FIG. 22A, the gear shafts 874, 876 define a rotation axis for various gears in the drive assembly 814. The gear shafts 874, 876 are configured to support the gears and allow them to rotate. In some embodiments, the drive assembly 814 may include two gear assemblies with different rotation axes and therefore may include two gear shafts 874, 876. The intermediate shaft 876 may be used to support a cluster gear 880 or first gear and may be a generally cylindrical rod having a securing flange 944 defined towards a first end. The intermediate shaft 876 may be fixed to define a rotational axis about which the cluster gear 880 rotates. The securing flange 944 is used to support the cluster gear 880 and maintain the cluster gear 880 in a desired location relative to the length of the intermediate shaft 876.

Figure 24A:
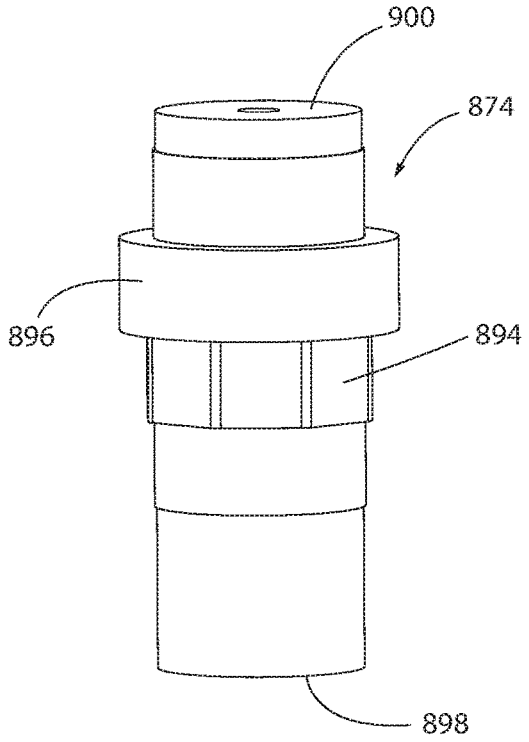
FIG. 24A is a front elevation view of a main shaft of the drive assembly of FIG. 22A.
Figure 24B:
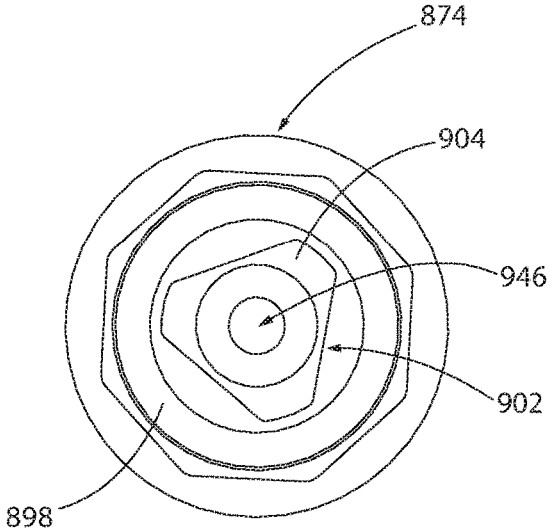
FIG. 24B is a top plan view of the main shaft of FIG. 24A.

Unlike the intermediate shaft 876, the main shaft 874 may be configured to rotate with the output gear 878. FIGS. 24A and 24B illustrate front elevation and top plan views, respectively, of the main shaft 874. With reference to FIGS. 24A and 24B, the main shaft 874 may be a generally cylindrical rod having an engagement end 898 and a securing end 900. A center axis of the main shaft 874 defines a rotation axis for the gear assembly of the drive assembly 814 and the main shaft 874. The main shaft 874 connects to and drives the brush assembly 808. In one embodiment, the main shaft 874 includes an annular band 896 or flange that extends around the outer perimeter at a greater diameter than the remainder of the main shaft 874. The shelf or band 896 may be positioned towards the securing end 900 of the main shaft 874 and defines a seat for one or more of the gears of the drive assembly 814. A keyed wall 894 may be defined adjacent the band 896 and may include a faceted surface or other keying structure for locking to the output gear 878 such that the main shaft 874 will be keyed to and rotate with the output gear 878. The keyed wall 894 may be defined as desired and its shape may vary depending on the type of fastening elements that are used to key the gear and the shaft together.

With reference to FIG. 24B, the engagement end 898 of the main shaft 874 defines a post cavity 902 for receiving a post or other component of the brush assembly 808. Engagement walls 904 defining the post cavity 902 are keyed to secure to the brush assembly 808 and ensure that the brush assembly 808 rotates with the main shaft 874. In one embodiment, the engagement walls 904 may be defined as angled or faceted walls that form a generally triangular shape with each corner of the triangle shape having a blunted end. The shape of the engagement walls 904 may vary based on the configuration of the brush assembly 808 and many different connections are envisioned.

The post cavity 902 terminates at a bottom wall that defines a magnet recess 946 to receiving a connection magnet 884. The magnet recess 946 may be shaped and dimension to match the shape of the connection magnet 884 and secure the connection magnet 884 in a desired position. The connection magnet 884 may be secured with adhesive, press-fit connection, or the like.

The gear assembly 881 for the drive assembly 814 will now be discussed in more detail. With reference to FIGS. 22A and 22C, the worm gear 866 is configured to be connected to and rotated by the drive shaft 864 of the motor 860. The worm gear 866 may include teeth 868 that extend around the outer surface thereof with the teeth 868 terminating before the bearing pin end 931 of the worm gear 866. The bearing pin end 931 may have a reduced diameter as compared to the remaining sections of the worm gear 866.

Figure 25A:
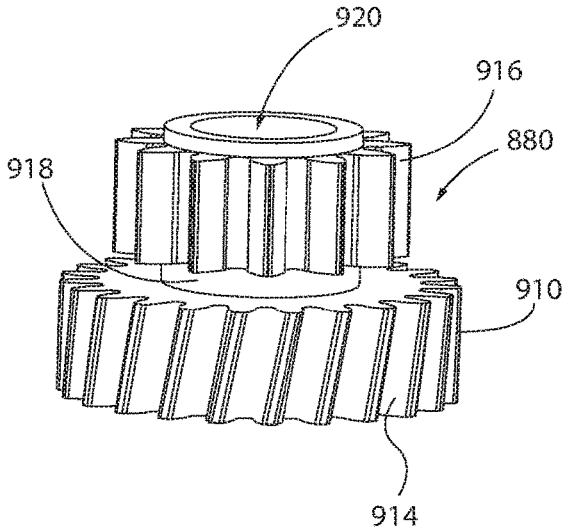
FIG. 25A is a front elevation view of a cluster gear of the drive assembly of FIG. 22A.
Figure 25B:
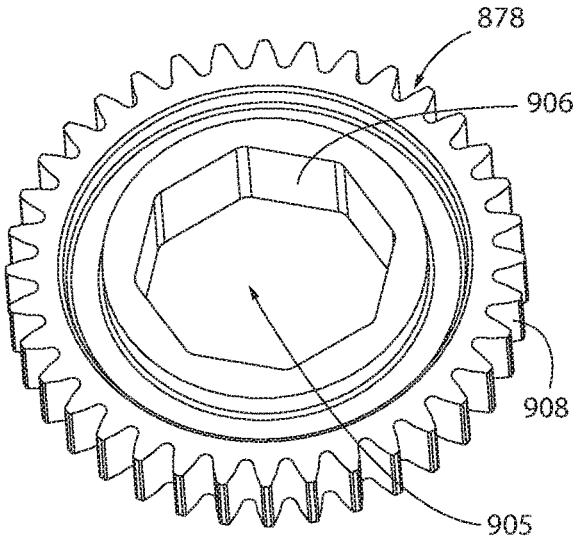
FIG. 25B is an isometric view of an output gear of the drive assembly of FIG. 22A.

FIGS. 25A and 25B illustrate isometric views of the cluster gear 880 and output gear 878, respectively. With reference to FIG. 25A, the cluster gear 880 may be a dual-plane gear including a worm wheel gear 910 and a shaft gear 912 stacked together. In one embodiment, the worm wheel gear 910 is positioned on the bottom of the shaft gear 912. The two gears 910, 912 are connected to and extend from a support shaft 918. The support shaft 918 may be a cylindrical tube having a center aperture 920 defined through its length. The center aperture 920 is configured to receive the intermediate shaft 876 and thus may have diameter that substantially matches that of the intermediate shaft 876.

In one embodiment, the worm wheel gear 910 has a larger outer diameter than the shaft gear 912 and extends further from the support shaft 918 than the shaft gear 912. Each of the gears 910, 912 may include engagement teeth 914, 916, respectively, or other features to mesh with corresponding gears, e.g., the worm gear 866 and the output gear 878. The pitch, angle, and other characteristics of the engagement teeth 914, 916 are selected based on a desired drive characteristics and parameters of the brush assembly 808, as well as based on the components of the drive assembly 814 and may be varied. In some embodiments, the worm wheel gear 910 and the shaft gear 912 may have different configurations. For example, in the embodiment shown in FIG. 25A, the engagement teeth 916 of the shaft gear 912 may be straight cut gears whereas the engagement teeth 914 of the worm wheel gear 910 may be helically shaped. In the embodiment shown in FIG. 25A, the worm wheel gear 910 includes helically cut engagement teeth 914 that extend from a top edge of the worm wheel gear 910 to the bottom edge of the worm wheel gear 910 at an angle. The helical structure of the engagement teeth 914 allow the worm wheel gear 910 to more easily engage with the teeth 868 of the worm gear 866 and helps to reduce noise during operation.

It should be noted that although the worm wheel gear 910 and the shaft gear 912 are shown in FIG. 25A as integrated together in a cluster gear 880, in other embodiments, the two gears 910, 912 may be differently configured and may be formed as separate gears that are operably connected together. With the cluster gear 880 arrangement, the number of parts for the brush 800 may be reduced, thereby reducing costs and assembly time, but other configurations can be used depending on the different requirements for the brush and assembly process.

With reference to FIG. 25B, the output gear 878 meshes with the cluster gear 880 to drive the brush assembly 808. In one embodiment, the output gear 878 may be formed as a ring gear having a plurality of teeth 908 extending around an outer surface thereof and an aperture 905 defined through a center thereof. In one embodiment, the aperture 905 is defined by a keyed surface 906 that includes plurality of facets or other keyed elements that engage with the main shaft 874 as discussed below. The teeth 908 are configured to mesh with the engagement teeth 916 of the shaft gear 912 and so in embodiments where the engagement teeth 916 of the shaft gear 912 are straight cut, the teeth 908 of the output gear 878 may also be straight cut. However, in other embodiments, the teeth 908 may be otherwise configured.

The drive assembly 814 may be connected together and inserted as a unit into the brush housing 813. With reference to FIGS. 22A-22C, to connect the drive assembly 814, the worm gear 866 is received around and connected to the drive shaft 864. A brushing 862 is positioned around the base of the worm gear 866 adjacent the top end of the motor 860. The bearing 870 is then received around the bearing pin end 931 of the worm gear 866. The worm gear 866 is inserted into the worm cavity 922 of the gear mount 872*a* with the bearing pin end 931 being positioned in an opposite end of the worm cavity 922 from the motor 860 in the pin pocket 932 of the worm cavity 922 and the bearing 870 seats in the bearing pocket 930 of the worm cavity 922, preventing lateral movement of the worm gear 866 within the worm cavity 922 and providing a rotational mount for the worm gear 866. A substantial portion of the teeth 868 of the worm gear 9866 may be arranged so that the teeth are aligned with the engagement window 928. The motor 860 is then secured to the gear mount 872*a* by fasteners 886*a*, 886*b* inserted into corresponding apertures on the motor 860 and apertures defined on the front lip surrounding the worm cavity 922. In this way, the motor 860 and the worm gear 866, which is secured to the motor 860, are prevented from moving longitudinally relative to the gear mount 872*a*.

The gear assembly 881 is positioned within the gear mount 872*a*. With reference to FIG. 20A, the connection magnet 884 is positioned within the magnet recess 946 of the main shaft 874 and secured in position. The engagement end 898 of the main shaft 874 is positioned in the main compartment 924 such that the main shaft 874 is aligned with the compartment aperture 925. The seal 888 is received around the outer surface of the main shaft 874 and is seated on a corresponding shelf 929 within the gear mount 872*a*. Bearing 890*a* is received around the main shaft 874 with the output gear 878 being received over the main shaft 874 adjacent the bearing 890*a*. The keyed surface 906 of the output gear 878 is positioned on and engaged with the keyed wall 894 of the main shaft 874 to secure the output gear 878 to the main shaft 874. With reference to FIG. 20A, the second bearing 890*b* is then positioned over the main shaft 874 and seats on the band 896 such that the band 896 separates the output gear 878 from the second bearing 890*b*.

With continued reference to FIG. 20A, the cluster gear 880 is connected to the gear mount 872*a* in a similar manner. In particular, the intermediate shaft 876 is positioned within the intermediate compartment 926 of the gear mount 872*a* and the intermediate shaft 876 is aligned with the compartment aperture 927 and positioned within the compartment aperture 927. Bearing 882*b* is positioned around the outer surface of the intermediate shaft 876 and the cluster gear 880 is received around the intermediate shaft 876. Specifically, the intermediate shaft 876 is inserted into the center aperture 920 of the cluster gear 880 and with the shaft gear 912 arranged to face towards the bearing 882*b*. In this manner the worm wheel gear 910 is aligned with the engagement window 928 and the engagement teeth 914 of the worm wheel gear 910 mesh with the teeth 868 of the worm wheel gear 910. The first bearing 882*a* is then positioned over the intermediate shaft 876 and seated on the securing flange 944.

Figure 26:
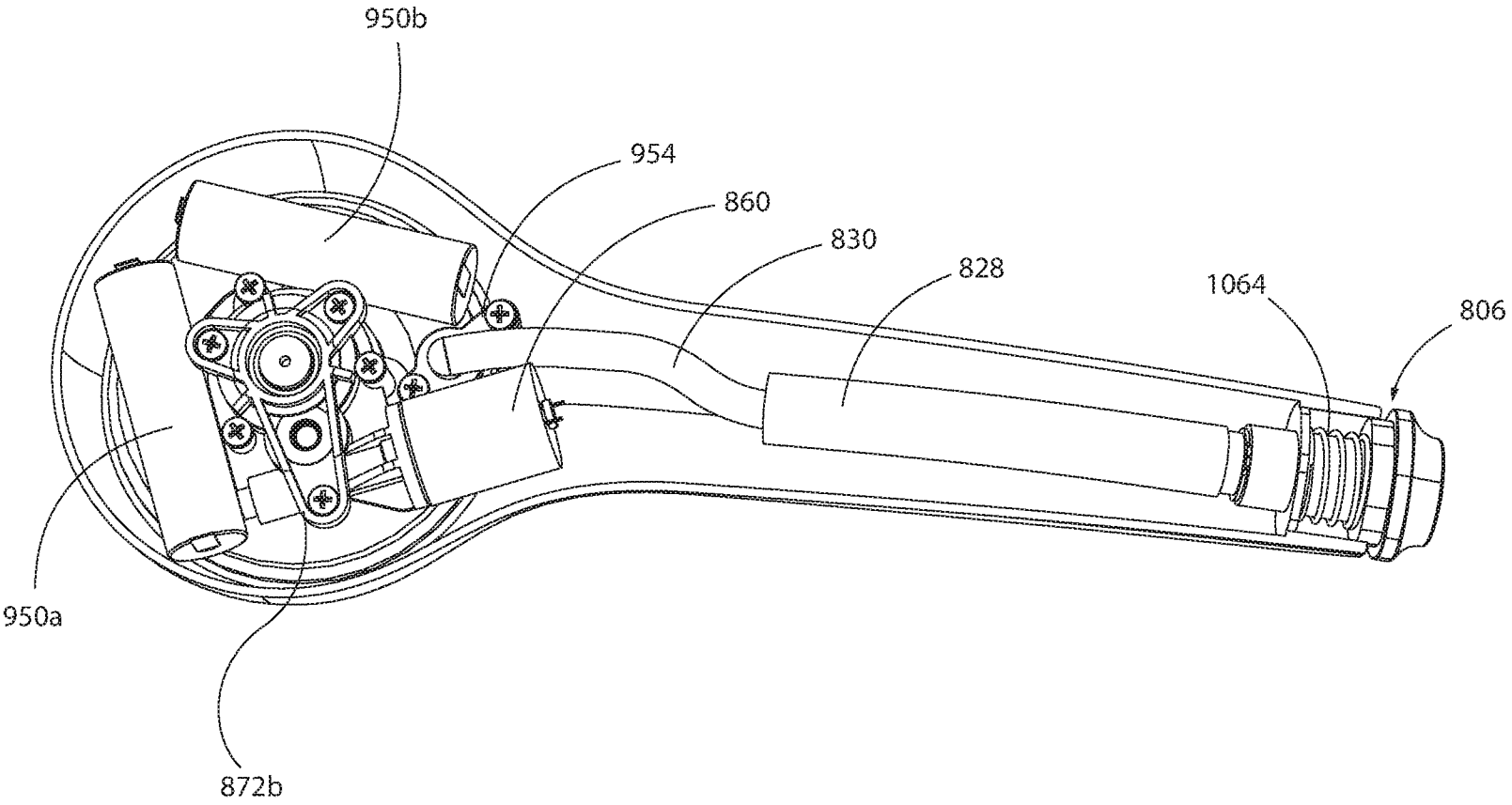
FIG. 26 is a rear plan view of the skin brush of FIG. 18A with certain components hidden.

With reference to FIGS. 20A, 22, and 26, the second gear mount 872*b* is positioned over and connected to first gear mount 872*a*. In particular, three of the securing brackets 934*a*, 934*c*, 934*e* on the first gear mount 872*a* are aligned with corresponding brackets on the second gear mount 872*b* and fasteners 892*a*, 892*b*, 892*c* are received therein, securing the two gear mounts 872*a*, 872*b* together to define a gear box 872 or housing for the drive assembly 814. The connected drive assembly 814 can then be electrically connected to the control assembly 820 and secured within the brush housing 813 of the brush 800 as discussed below.

The control assembly 820 will now be discussed in more detail. With reference to FIG. 19, the control assembly 820 may include a circuit board 948, one or more batteries 950*a*, 950*b*, and a button assembly 952 having two switches 938*a*, 938*b*. The control assembly 820 activates the drive assembly 814 to operate the brush 800 and optionally may be used to control the speed of the brush assembly 808.

The circuit board 948 connects the batteries 950*a*, 950*b* or other power source to the motor 860 of the drive assembly 814. The circuit board 948 may also include electronic components, such as one or more processing elements, microcontrollers, and/or microcomputers, which can be used to drive the brush. In one embodiment, the circuit board 948 also functions as a structural feature to support the batteries 950*a*, 950*b* within the brush 800. As shown in FIG. 20A, the batteries 950*a*, 950*b* are mounted to the circuit board 948 and are supported above the interior bottom surface 853 of the second shell 816*b* of the brush housing 813. The circuit board 948 also electrically connects the batteries 950*a*, 950*b* to the charging coil 826 such that the batteries 950*a*, 950*b* can be charged when the charger assembly is connected (discussed below).

The batteries 950*a*, 950*b* provide power to the drive assembly 814 to drive the brush assembly 808. The batteries 950*a*, 950*b* may be substantially any type of component that can store and release electricity. However, in one embodiment, the batteries 950*a*, 950*b* are lithium rechargeable AA-size batteries. With reference to FIG. 26 the batteries 950*a*, 590*b* are housed within the brush head 804 of the brush 800 and in some embodiments may be selected to have a length that is shorter than or substantially the same as a diameter of the head portion 833 of the second shell 816*b* of the brush housing 813. This allows the batteries 950*a*, 950*b* to be arranged at different angles relative to one another and spaced within the second shell 816*b* around the other components, such as the drive assembly 814 and the like. In some embodiments the batteries 950*a*, 950*b* may be positioned at a first angle and a second angle, respectively, relative to a centerline of the head portion 833 of the brush housing 813. In this manner, each of the batteries 950*a*, 950*b* may extend longitudinally so as to avoid or not intersect with the centerline of the brush housing 813. In these embodiments, the motor or other portions of the drive assembly 814 may be positioned around the centerline as well to act to counterbalance the head portion 833 when the handle is held by a user and distribute the weight around the centerline, making it easier for a user to manipulate and use. In some implementations, the batteries 950*a*, 950*b* may be positioned around the perimeter of the brush head to offset the weight of the motor and the drive assembly and provide a balanced brush head 804 when the brush 800 is held by a user.

With reference to FIGS. 20B and 20C, as noted above, the button assembly 952 may include one or more input buttons 818*a*, 818*b* for activating and/or modifying the motion of the brush assembly 808. Each input button 818*a*, 818*b* may include a head portion 935 and a stem 937 that extends from and connects to the head portion 935. The head portion 935 includes a slightly curved top surface where the curvature substantially matches the curvature of the first shell 816*a* of the brush housing 813 to provide an aesthetically pleasing appearance. The stem 937 is configured to actuate a corresponding switch 938*a*, 938*b* on the button assembly 952. The stem 937 may include an annular grooves 941 configured to receive a seal 942. For example, a seal 942, such as a U-cup, may be inserted into the annular groove 941 on the stem 937. The button assembly 952 may also include a clip 940 or other fastening element to secure the input buttons 818*a*, 818*b* to the brush housing 813.

The switches 938*a*, 938*b* are connected to the button assembly 952 and are configured to be mechanically moved (e.g., compressed) by the input buttons 818*a*, 818*b*. The switches 938*a*, 938*b* close a circuit to provide power to the motor from the batteries 950*a*, 950*b* or to provide a first or second signal to the motor, such as a reduced voltage signal to the motor to provide a first speed and an increased voltage signal to provide a second speed. In one embodiment the switches 938*a*, 938*b* move vertically to open/close the circuits, but substantially any other type of electrical switch can be used.

The button assembly 952 may also include one or more light sources, such as light emitting diodes, to illuminate icons around or on the input buttons 818*a*, 818*b* to provide an indication to the user regarding the state of the brush 800, such as the current mode selected, battery status, or the like.

With reference to FIGS. 19 and 26, the brush 800 also includes internal fluid directing structures. The elbow hose 830 and connection hose 828 direct fluid from a water supply, such as the showerhead or J-pipe, to the outlet aperture 844 in the second shell 816*b* of the brush housing 813. The elbow hose 830 defines a fluid passageway 955 through its length and is configured to connect to the interior bottom surface 853 of the second shell 816*b* and includes a connector 954 on a terminal end thereof. The connector 954 may be formed integrally with the elbow hose 830 and include a central portion and two arms that extend off of either side. The arms may include fastening apertures to receive fasteners that secure the connector 954 to the second shell 816*b*. The opposite end of the elbow hose 830 includes a barbed end 958 for connecting to the hose 828.

With reference to FIG. 26, in some embodiments, the elbow hose 830 may be curved to fit around the button assembly 952. In these embodiments, the hose 830 may include a jog 956 or bend. The jog 956 may be permanent or may be formed by deforming the elbow hose 830, such as by securing the first and second ends of the hose at different angular positions. In some embodiments, the elbow hose 830 may include a securing bracket at the inflection point of the jog 956. In these embodiments, the elbow hose 830 can be secured in position in the brush housing 813 with the securing bracket used to maintain the desired position of the elbow hose 830 within the brush housing 813.

With reference to FIG. 20B, the connection hose 828 fluidly connects the elbow hose 830 to the connector assembly 806. The connection hose 828 defines a fluid passage 827 through its length and has a diameter that is larger than a diameter of the elbow hose 830. In this manner, the barbed end 958 of the elbow hose 830 can be received within a portion of the connection hose 828 to fluidly connect the two hoses 828, 830 together. In some embodiments, the connection hose 828 may be omitted and the elbow hose 830 may connect directly to the connector assembly 806. Additionally, it should be noted that in some embodiments, both hoses 828, 830 may be omitted and the fluid flow paths may be defined by the brush housing 813 itself (e.g., channel walls defined by the shells). The structure and configuration of the hoses 828, 830 may be varied as desired depending on the fluid source, the fluid pressure, and the like.

As shown in FIGS. 19 and 20A, a spray plate 822, along with the nozzle ring 845 of the second shell 816*b*, defines the spray nozzles 812 of the brush 800. In one embodiment, the spray plate 822 may be generally disc shaped member having a drive aperture 968 defined through a central region. The drive aperture 968 is configured to receive a portion of the brush assembly 808 therethrough, allowing the brush assembly 808 to connect to the drive assembly 814 as discussed in more detail below. The main body 962 of the spray plate 822 may be a generally planar surface having an annular spray wall 964 extending normally outwards along a perimeter thereof. The spray wall 964 defines the perimeter of the spray plate 822 and in some embodiments has a beveled or angled transition defining an angled edge 966 between the main body 962 and the spray wall 964. The angle or pitch of the edge 966 may be selected to encourage a desired volume of fluid to flow between the spray plate 822 and the nozzle ring 845 through the plurality of nozzle channels 852. In these embodiments, the spray nozzles 812 may be defined around the edge of the spray wall 964. However, in other embodiments, the spray nozzles 812 may be defined through the spray plate 822 or by elements connected to or formed with the spray plate 822 or housing (e.g., rubber nozzle outlets).

The brush assembly 808 will now be discussed in more detail. The brush assembly 808 includes the bristles 810, a bristle base 970, a bristle carrier 972, and a connection mechanism, e.g., a connecting magnet 978. Each will be discussed, in turn, below with reference to FIGS. 27A-27C. As discussed above, in some embodiments, the brush assembly 808 is removable from the brush 800 to allow easy replacement of the brushes and to allow different users to share the same device, but without having to share the brush assemblies 808, which could be unhygienic. Additionally, in some embodiments, the brush assemblies 808 may have tailored configurations for certain uses and a user can use the specialized brushes as desired.

The bristles 810 are flexible elements configured to contact a user's skin. In some embodiments, the bristles 810 are separate elements that flare out as they expand from a bottom or connection end 983 to an engagement end 981. In this manner, the spacing between the bristles 810 may be reduced towards the engagement end 981 of the bristles 810, generating a larger surface area for contacting a user's skin. The engagement ends 981 of the bristles 810 may be dimensioned and shaped based on a desired action or feeling on the user's skin, e.g., exfoliating, stimulating, massaging, and so on. In some embodiments, the engagement end 981 may be substantially flat and each of the bristles 810 may have the same length to define a relatively constant, flat, work surface that engages a user's skin.

The bristle base 970 secures the bristles 810 in a desired orientation and moves the bristles 810 as a collective group. In this manner the bristle base 970 may form a substrate for the bristles 810. The bristle base 970 includes a main body 980 having a face surface 982 and a rear surface 986. The face surface 982 includes a plurality of bristle cavities 984 configured to receive one or more bristles 810. In some embodiments, the bristle cavities 984 are arranged in a spiral or swirl shape extending from a center of the face surface 982. In this manner the bristles 810 are spatially separated along the face surface 982 and generally distributed in a uniform manner across the face surface 982, but in an aesthetically pleasing pattern. The shape and orientation of the bristle cavities 984 may be varied as desired and may be selected based on a desired purpose of the brush 800 and can be configured to enhance certain functions like cleansing, massaging, and the like. With reference to FIG. 27A, the bristle base 970 includes a carrier recess 988 defined on the rear surface 986. The carrier recess 988 is configured to connect to and engage the bristle carrier 972.

Figure 27B:
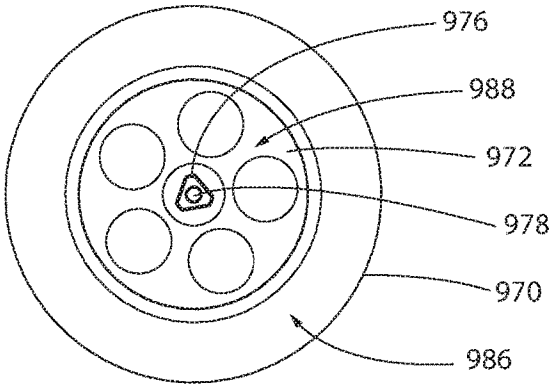
FIG. 27B is a rear plan view of the brush assembly of FIG. 27A.
Figure 27A:
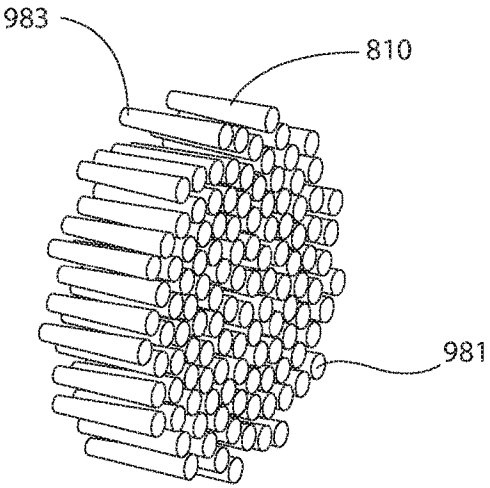
FIG. 27A is a rear isometric view of a brush assembly for the skin brush of FIG. 18A.
Figure 27A:
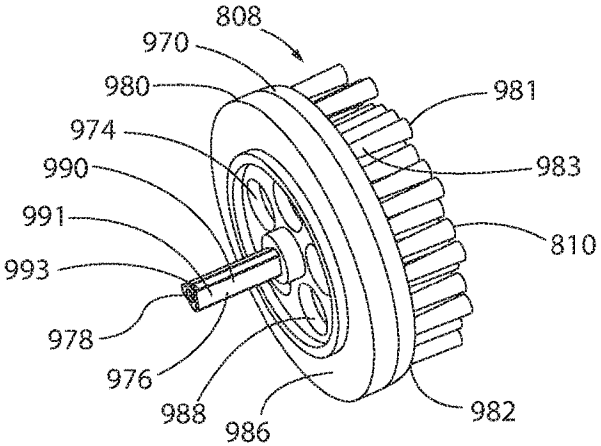
Figure 27C:
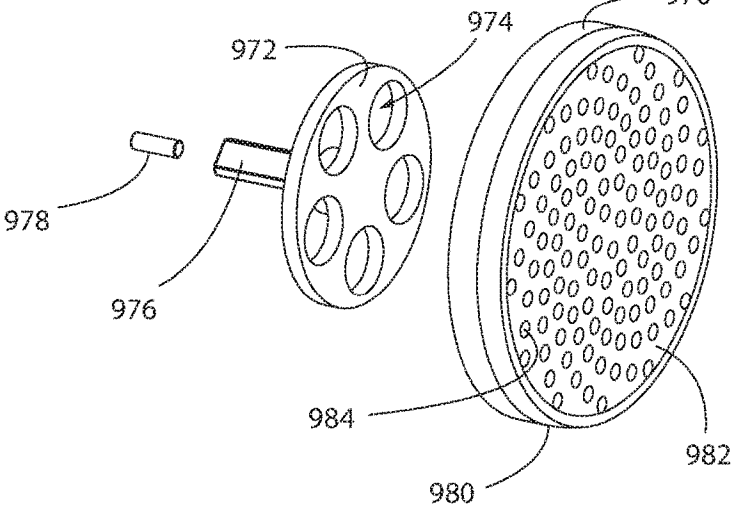
FIG. 27C is an exploded view of the brush assembly of FIG. 27A.
Figure 28:
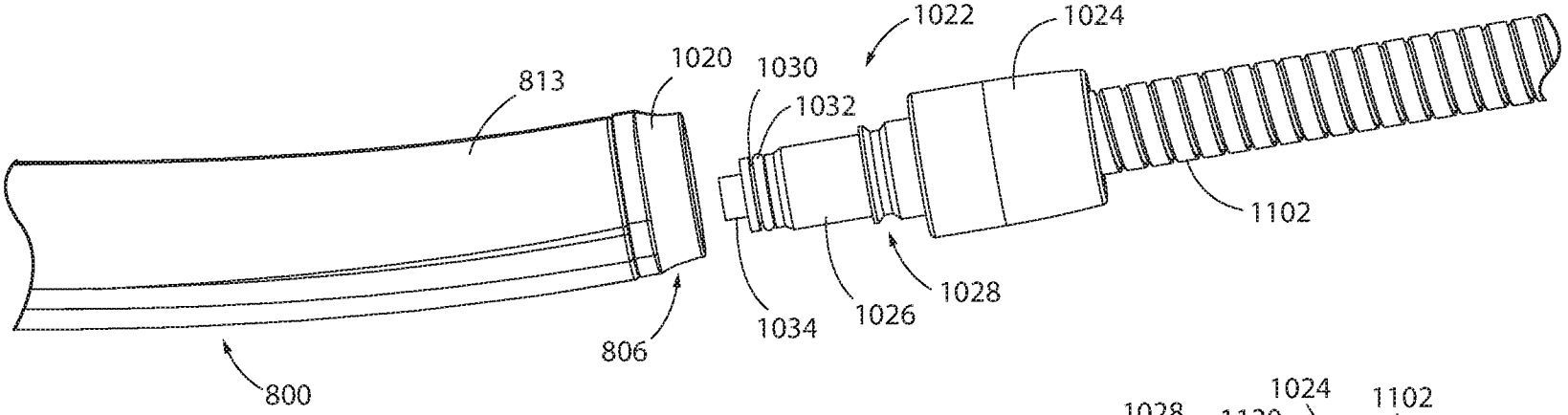
FIG. 28 is an enlarged view of the skin brush of FIG. 18A and a hose connector assembly in the disconnected position.

With reference to FIGS. 27A-27C, the bristle carrier 972 connects to the drive assembly 814 of the brush 800 to move the bristles 810 in a desired manner. The bristle carrier 972 includes a brush shaft 976 extending from a back surface thereof. The brush shaft 976 may include a keyed surface 990 to engage with the drive assembly 814 to ensure that the brush shaft 976 rotates with the drive assembly. The keyed surface 990 may also assist a user in installing the brush assembly 808 correctly to the brush 800. In one embodiment, the keyed surface 990 may be generally triangular shaped but with blunted corner edges. In this manner, the keyed surface 990 includes large, angled, facet surfaces 991 and small, angled, facet surfaces 993 that alternate such that a small, angled, facet surface 993 is positioned between each pair of adjacent large facet surfaces 991. However, other keying structures, such as longitudinal ribs, an asymmetrical shape, or the like, can be used as well. The bristle carrier 972 may also include apertures 974 to reduce the weight of the bristle carrier 972 and as such may be omitted if desired.

The connecting magnet 978 is used to releasably secure the brush assembly 808 to the drive assembly 814. In some embodiments, the connecting magnet 978 may be a permanent magnet that is attracted to the corresponding connection magnet 884 in the drive assembly 814 to fasten the brush assembly 808 to the drive assembly via a magnetic force. However, the magnetic force may be selected to have a limit such that a user can pull the brush assembly 808 apart from the drive assembly 814 to remove and replace the brush assembly 808. In embodiments where magnets are used, the connecting magnet 978 will exert a force assist a user in connecting the brush assembly 808.

To assemble the brush assembly 808, each of the bristles 810 are secured in a respective bristle cavity 984 on the bristle base 970. The bristles 810 may be secured through adhesive, welding, press fit, or the like. The bristle carrier 972 is positioned within the carrier recess 988 on the bristle base 970 and secured in position through insert molding techniques, adhesive, fasteners, or the like. The connecting magnet 978 is then inserted into the brush shaft 976. For example, the brush shaft 976 may include a cavity for receiving the connecting magnet 978. The connecting magnet 978 may be secured within the cavity in a variety of manners, such as, but not limited to, adhesive, press fit connection, or the like. Once assembled, the brush assembly 808 can be secured and released from the brush 800 as will be discussed in more detail below.

Figure 29A:
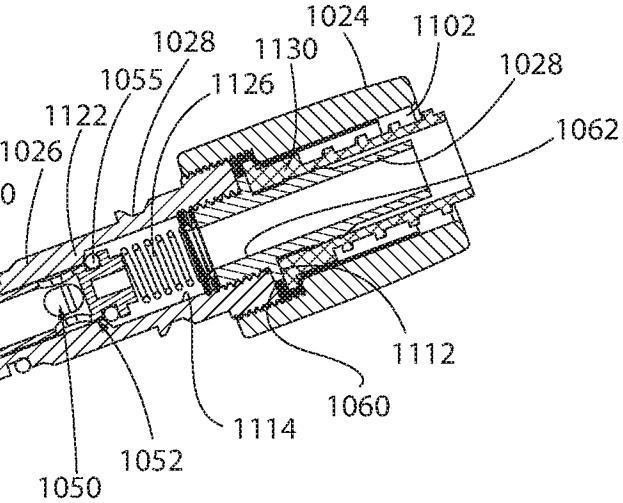
FIG. 29A is a cross-section view of the skin brush and hose connector of FIG. 28.
Figure 29A:
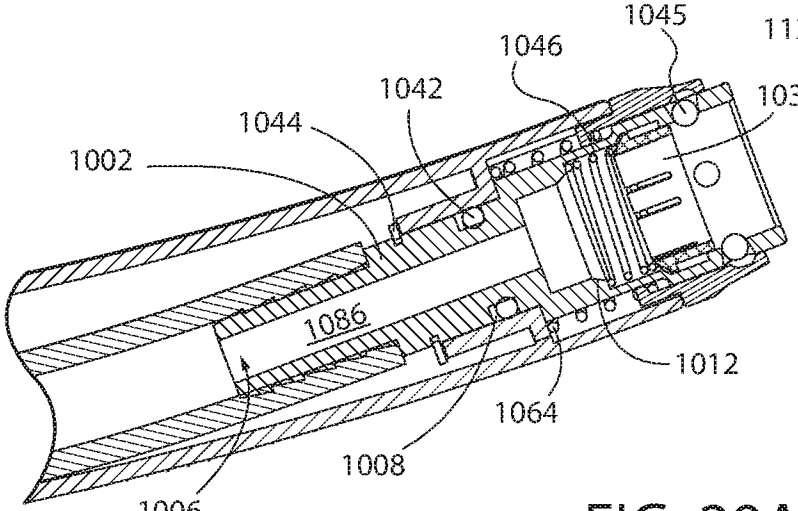
Figure 29B:
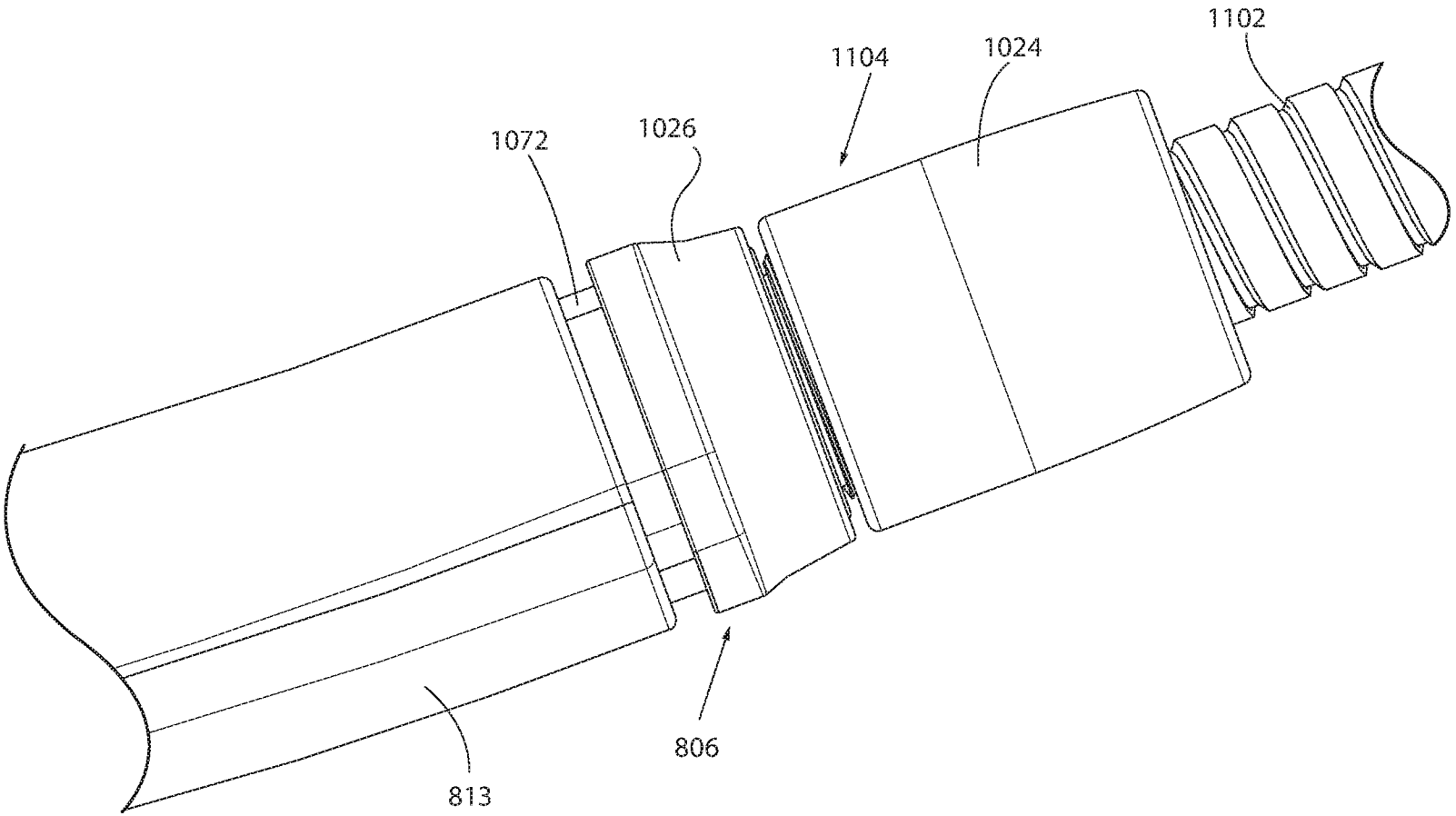
FIG. 29B is an enlarged view of the skin brush and hose connector of FIG. 28 in the connected position.

The connector assembly 806 will now be discussed in more detail. FIGS. 29A-29C illustrate various views of the connector assembly 806 connected to the brush 800. FIGS. 30A-31C illustrate the connection assembly 1004 and various components of the connector assembly 1104 separated from the brush 800. With reference to FIGS. 29A, 29B, 30A, and 30B, the connector assembly 806 is used to secure the hose or other fluid source to the brush housing 813. The connector assembly 806 may include a hose connector 1002, a knob 1020 or other actuator, a knob biasing element 1064, and a latch assembly including a latch 1036, one or more retention balls 1045, and a latch biasing element 1046.

Figure 31B:
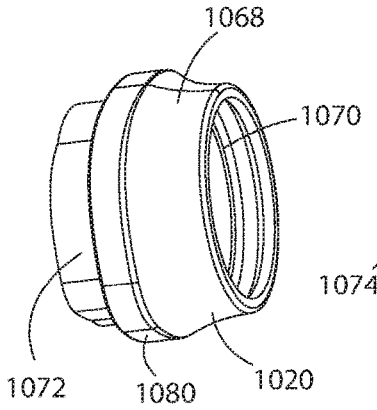
FIG. 31B is an isometric view of a hose connector body for the connector assembly of FIG. 30A.
Figure 31A:
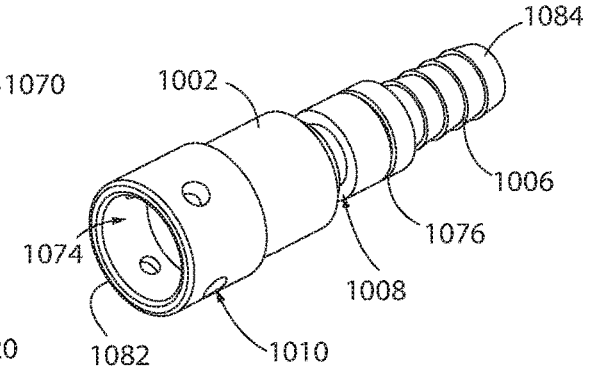
FIG. 31A is a side isometric view of a knob for the connector assembly of FIG. 30A.
Figure 31C:
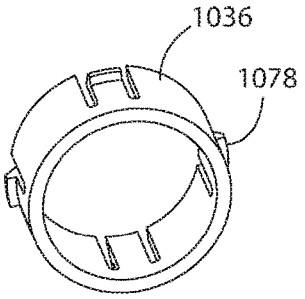
FIG. 31C is a front isometric view of a latch for the connector assembly of FIG. 30A.

With reference to FIGS. 29B and 31A, the knob 1020 is actuated by a user to release and/or connect a hose assembly 1100. In one embodiment, the knob 1020 may be pulled or pushed by a user, rather than turned, but in other embodiments may be manipulated in other manners to actuate the connection. The knob 1020 may include a lower body 1072 having an oblong keyed shape configured to be positioned within and engage the interior surfaces of the shells 816*a*, 816*b*. Extending outwards from the lower body 1072 is the user engagement surface 1068. The user engagement surface 1068 may include a lower lip 1080 formed at its bottom end that transitions to form a convexly curved tapering surface. This user engagement surface 1068 can be engaged by a user to actuate the knob and the shape is aesthetically pleasing and helps to cradle a user's fingers to allow easier actuation of the knob 1020.

A retaining groove 1070 or other element is defined on an interior surface of the user engagement surface 1068 of the knob 1020. The retaining groove 1070 may be an annular groove and is configured to interact with the latch assembly as discussed in more detail below.

Figure 30A:
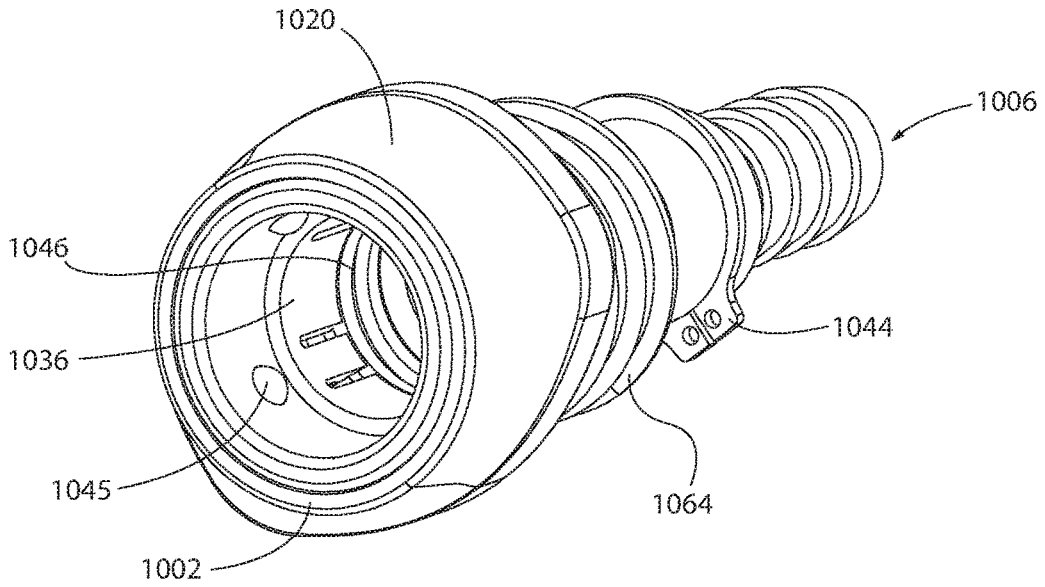
FIG. 30A is an isometric view of a connector assembly for the skin brush of FIG. 18A.
Figure 30B:
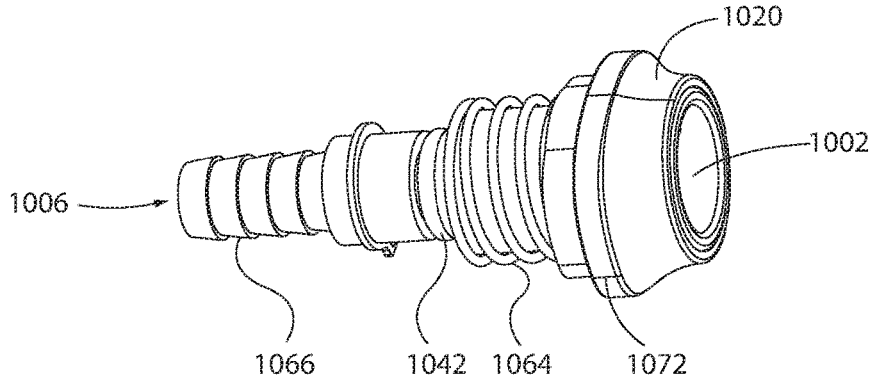
FIG. 30B is a side isometric view of the connector assembly of FIG. 30A.

With reference to FIGS. 30A, 30B, and 31A, the hose connector 1002 may be a generally cylindrical body that tapers from a first end 1082 to a second end 1084. The first end 1082 defines a connector inlet 1074 and the second end 1084 defines a connector outlet 1006, the connector inlet 1074 and connector outlet 1006 are fluidly connected by the lumen 1086 that extends through the length of the hose connector 1002. With reference to FIG. 29B, the interior surface of the hose connector 1002 may include one or more internal features that interact with other components of the connector assembly 806. For example, a seat 1012 is defined in a middle section of the connector inlet 1074 and a lip 1009 is defined towards an end of the hose connector 1002. The seat 1012 and lip 1009 help to retain the latch biasing element 1046 and latch 1036 in the desired positions, as discussed below.

A plurality of ball apertures 1010 may be defined towards a top end of the hose connector 1002. The ball apertures 1010 may be spatially separated from one another and in some embodiments are defined as circular apertures. With reference to FIG. 29B, in one embodiment, the ball apertures 1010 have a tapered shape that tapers from the outer surface of the hose connector 1002 as they extend toward the interior surface. The tapered shape helps to secure the retention balls 1045 to the hose connector 1002, but also allows the retention balls 1045 to move closer and farther away from the interior surface of the hose connector 1002 for the reasons discussed in more detail below.

The hose connector 1002 may also include external features, such as grooves 1008, 1076 for receiving sealing elements or retaining elements, such as clip 1044. In one embodiment, the grooves 1008, 1076 are formed as annular grooves, but in other embodiments can be differently configured, e.g., notches, channels, or the like. The hose connector 1002 may also include one or more barbs 1066 defined towards the second end 1084. The barbs 1066 assist in securing the hose connector 1002 to the connection hose 828 as they grip the interior surfaces of the hose connection 828.

The latch 1036 activates and secures the connection between the hose and the brush as explained below. The latch 1036 may be defined as a generally cylindrical member and may include one or more tangs 1078 connected or defined on the outer surface thereof. The tangs 1078 may include tabs 1079 that extend outwards from the bottom edge. In some embodiments, the tangs 1078 may be separated from the latch 1036 body by longitudinal slots that extend along a portion of the length of the latch 1036. The slots allow the tangs 1078 to be more flexible, which may allow the latch 1036 to be more easily inserted into the hose connector 1002 as described below.

Assembly of the Brush

Assembly of the brush 800 will now be discussed. With reference to FIGS. 20B, 22A, and 26, the drive assembly 814 is inserted into and connected to the second shell 816*b*. In particular the gear mount 872*a* is positioned on the interior bottom surface 853 in the head portion 833 of the second shell 816*b*. With the securing brackets 934*b*, 934*d*, 934*f* are aligned with securing brackets 846*a*, 846*b*, 846*c* of the head portion 833 and fasteners are received therein secure the components together. In this configuration, with reference to FIG. 26, the motor 860 extends at an angle partially into the elongated portion 832 of the second shell 816*b*. The main shaft 874 is aligned with and positioned within the drive aperture 848 such that the engagement end 898 is accessible through the outer surface of the second shell 816*b*. A seal 888, such as a U-cup or an O-ring 825 may be positioned around the main shaft of the drive assembly.

The control assembly 820 is connected to the second shell 816*b*, with the button assembly 952 positioned in the button platform 838. The switches 938*a*, 938*b* are electrically and structurally connected to the button platform 838 with the bracket walls 840 securing the switches 938*a*, 938*b* and button assembly 952 in position.

The batteries 950*a*, 950*b* are electrically connected to the circuit board 948 and are coupled to the circuit board at an angle relative to one another. The circuit board 948 is then positioned within the head portion 833 of the second shell 816*b* around the drive assembly 814 and the gear amount 872*b*. In this manner, the batteries 950*a*, 950*b* are positioned around different sides of the drive assembly 814 and are angled around the drive aperture 848 in the head portion 833 of the second shell 816*b*. In other words, the batteries 950*a*, 950*b* are arranged so that they do not intersect a center area of the brush head. This battery orientation assists in balancing the weight of the head portion 833 so that the weight is more evenly distributed. Additionally, the positioning allows more room for larger batteries within the small area of the head portion 833. In some embodiments, the batteries 950*a*, 950*b* are positioned at an acute angle relative to one another.

The barbed end 958 of the elbow hose 830 is inserted into the first end of the connection hose 828 to connect the elbow hose 830 to the connection hose 828. The elbow hose 830 and connection hose 828 are then positioned in the elongated portion 832 of the second shell 816*b*. The bracket 960 may be secured to a hose connector structure on the bottom of the second shell 816*b* and routes the elbow hose 830 from alignment with substantially the middle of the handle cavity 834 to adjacent on the sidewalls of the second shell 816*b*. The connector 954 is secured to the connection structure in the second shell 816*b* and is fluidly coupled to the outlet aperture 844.

With reference to FIGS. 20A and 21B, the charging coil 826 is positioned within the coil channel 858 on the exterior surface 857 of the head portion 833 of the second shell 816*b*. The charging coil 826 is constrained in position by the separating wall 856 and is positioned around the drive aperture 848. The charging coil 826 includes an opening in the center for passage of the brush shaft 976 into the drive assembly 814 when positioned on the exterior surface 857.

The spray plate 822 is then positioned within the head portion 833 and seated on the top edges of the separating wall 856 and the interior wall surrounding the drive aperture 848. In this manner, the spray plate 822 is positioned above the fluid channel 854 defining a gap to provide a fluid pathway around the exterior surface 857 of the head portion 833. The annular spray wall 964 of the spray plate 822 is aligned so as be adjacent the nozzle ring 845 on the head portion 833. In some embodiments, the spray plate 822 sits against and interfaces with the interior wall of the nozzle ring 845 such that the only exit for the fluid in the head portion 833 is through the nozzle channels 852. This ensures that the spray pattern is around the ring of the spray plate 822, which will direct fluid around the brush assembly 808. The spray plate 822 may be connected to the nozzle ring 845 of the second shell 816*b* using ultrasonic welding, adhesive, fasteners, or the like.

The trim ring 824 is secured to the around the nozzle ring 845 to provide an aesthetically pleasing appearance for the brush. The trim ring 824 may be secured to the second shell 816*b* using ultrasonic welding, adhesive, fasteners, or the like. A trim bezel 815 may also be connected to the first shell 816*a* in a similar manner.

The connector assembly 806 is connected to the brush housing 813 in stages. With reference to FIGS. 29B and 30A, the seal 1042 is positioned within the groove 1076 of the hose connector 1002. The knob biasing element 1064 is then positioned within the second shell 816*b* of the brush housing 813 between the bottom end 841 of the second shell 816*b* and the backside of the valve securing structure 836. The knob biasing element 1064 seats on the back surface of the valve securing structure 836. The end of the hose connector 1002 defining the barbs 1066 is inserted through the valve securing structure 836 defined on the second shell 816*b* and then inserted into the connection hose 828. The clip 1044 is then clamped around the hose connector 1002 between the connection hose 828 and the valve securing structure 836. The clip 1044 is positioned within the groove 1076 and prevents the hose connector 1002 from being pulled out from the second shell 816*b*.

The latch biasing element 1046 is positioned within the connector inlet 1074 and is positioned on the seat 1012 defined on the interior surface of the hose connector 1002. Retention balls 1045, which may be steel or other metal are positioned in each of the ball apertures 1010 on the hose connector 1002. The latch 1036 is positioned within the connector inlet 1074 with the tangs 1078 engaging the lip 1009 on the interior surface of the connector 1002. To insert the latch 1036, the tangs 1078 may be deformed or flexed inwards, until the latch 1036 moves past the lip 1009 and then released to expand outwards and engage the lip 1009. However, in other embodiments, the latch 1036 may be inserted in other manners.

With continued reference to FIG. 29B, the knob 1020 is positioned around the outer surface of the hose connector 1002 with the lower body 1072 of the knob 1020 inserted between the bottom end 841 of the second shell 816*b* and the hose connector 1002. The knob 1020 is then positioned to engage the knob biasing element 1064 and contain the knob biasing element 1064 within the second shell 816*b*. The knob 1020 and the latch 1036 act to keep the retention balls 1045 within the ball apertures 1010, but as discussed below, allow the retention balls 1045 to move within the ball apertures 1010.

With reference to FIG. 20C, the input buttons 818*a*, 818*b* are connected to the first shell 816*a*. In particular, the seal 942 is received within the annular groove on the stem 937 and the biasing element 936*b* is positioned within the button cavity 992 defined on the first shell 816*a* and positioned around the button wall 994. The stem 937 is then inserted into the aperture defined by the button wall 994. The head portion 935 of the input button 818*a* is seated on top of the top end of the biasing element 936*a*. The clip 940 is positioned around the bottom end of the stem 937 as it extends past the terminal end of the button wall 994. The clip 940 prevents the input button 818*a* from being pulled out of the button cavity 992, but still allows the input button 818*a* to move within the button cavity 992 to activate the switch 938*a*. The second input button 818*b* is assembled in the same manner as the first input button 818*a*.

The first shell 816*a*, including the attached input buttons 818*a*, 818*b*, is then positioned over the top edges 851, 851*b* of the second shell 816*b* and connected thereto. The two shells 816*a*, 816*b* may be connected in substantially any manner, such as, but not limited to, ultrasonic welding, adhesive, fasteners, press fit, or the like.

Once the brush housing 813 is connected together, the brush 800 can be connected to the brush assembly 808. To secure the brush assembly 808 to the brush 800, the brush shaft 976 is aligned with the main shaft 874 of the drive assembly 814 such that the keyed surfaces 990 of the brush shaft 976 align with the engagement walls 904 and the brush shaft 976 is then inserted into the post cavity 902. The connection magnet 884 and connecting magnet 978 are attracted to one another to secure the brush assembly 808 to the brush 800.

Operation of the Brush

Operation of the brush 800 will now be discussed in more detail. With reference to FIGS. 20B and 26, when a fluid source is connected to the connector assembly 806 (an example of which is discussed with reference to FIG. 29C below), fluid flows through the lumen 1086 in the hose connector 1002 and enters the fluid passage 827 of the connection hose 828. From the connection hose 828, the fluid enters into the elbow hose 830 and into the connector 954 of the elbow hose 830. With reference to FIGS. 18A, 21B, and 20A, from the connector 954, the fluid flows through the outlet aperture 844 defined in the interior bottom surface 853 of the second shell 816*b*. From the outlet aperture 844, the fluid flows into the fluid channel 854 and into the nozzle channels 852 defined in the nozzle ring 845 and enclosed by the spray wall 964 of the spray plate 822.

When the brush assembly 808 is connected, the fluid is distributed around the brush assembly 808 in a halo effect by the spray nozzles 812.

With reference to FIG. 20B, when the brush assembly 808 is connected and a user desires to activate motion of the bristles 810, the user compresses input button 818*a* with a force sufficient to overcome the biasing force exerted by the biasing element 936*a*, which moves the stem 937 downwards and compresses the switch 938*a*. The switch 938*a* then electrically connects the motor 860 of the drive assembly 814 to the batteries 950*a*, 950*b*.

With reference to FIGS. 22B, 22C, and 20A, as the motor 860 is powered, the worm gear 866 rotates. The rotation of the worm gear 866 causes the worm wheel gear 910 to rotate around the intermediate shaft 876. As the worm wheel gear 910 rotates, the shaft gear 912, which is formed as a cluster with the worm wheel gear 910, rotates correspondingly. The engagement between the shaft gear 912 and the output gear 878 causes the output gear 878 to rotate as well. In an exemplary embodiment the speed reduction by the gear assembly is as follows: first stage (e.g., drive shaft to worm gear) is 1:23, the second stage (e.g. worm gear to worm wheel) is 12:36, and the final ratio is 69:1 (shaft gear to output gear). In embodiments where the motor rotates at 14,000 RPMs, the final no-load main shaft 874 and brush assembly speed is about 175 RPM. Due to the keyed connection between the output gear 878 and the main shaft 874, the main shaft 874 rotates with the output gear 878. The speed of the brush may be varied as desired and may vary based on the bristle stiffness and orientation, among other factors.

With reference to FIG. 20A, as the main shaft 874 rotates, the brush assembly 808, which is keyed to the main shaft 874 through keyed surfaces 990 on the brush shaft 976, causes the bristle carrier 972 to rotate. As the bristle carrier 972 rotates, the bristle base 970 and bristles 810 rotate as well. Because the bristles 810 are connected to the same bristle base 970, the bristles 810 may rotate generally in unison, with slightly varying speeds based on the radial location of the bristles 810 relative to the center of the bristle base 970. The user can then apply the moving bristles 810 onto his or her skin to remove dead skin, debris, provide a stimulating massage, and/or cleanse the skin.

During use, if the user wishes to change the speed of the brush assembly 808, the user can activate the second input button 818*b* in a similar manner as described above with respect to the first input button 818*a*. As the second input button 818*b* is depressed, the switch 938*b* is activated. The switch 938*b* sends a signal to a processing element on the circuit board 948 or otherwise completes a communication path that either reduces or increases the voltage applied to the motor 860. As the voltage is increased, the rotational velocity of the drive shaft 864 and the attached worm gear 866 increases, thereby increasing the rotational speed of the brush assembly 808. As the voltage is decreased, the motor 860 reduces the rotational speed of the worm gear 866, causing a reduction in the rotational speed of the brush assembly 808.

Hose Connection

Figure 32:
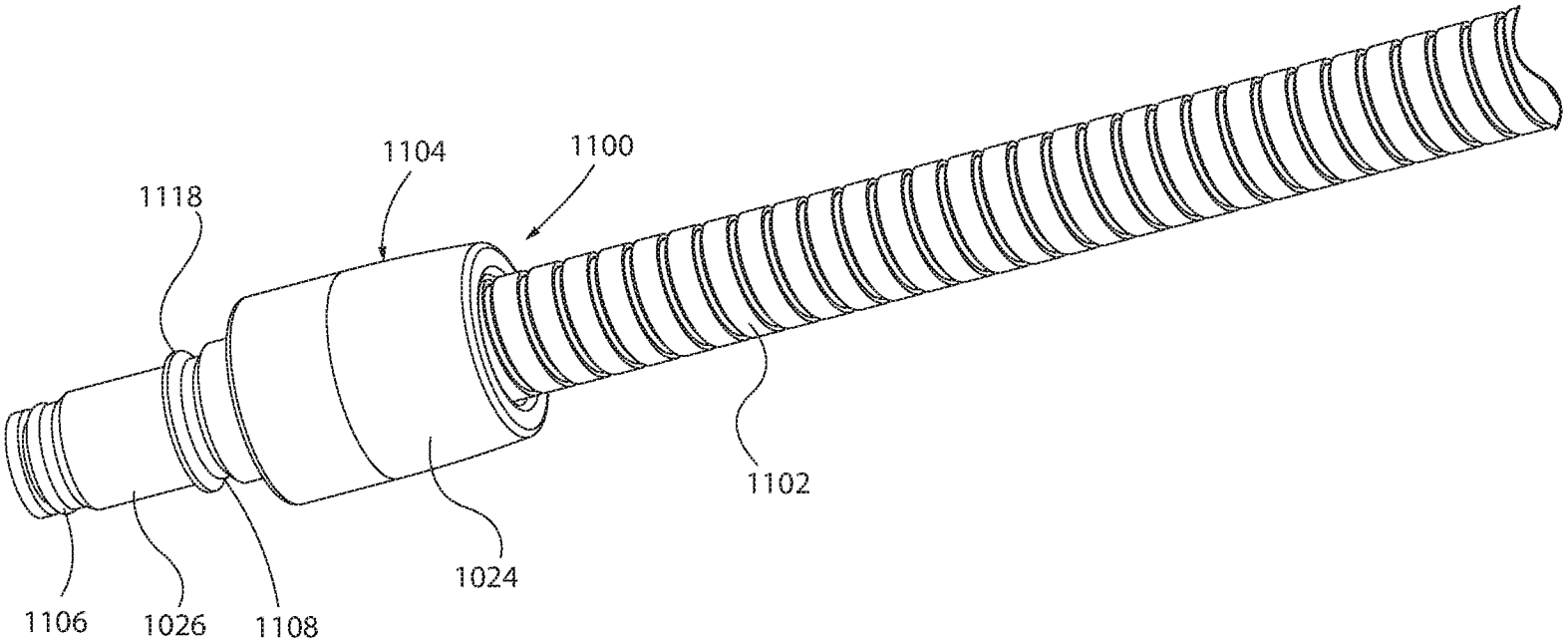
FIG. 32 is an isometric view of a hose connector assembly and a hose that can be connected to the skin brush of FIG. 18A.

As mentioned above, in some embodiments, the brush 800 can be connected to a fluid source to provide a fluid outlet with or separate from the brush motion. In some embodiments, the hose assembly 1100 may be included with the brush 800 for connecting the brush 800 to a fluid source. FIG. 32 illustrates the hose assembly 1100. With reference to FIGS. 29B and 32, the hose assembly 1100 includes a hose 1102 that is fluidly connected to a fluid source, such as a diverter, a J-pipe, a valve, a fixed showerhead, or the like. A hose connector assembly 1104 couples the hose 1102 to the brush 800 and also seals the end of the hose 1102 when not connected to the brush 800. The hose connector assembly 1104 may include a grip sleeve 1024, a valve body 1026, a check valve 1052, and a hose connector 1058, each of which will be discussed, in turn, below.

The hose connector 1058 is a generally cylindrically shaped member having a fluid lumen 1110 defined therethrough. The hose connector 1058 has a diameter sized to be received within the internal fluid path of the hose 1102. Additionally, the hose connector may include a flange 1112 towards an end portion that seats on the outer edge of the terminal end of the hose 1102. In these embodiments, the flange 1112 may have a larger diameter than the internal diameter of the hose fluid pathway so that the flange 1112 can seat on the end of the hose 1102. A threaded connection end 1060 may extend from the flange 1112. The connection end 1060 may have a diameter that is the same or smaller than the flange 1112 or is otherwise configured to mate with the valve body 1026.

With reference to FIGS. 29B and 32, the valve body 1026 defines a cavity 1114 that extends through a length of the valve body 1026. A first end of the valvebody 1026 includes a threaded surface 1062 on an outer surface for engaging the grip sleeve 1024 and a threaded surface 1061 on an interior surface for engaging the hose connector 1058. From the threaded surface 1062, the outer surface of the valve body 1026 transitions to a smooth surface and then defines a latch groove 1108. In some embodiments, the latch groove 1108 may have angled sidewalls that extend from a bottom 1116 of the latch groove 1108 towards the outer surface of the valve body 1026 at an angle, e.g., expand outwards as they extend upwards. A lip 1118 may be defined adjacent the latch groove 1108 and in some embodiments may define a wall of the latch groove 1108. The second end of the valve body 1026 may include a groove 1030 for receiving a sealing member 1106. With reference to FIG. 29B, a check valve seat 1122 may be defined on an interior surface of the valve body 1026. In particular, the check valve seat 1122 may be defined as a shelf that extends into the cavity 1114 from the interior sidewalls and reduces the diameter of the cavity 1114.

The check valve 1052 may include a plunger 1120 that may be a generally cylindrical tube having a valve passage 1048 defined therethrough. One or more flow apertures 1050 may be defined through the sidewalls of the plunger 1120 to allow fluid to enter into the valve passage 1048. A bottom end of the plunger 1120 is sealed by a seal wall 1054, which is selected to have a diameter that matches the diameter of the cavity 1114 of the valve body 1026 beyond the check valve seat 1122, i.e., it matches the reduced diameter of the cavity 1114.

A back end of the plunger 1120 includes a flange 1056 that is spaced apart from the seal wall 1054 to allow a seal 1055 (e.g., and O-ring) to be received therebetween. Additionally, the opposite side of the flange 1056 also defines a seating surface for the biasing element 1126 of the check valve 1052.

To assemble the hose assembly 1100, the hose connector 1058 is inserted into the hose 1102. Optionally, the hose connector 1058 is secured to the end of the hose 1102 such as through threading, a press fit, or the like. For example, in some embodiments, the hose connector 1058 may include one or more barbs 1128 that expand to engage the interior sidewalls of the hose 1102. An optional sleeve 1130 may be inserted onto the hose 1102 before the hose connector 1058 is inserted into the hose 1102 in order to further assist in securing the hose connector 1058 in position and couple the valve body 1026 to the hose 1102.

The grip sleeve 1024 is then received around the hose 1102 and positioned around the sleeve 1130. The plunger 1120 is inserted into the cavity 1114 of the valve body 1026. In one embodiment, the plunger 1120 is inserted through the end of the valve body 1026 defining the threaded surface 1062 and the seal 1055 and flange 1056 are seated on the check valve seat 1122 on the interior of the valve body 1026. The biasing element 1126 is then received around the outer surface of the plunger 1120 and seats on the second surface of the flange 1056 opposite from the check valve seat 1122.

With the check valve 1052 assembled, the valve body 1026 is inserted into a first end of the grip sleeve 1024 and the outer threaded surface 1062 threads onto corresponding threads on the interior of the grip sleeve 1024. Simultaneously, the interior threaded surface 1061 is threaded to and engages the threaded connection end 1060 of the hose connector 1002. The biasing element 1126 is positioned on the outer edge surface of the hose connector 1002, such that the plunger 1120 can move laterally within the valve body 1026 towards the hose connector 1002 by compressing the biasing element 1126.

Figure 33A:
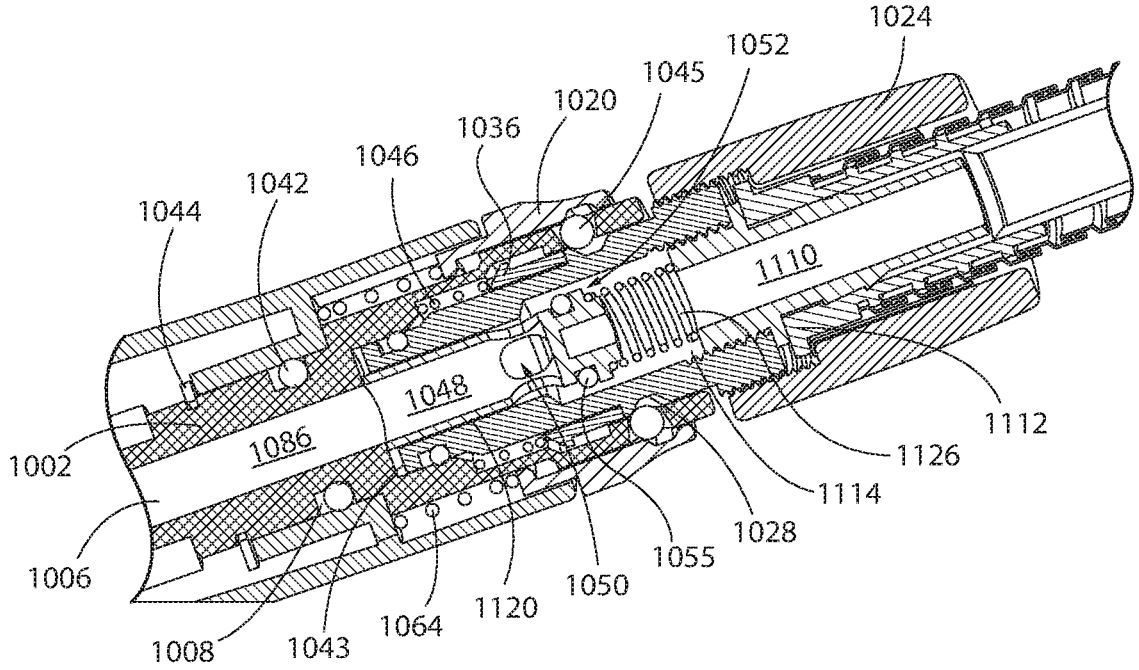
FIG. 33A is a cross-section view of the hose connector assembly being connected to the connector assembly of the skin brush.

Connecting and disconnecting the hose 1102 from the brush 800 will now be discussed in more detail. With reference to FIGS. 29A and 33A, as the user brings the hose 1102 towards the handle 813 of the brush 800, the user inserts the hose connector assembly 1104 and specifically the valve body 1026 and check valve 1052 partially into the connector inlet 1074 of the hose connector 1002. As the check valve 1052 enters the connector inlet 1074, the lip 1118 on the outer surface of the valve body 1026 engages the top edge of the latch 1036, moving the latch 1036 laterally within the connector inlet 1074 and compressing the latch biasing element 1046 towards the seat 1012 within the hose connector 1002.

As the latch 1036 moves, it unblocks the ball apertures 1010, allowing the retention balls 1045 to move inwards towards the interior of the hose connector 1002, i.e., fall further into the ball apertures 1010 and away from the outer surface of the hose connector 1002. This ball movement is shown in FIG. 33A. As the retention balls 1045 drop, the retention balls 1045 disengage from the retaining groove 1070 in the knob 1020. In other words, the retention balls 1045 function as a catch for the knob 1020 and, when moved, they release the knob 1020 to allow the knob 1020 to move.

Figure 33B:
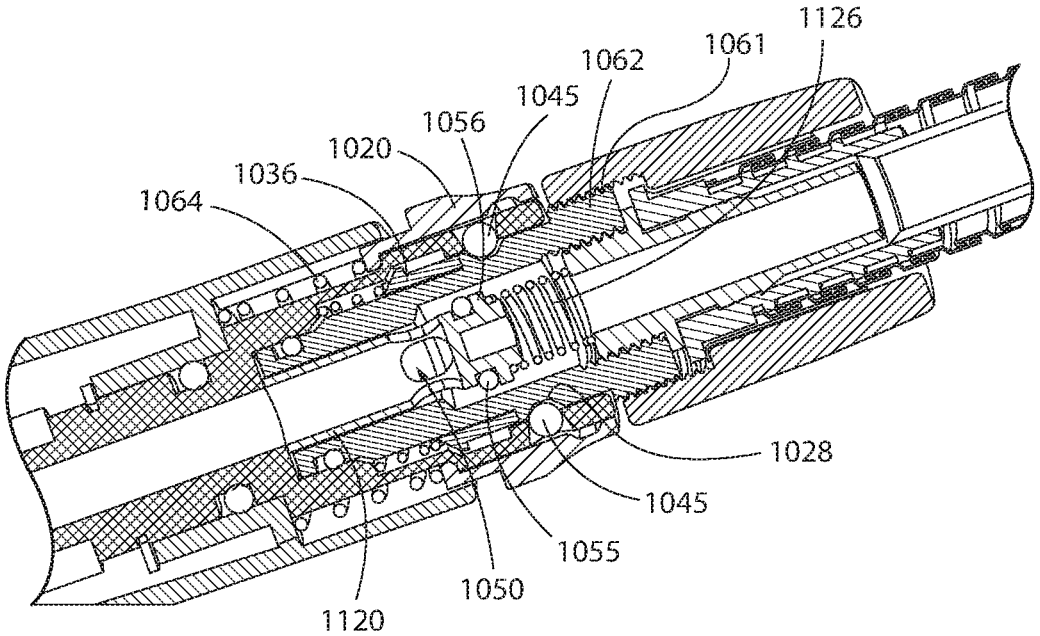
FIG. 33B is a cross-section view of the hose connector assembly being latched to the connector assembly of the skin brush.

As shown in FIG. 33B, once released from the retention ball 1045, the knob biasing element 1064 biases the knob 1020 away from the second shell 816*b* and towards the hose 1102. This movement slides the knob 1020 along the outer surface of the hose connector 1002 towards the grip sleeve 1024, aligning the interior surface of the knob 1026 (i.e., non-grooved portion) with the ball apertures 1010, locking the retention balls 1045 in the groove 1116 on the outer surface of the valve body 1026 and in the ball apertures 1010. This helps to secure the connection between the hose connector assembly 1104, hose 1102, and the connector assembly 806 of the brush.

With reference to FIGS. 33A and 33B, as the valve body 1026 is inserted into the hose connector 1002, the top edge of the plunger 1120 of the check valve 1052 engages the back wall 1043 of the valve body 1026. This engagement compresses the plunger 1120, over the force of the biasing element 1126, towards the hose connector 1058 of the hose connector assembly 1104. The plunger 1120 thus retracts into the valve body 1026, which unseats the seal 1055 and flange 1056 of the plunger 1120 from the check valve seat 1122 within the valve body 1026. This allows the flow apertures 1050 in the plunger 1120 to be in fluid communication with the fluid lumen 1110 in the hose connector 1058 and the fluid flow pathway within the hose 1102. Fluid then can flow through the flow apertures 1050 in the plunger 1120 into the valve passage 1048 in the plunger 1120 and into the lumen 1086 and connector outlet 1006 of the hose connector 1002. As describe above, the fluid then enters the connection hose 828, and the elbow hose 830 and is expelled out of the fluid channels 852 forming the spray nozzles 812 around the spray plate 822.

With reference to FIG. 33B, to release the hose 1102 from the brush 800, the user moves the knob 1020 towards the bottom edge of the second shell 816*b*. As the user moves the knob 1020 towards the second shell 816*b*, the knob 1020 compresses the knob biasing element 1064. As the knob 1020 moves in this direction, the retaining groove 1070 of the knob 1020 aligns with the ball apertures 1010 in the hose connector 1002, allowing the retention balls 1045 to move outwards, disengaging from the groove 1116 in the valve body 1026. The latch biasing element 1046 then biases the latch 1036 towards the hose 1102, pushing the valve body 1026 outwards, further moving the retention balls 1045 into the retaining groove 1070 in the knob 1020. This causes the valve body 1026 and plunger 1120 to move away from the back wall 1043 of the hose connector body 1002. The biasing element 1126 of the check valve 1052 acts with the latch biasing element 1046 to force the valve body 1026 out of the hose connector 1002.

With reference to FIG. 29A, once the valve body 1026 is removed from the connector inlet 1074, the latch 1036 moves to a position adjacent the ball apertures 1010, causing the retention balls 1045 to be seated back in the retaining groove 1070 in the knob 1020, securing the knob 1020 in the disconnected position. Additionally, the check valve 1052 in the valve body 1026, seals the terminal end of the valve body 1026. In particular, the biasing force of the biasing element 1126 biases the plunger 1120 against the check valve seat 1122 in the valve body 1026, causing the seal 1055 to seal against the check valve seat 1122 and the seal wall 1054 to engage the interior walls of the valve body 1026, preventing fluid from the fluid lumen 1110 from reaching the flow apertures 1050 in the plunger 1120, i.e., fluidly disconnecting the flow apertures 1050 from the hose 1102.

Charging Assembly

Figure 34A:
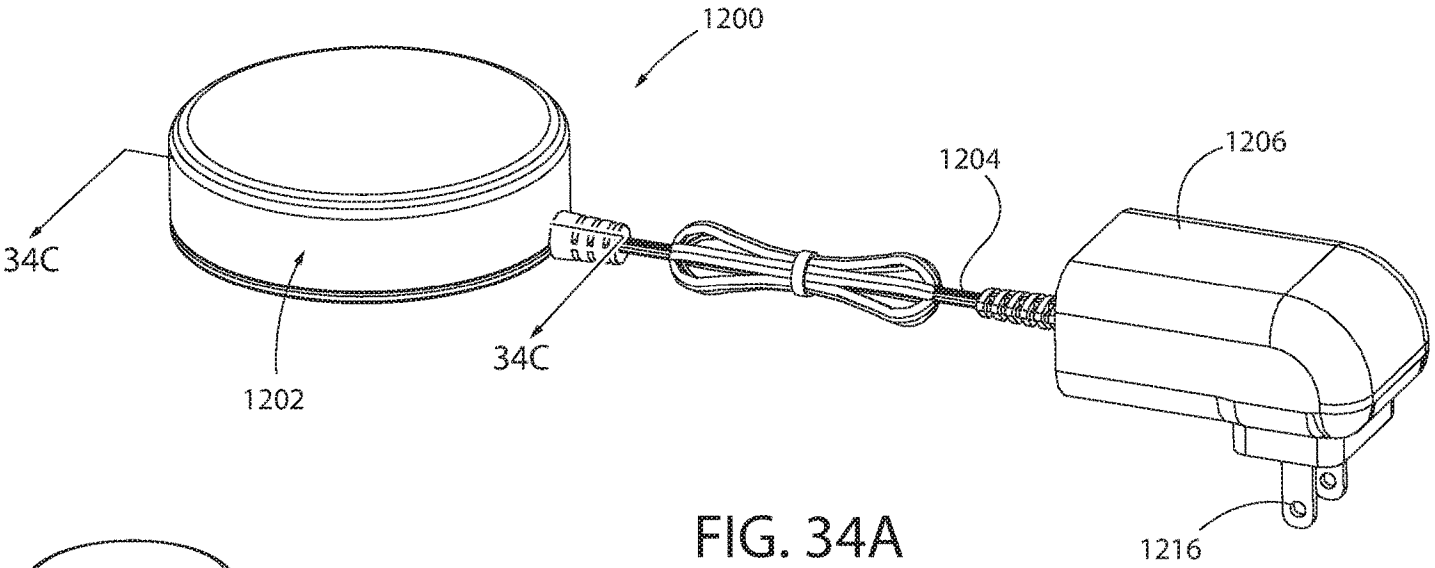
FIG. 34A is an isometric view of a charging assembly that can be used to recharge the skin brush of FIG. 18A.
Figure 34C:
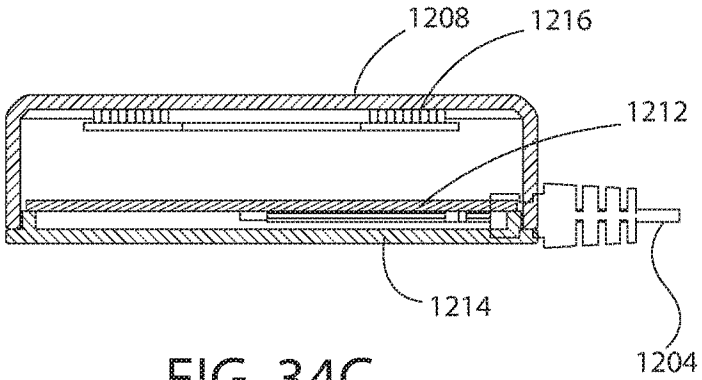
FIG. 34C is a cross-section view of the charging assembly of FIG. 34A taken along line 34C-34C in FIG. 34A.
Figure 34B:
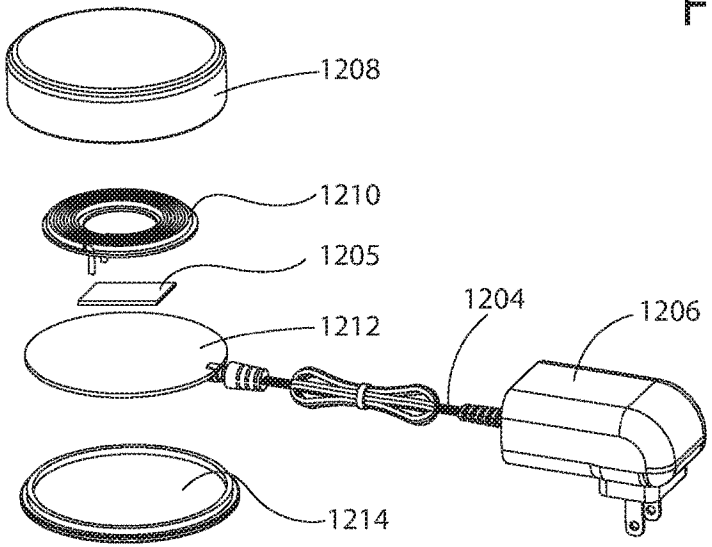
FIG. 34B is an exploded view of the charging assembly of FIG. 34A.

In some embodiments, the batteries 850*a*, 850*b* of the brush 800 may be rechargeable. In these embodiments, the cleansing system may include a charging device for recharging the batteries. FIGS. 34A-34C illustrate various views of an example of a charging device. With reference to FIGS. 34A-34C, the charging device 1200 is used to transfer electricity from a power source (such as a wall outlet, larger battery, etc.) to the batteries 850*a*, 850*b* or other components in the brush 800. In one embodiment, the charging device 1200 is an inductive charger and uses an electromagnetic coil to induce a charge in the corresponding coil in the brush 800. However, in other embodiments, the charging device may connect directly to the brush 800 (e.g., through a charging port or the like) to charge the brush 800 or may use other electrical transfer methods. Additionally, it should be noted that in some embodiments the batteries 850*a*, 850*b* may not be rechargeable and the batteries 850*a*, 850*b* in the brush 800 may be replaced rather than recharged.

With reference to FIG. 34A, in one embodiment, the charging device 1200 includes a charger puck 1202, a cord

1204, and an adaptor 1206. Each of the components is electrically connected together such that current from the adaptor is transferred to the charger puck 120 via the cord 1204. The adaptor 1206 is configured to connect to a power supply, such as wall outlet, and may include one or more electrical contacts 1216, such as prongs, that are received into a wall outlet. The adaptor 1206 may also be configured to invert, regulate, step-down, smooth out, etc., current from the power source before it is transferred to the charger puck 1202, e.g., the adaptor may be an inverter that converts alternating current to direct current.

With reference to FIGS. 34B and 34C, the charger puck 1202 includes a first and second housing pieces 1208, 1214 that connect together to define an enclosure. Within the enclosure, a charge coil 1201 and circuit board 1212 are contained. In some embodiments the first housing piece 1208 may be defined as a generally cylindrical member having an enclosed end. The diameter of the first housing piece 1208 may be selected to substantially match the diameter of the spray plate 822 and/or brush face of the second shell 816*b* of the brush 800 to allow the charger puck 1202 to mate with the brush 800 when the brush assembly 808 is removed. In other embodiments, the first housing piece 1208 may be differently configured.

The second housing piece 1214 acts to enclose the first housing piece 1208 and may be a substantially flat floor that press fits, snaps, or otherwise connects to the bottom edge of the first housing piece 1208.

The charge coil 1210 may be supported beneath or operably connected to the top interior surface of the first housing piece 1208 and electrically connected to the circuit board 1212 which may be supported on the bottom interior surface of the second housing piece 1214. The position of the charge coil 1210 within the first housing piece 1208 may be selected to reduce a gap between the charge coil 1210 of the charging device 1200 and the charge coil 826 of the brush 800.

To recharge the batteries 850*a*, 850*b* of the brush 800, the brush assembly 808 is removed and the brush 800 face is brought into close proximity to the charging device 1200. In some embodiments, the charger puck 1202 meshes with or seats against the spray plate 822 or other outer surface of the brush 800. For example, the charger puck 1202 may generally correspond to the shape and size of the nozzle ring 845 of the second shell 816*b* and be seated within the nozzle ring 845. In these embodiments, the charging coil 826 can be axially aligned with the charge coil 1210, which ensures good power transfer between the brush 800 and the charging device 1200. However, in other embodiments, the devices can be aligned or connected in other manners. The charging device 1200 may include a charging magnet that interacts with the brush magnet 1205 to secure the charging device to the brush head during charging. This helps to ensure that the charging device remains connected to the brush head to ensure efficient charging.

During charging, the power adaptor 1206 transfers power from a wall outlet or other source to the circuit board 1212, which in turn transfers the power to the charge coil 1210. As the charge coil 1210 is powered, a magnetic field is generated. The magnetic field induces a current in the charging coil 826 in the brush 800, which is used to recharge the batteries 850*a*, 850*b*.

In some embodiments, the charging device 1200 may include a connection element, such as a magnetic element, that secures the charging device 1200 to the brush during operation. For example, the charging device 1200 may include a post having a magnetic component that fits into the main shaft 874 and connects to the connection magnet 884 to secure the charger puck 1202 to the brush 808 during charging.

In other embodiments, different connection mechanisms may be used that help to ensure that the charging coil 826 and charge coil 1210 are properly aligned to ensure that they can induce power from the latter to the former.

CONCLUSION

It should be noted that any of the features in the various examples and embodiments provided herein may be interchangeable and/or replaceable with any other example or embodiment. As such, the discussion of any component or element with respect to a particular example or embodiment is meant as illustrative only.

All directional references (e.g., upper, lower, upward, downward, left, right, leftward, rightward, top, bottom, above, below, vertical, horizontal, clockwise, and counterclockwise) are only used for identification purposes to aid the reader's understanding of the examples of the invention, and do not create limitations, particularly as to the position, orientation, or use of the invention unless specifically set forth in the claims. Joinder references (e.g., attached, coupled, connected, joined and the like) are to be construed broadly and may include intermediate members between the connection of elements and relative movement between elements. As such, joinder references do not necessarily infer that two elements are directly connected and in fixed relation to each other.

In some instances, components are described by reference to "ends" having a particular characteristic and/or being connected with another part. However, those skilled in the art will recognize that the present invention is not limited to components that terminate immediately beyond their point of connection with other parts. Thus the term "end" should be broadly interpreted, in a manner that includes areas adjacent rearward, forward of or otherwise near the terminus of a particular element, link, component, part, member or the like. In methodologies directly or indirectly set forth herein, various steps and operations are described in one possible order of operation but those skilled in the art will recognize the steps and operation may be rearranged, replaced or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A handheld brush for contact with a user's skin comprising:

a handle;

a brush head extending from the handle;

a connection magnet positioned within the brush head;

a brush assembly releasably coupled to the brush head, the brush assembly comprising:

a bristle base;

a plurality of bristles extending from an outer surface of the bristle base; and a brush magnet supported by the bristle base; and a drive assembly for rotating the brush assembly, the drive assembly comprising:

a motor having a drive shaft;

a worm gear coupled to the drive shaft and rotatable therewith; and at least one gear engaged with the worm gear;

wherein the connection magnet and the brush magnet attractively connect to releasably couple the brush assembly to the brush head; and wherein the at least one gear is operably coupled to the brush assembly and configured to rotate the brush assembly as the worm gear rotates.

2. The handheld brush of claim 1, wherein the at least one gear comprises an output gear coupled to the brush assembly.

3. The handheld brush of claim 2, wherein the at least one gear further comprises:

a worm wheel gear configured to engage with the worm gear; and a shaft gear coupled to the worm wheel gear and engaged with the output gear.

4. The handheld brush of claim 3, wherein the worm wheel gear and the shaft gear form a cluster gear.

5. The handheld brush of claim 4, wherein the worm wheel gear includes helically shaped teeth and the shaft gear includes straight cut teeth.

6. The handheld brush of claim 3, further comprising:

an intermediate shaft operably coupled to the housing, wherein the shaft gear is mounted on the intermediate shaft; and a main shaft operably coupled to the housing, wherein the output gear is mounted on the main shaft.

7. The handheld brush of claim 6, wherein the brush assembly is operably coupled to the main shaft and the main shaft rotates with the output gear.

8. The handheld brush of claim 6, wherein the intermediate shaft is stationary and the main shaft is rotatable.

9. The handheld brush of claim 1, wherein the at least one gear is a dual plane gear.

10. The handheld brush of claim 1, further comprising:

a plurality of nozzles defined by or connected to the brush head; and a flow path for fluidly connecting the plurality of nozzles to a fluid source.

11. The handheld brush of claim 10, wherein the flow path comprises:

at least one hose received within the handle; and a flow channel defined by a wall of the handle.

12. The handheld brush of claim 11, further comprising a spray plate coupled to a perimeter of a wall of the brush head, wherein the plurality of nozzles are defined by a plurality of channels formed between the perimeter of the wall of the brush head and the spray plate.

13. The brush of claim 12, wherein the plurality of nozzles are positioned and spaced around a perimeter of the brush assembly.

14. A handheld brush for contact with a user's skin comprising:

a handle;

a brush head extending from the handle;

a connection magnet positioned within the brush head; and a brush assembly releasably coupled to the brush head, the brush assembly comprising:

a bristle base;

a plurality of bristles extending from an outer surface of the bristle base; and a brush magnet supported by the bristle base;

wherein the connection magnet and the brush magnet attractively connect to releasably couple the brush assembly to the brush head;

wherein the handle has a fluid inlet and a fluid passage connected to the fluid inlet; and wherein the brush head has a plurality of spray nozzles in fluid communication with the fluid passage and spaced around the brush assembly.

15. The handheld brush of claim 14, wherein:

the brush assembly further comprises a brush shaft extending from an inner surface of the bristle base opposite the outer surface; and the brush magnet is secured to a terminal end of the brush shaft away from the inner surface of the bristle base.

16. The handheld brush of claim 14, further comprising a spray plate connected to the brush head, wherein the spray nozzles are defined by channels formed between a wall surrounding the bristle base and the spray plate.

17. The handheld brush of claim 16, wherein the spray plate is positioned beneath the brush assembly.

18. A handheld brush for contact with a user's skin comprising:

a handle;

a brush head extending from the handle;

a connection magnet positioned within the brush head;

a brush assembly releasably coupled to the brush head, the brush assembly comprising:

a bristle base;

a plurality of bristles extending from an outer surface of the bristle base; and a brush magnet supported by the bristle base;

a drive assembly for driving the brush assembly; and a main shaft rotatable by the drive assembly; wherein:

the connection magnet and the brush magnet attractively connect to releasably couple the brush assembly to the brush head;

the brush assembly further comprises a brush shaft extending from an inner surface of the bristle base opposite the outer surface;

the brush magnet is secured to a terminal end of the brush shaft away from the inner surface of the bristle base;

the connection magnet is mounted on the main shaft; and the brush shaft is removably coupled to the main shaft.

19. The handheld brush of claim 18, wherein the connection magnet and the brush magnet are received within a cavity defined within the main shaft.

20. The handheld brush of claim 18, wherein:

the drive assembly includes an electric motor; and wherein the handheld brush further comprises:

a battery housed within the brush head and connected with the electric motor to provide power to the electric motor; and a charging coil positioned within the brush head and connected with the battery.

21. The handheld brush of claim 20;

further comprising a charging assembly selectively coupled to the handheld brush, wherein when activated the charging assembly induces a current in the charge coil.

22. The handheld brush of claim 21, wherein the brush assembly is detached from the brush head to electronically couple the charging assembly to the charge coil.

23. The handheld brush of claim 21, wherein the charging assembly comprises a charging magnet that interacts with the brush magnet to secure the charger to the brush head.

* * * * *